US006027868A

United States Patent [19]

Iwagaki et al.

[11] Patent Number: 6,027,868

[45] Date of Patent: Feb. 22, 2000

[54] MONOCHROME IMAGE FORMING SILVER HALIDE LIGHT-SENSITIVE MATERIAL AND PHOTO-TAKING UNIT USING THE SAME

[75] Inventors: Masaru Iwagaki; Toshihiko Iwasaki, both of Hino, Japan

[73] Assignee: Konica Corporation, Japan

[21] Appl. No.: 08/913,454

[22] PCT Filed: Mar. 25, 1997

[86] PCT No.: PCT/JP97/00703

§ 371 Date: Sep. 4, 1997

§ 102(e) Date: Sep. 4, 1997

[87] PCT Pub. No.: WO97/33194

PCT Pub. Date: Dec. 9, 1997

[30] Foreign Application Priority Data

| | | | |
|---|---|---|---|
| Mar. 6, 1996 | [JP] | Japan | 8-049043 |
| May 30, 1996 | [JP] | Japan | 8-136765 |

[51] Int. Cl.[7] ..... G03C 1/40

[52] U.S. Cl. ..... 430/559; 430/390

[58] Field of Search ..... 430/543, 559, 430/570

[56] References Cited

U.S. PATENT DOCUMENTS

| | | | |
|---|---|---|---|
| 4,315,069 | 2/1982 | Scott et al. | 430/365 |
| 4,368,255 | 1/1983 | Borg | 430/351 |
| 4,542,091 | 9/1985 | Sasaki et al. | 430/503 |
| 4,970,139 | 11/1990 | Bagchi | 430/546 |
| 5,006,452 | 4/1991 | Bucci | 430/544 |
| 5,089,380 | 2/1992 | Bagchi | 430/546 |
| 5,104,776 | 4/1992 | Bagchi et al. | 430/546 |
| 5,182,189 | 1/1993 | Bagchi et al. | 430/546 |
| 5,380,631 | 1/1995 | Nozawa et al. | 430/504 |
| 5,532,117 | 7/1996 | Merkel et al. | 430/504 |
| 5,635,340 | 6/1997 | Mano et al. | 430/357 |
| 5,763,146 | 6/1998 | Reynolds et al. | 430/564 |

FOREIGN PATENT DOCUMENTS

| | | |
|---|---|---|
| 0600377 | 8/1994 | European Pat. Off. . |
| 2038870 | 8/1971 | France . |
| 1287038 | 2/1970 | United Kingdom . |

OTHER PUBLICATIONS

Research Disclosure No. 17123 (Jul. 1978).
European Search Report EP 97 90 6845.

*Primary Examiner*—Hoa Van Le
*Attorney, Agent, or Firm*—Jordan B. Bierman; Bierman, Muserlian and Lucas

[57] ABSTRACT

Disclosed are a silver halide light-sensitive material for forming a monochrome-image which material is colored in orange, a silver halide light-sensitive material for forming a monochrome-image which material has an identical printing level as at least one of the silver halide color light-sensitive materials provided for a negative-positive type color photographic system, and a photo-taking unit loading and packaging in a photographable state at least one of the monochrome image forming silver halide light-sensitive material. The invention provides a silver halide light-sensitive material for forming a monochrome-image which is suitable for a negative-positive system color photographic processing and is easy for printing onto a photographic paper.

29 Claims, 1 Drawing Sheet

MONOCHROME IMAGE FORMING SILVER HALIDE LIGHT-SENSITIVE MATERIAL AND PHOTO-TAKING UNIT USING THE SAME

FIELD OF THE INVENTION

The present invention relates to a monochrome-image-forming silver halide light-sensitive material suitable for the photographic processing of a negative-positive type color photographic system and a photo-taking unit using the same.

BACKGROUND OF THE INVENTION

In the photographic systems which are currently abundant, a silver halide color light-sensitive material for photography (a color negative film) is loaded into a camera for photographing and a color photographic paper is printed from a so-called color negative film developed to obtain a positive color print (a negative-positive system). Alternatively, in a reversal processing type silver halide color light-sensitive material (a color reversal film) for photographing, a positive image can be obtained only with reversal developing. Therefore, it is viewed as it is or is viewed with a slide projector. In addition, a positive color print can be made (a positive-positive style). However, since the color reversal film has narrow photographing latitude, it is not suitable for easy photographing. In addition, a positive color print is expensive. Therefore, aforesaid positive-positive system has not got ahead of aforesaid negative-positive system. In addition, due to appearance of a photo-taking unit housing an unexposed color negative film with a photographable state, i.e., a so-called lens-fitted film, opportunity of photographing a color negative film has further increased. Accordingly, the position of the negative-positive type has been solidified.

Among proliferation of aforesaid color photographic system, a black-and-white silver halide light-sensitive material for photographing has caused a calm boom. It is assumed that, in the overflow of color photography, a monochrome image is felt to be fresh in return and that its peculiar description is felt to be mysterious. The main users of the black-and-white light-sensitive material for photography was a professional and advanced amateur. However, in April, 1995, "Film In-Mini B & W" was released, enabling any people to be able to enjoy photographing using a black-and-white silver halide light-sensitive material. Since it obtained unexpected reputation, the photographic industry field had to take notice of.

However, since the photographic processing method of the black-and-white silver halide light-sensitive material for photographing is different from that of a negative-positive type color photographic system which has been proliferating. Therefore, there is a big trouble to labs in the city to select the black-and-white silver halide light-sensitive material to handle. In addition it is necessary to newly install a photographic processing steps for the black-and-white silver halide light-sensitive material.

On the contrary, a monochrome image forming silver halide light-sensitive material for photographing which is suitable for the photographic processing of a commonly-prevailing negative-positive type color photographic system is known. In U.S. Pat. Nos. 2,592,514 and 4,348,474, Japanese Patent Publication No. 59136/1988 and Japanese Patent Open to Publication (hereinafter, referred to as Japanese Patent O.P.I. Publication) No. 236550/1986, a monochrome image forming silver halide light-sensitive material using a black coupler is disclosed.

U.S. Pat. Nos. 2,181,944, 2,186,736, 4,368,255, 5,141844 and Japanese Patent O.P.I. Publication Nos. 56838/1982, 58147/1982, 215645/1983, 107144/1991, 214357/1994 and 199421/1995 and Japanese PCT Application Publication No. 505580/1994 disclose technologies to form a black dye image by mixing a yellow coupler, a magenta couple and a cyan coupler which are used for a conventional silver halide color light-sensitive material. However, all of the above-mentioned technologies have a shortcoming that printing onto a photographic paper is complicated though photographic processing can be commonalized. If the above-mentioned technologies are used for color photographic processing, either coloring component collapses balance with other coloring components due to difference of coupler reactivity. Therefore, it was difficult to obtain neutral gray throughout the entire density regions. In addition, processing fluctuation occurred due to developing agent density, pH, temperature and contamination so that it was extremely difficult to stably form a monochrome image. Even in the case of a black-and-white printing, its color tone of final image has warmth and nostalgic sepia tone is favored. It is demanded to easily prepare a monochrome printing in the above-mentioned sepia tone.

On the other hand, in a silver halide color light-sensitive material widely prevailing, a two-equivalent coupler having a favorable coloring property is known as one of a technology which improves sharpness. However, by the use of the above-mentioned means, graininess extremely deteriorates and fogging also increases though sharpness is increased.

An objective of the present invention is to provide a silver halide light-sensitive material which is suitable for a negative-positive system color photographic processing, which is excellent in terms of graininess and processing stability and, simultaneously, which is easy for printing onto a photographic paper and by which sepia tone monochrome printing is easily prepared, a monochrome image forming silver halide light-sensitive material, a photo-taking unit and a monochrome image forming method.

SUMMARY OF THE INVENTION

The monochrome image forming silver halide light-sensitive material of the present invention is colored to orange tints.

It is preferable that a light-sensitive material is colored to orange by incorporating a colored coupler. The colored coupler used here is at least one selected from a yellow-colored magenta coupler, a magenta-colored cyan coupler and a yellow-colored cyan coupler.

It is preferable that the monochrome image forming silver halide light-sensitive material of the present invention has an identical printing level as at least one of the silver halide color light-sensitive materials provided for a negative-positive type color photographic system.

In the embodiments, the above-mentioned monochrome image is formed due to metallic silver formed by developing of silver halide, a dye image forming type coupler, a mixture of a colorless coupler which forms a red image due to color developing and a colorless coupler which forms a blue image due to color developing, and a mixture of a colorless coupler which forms a yellow image, a colorless coupler which forms a magenta image and a colorless coupler which forms a cyan image due to color developing.

The photo-taking unit of the present invention loads at least one selected from the above-mentioned monochrome image forming silver halide light-sensitive material, and is packaged in a photographable state.

Other preferable embodiments will now be listed:

A silver halide light-sensitive material containing a hexa-equivalent coupler.

The above-mentioned silver halide light-sensitive material in which the above-mentioned hexa-equivalent coupler is composed of a two-equivalent yellow coupler, a two-equivalent magenta coupler and a two-equivalent cyan coupler, wherein respective aforesaid two-equivalent couplers are contained in identical oil particles.

A silver halide light-sensitive material having photographic constituting layers composed of at least one light-sensitive layer and at least one non-light-sensitive layer on one side of a transparent support, wherein aforesaid light-sensitive layer contains a silver halide emulsion sensitized to panchromatic light and a dispersed product of a hexa-equivalent coupler.

The above-mentioned silver halide light-sensitive material wherein the silver halide is AgBrI.

The above-mentioned silver halide light-sensitive material wherein aforesaid silver halide contains tabular silver halide grains whose average aspect ratio is 3 or more.

BRIEF DESCRIPTION OF A DRAWING

FIG. 1 is a drawing showing an example of the structure of a photo-taking unit of the present invention.

EXPLANATION OF NUMERALS

1. Photo-taking lens
2. View finder
3. Release button
4. Carton
5. Lens mounting
6. Pilot lamp for charging for a flash light
7. Film counter window
8. Film winding knob

Detailed Description of the Drawings

Figure 1:
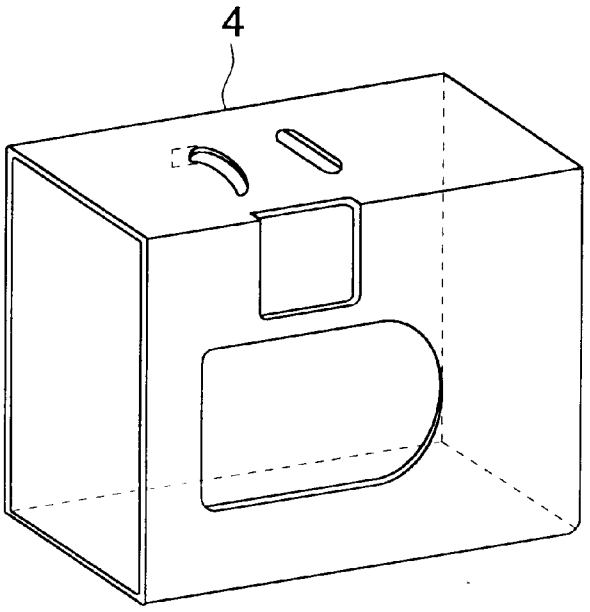
Figure 1:
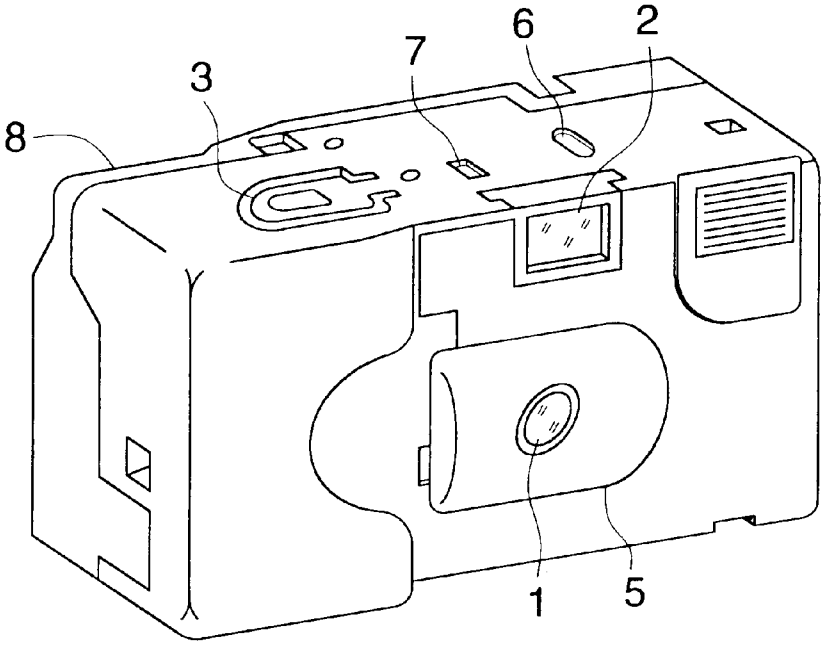

In the present invention, the term orange coloration refers to that the unexposed portions after photographic processing is orange. Aforesaid unexposed portion is necessary to be colored with a dye or a pigment which neither bleaches out nor bleads during photographic processing. The support may be colored. Preferably, a non-eluting and a non-decoloring type dye and a pigment are incorporated in the photographic constituting layers.

In the present invention, it is preferable that a monochrome silver halide light-sensitive material contains a colored coupler as a non-eluting or a non-decoloring dye and a pigment. A colored coupler is conventional in the field of color photography. Aforesaid colored coupler has color hue even when unreacted. It may form a dye image such as a yellow, magenta, cyan and black due to coupling reaction with a color developing agent or it may become colorless. Generally, aforesaid colored coupler is referred to as those whose color hue unreacted is different from the color hue after being colored.

A colored coupler preferable in the present invention is at least one selected from a yellow colored magenta coupler, a magenta colored cyan coupler or a yellow colored cyan coupler.

In the present invention, a yellow colored magenta coupler is defined to have an absorption maximum from 400 nm to 500 nm in the visible absorption region of the coupler and concurrently with this, forms a magenta coupler in which the absorption maximum in the visible absorption region after coupling with an oxidized product of an aromatic group primary amine is from 510 to 580 nm.

A yellow colored magenta coupler of the present invention is preferably represented by the following Formula (1).

$$C_p—N=N—R_1 \qquad \text{Formula (1):}$$

wherein $C_p$ represents a magenta coupler residual group in which an azo group bonds with an active position; and $R_1$ represents a substituted or unsubstituted aryl group.

As a magenta coupler residual group represented by $C_p$, coupler residual groups introduced from a 5-pyrazolone magenta coupler-and a pyrazolotriazole-containing magenta coupler are preferable. The specifically preferable are residual groups represented by the following Formula (2).

Formula (2)

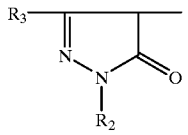

wherein $R_2$ represents a substituted or unsubstituted aryl group; $R_3$ represents an acylamino group, an anilino group, an ureido group or a carbamoyl group; these may all have a substituent.

As an aryl group represented by $R_2$, the preferable is a phenyl group. As a substituent for an aryl group, a halogen atom, an alkyl group (a methyl group and an ethyl group), an alkoxy group, (a methoxy group and an ethoxy group), an aryloxy group (a phenyloxy group and a naphtyloxy group), an acylamino group (a benzamide group and an α-(2,4-di-t-amylphenoxy)butylamide group), a sulfonylamino group (a benzenesulfoneamide group and an n-hexadecanesulfonamide group), a sulfamoyl group (a methylsulfamoyl group and a phenylsulfamoyl group), a carbamoyl group (an n-butylcarbamoyl group and a phenylcarbamoyl group), a sulfonyl group (a methylsulfonyl group, an n-dodecylsulfonyl group and a benzenesulfonyl group), an acyloxy group, an ester group, a carboxyl group, a sulfo group, a cyano group and a nitro group are cited.

As a practical examples of $R_2$, phenyl, 2,4,6-trichlorophenyl, pentachlorophenyl, pentafluorophenyl, 2,4,6-trimethylphenyl, 2-chloro-4,6-dimethylphenyl, 2,6-dichloro-4-methylphenyl, 2,4-dichloro-6-methylphenyl, 2,6-dichloro-4-methoxyphenyl, 2,6-dichloro-4- [α- (2,4-di-t-amylphenoxy)acetoamide]phenyl are cited.

As an acylamino group represented by $R_3$, a pivaloylamino, an n-tetradecaneamide, an α-(3-pentadecylphenoxy)butylamide, a 3-[α- (2,4-di-t-amylphenoxy)acetoamide]benzamide, benzamide, a 3-acetoamidebenzamide, a 3-(3-n-dodecylsuccineimide) benzimide and a 3-(4-n-dodecyloxybenzenesulfoneamide) benzamide are cited.

As an anilino group represented by $R_3$, an anilino group, a 2-chloroanilino group, a 2,4-dichloroanilino group, a 2,4-dichloro-5-methoxyanilino group, a 4-cyanoanilino group, a 2-chloro-5-[α- (2,4-di-t-amylphenoxy)butylamide]anilino group, a 2-chloro-5-(3-octadecenylsuccineimide)anilino group, a 2-chloro-5-n-tetradecaneamideanilino group, a 2-chloro-5-[α- (3-t-butyl-4-hydroxyphenoxy) tetradecaneamide]anilino group and 2-chloro-5-n-hexadecanesulfonamide anilino group are cited.

As a ureido group represented by $R_3$, a methylureido group, a phenyl ureido group and a 3- [α- (2,4-di-t-amylphenoxy)butylamide]phenylureido group are cited.

As a carbamoyl group represented by $R_3$, an n-tetradecylcarbamoyl group, a phenylcarbamoyl group and a 3-[α-(2,4-di-t-amylphenoxy)acetoamide]phenyl carbamoyl group are cited.

As an aryl group represented by $R_1$ a phenyl group or a naphtyl group is preferable.

As a substituent of an aryl group represented by $R_1$, a halogen atom, an alkyl group, an alkoxy group, an aryloxy group, a hydroxy group, an acyloxy group, a carboxyl group, an alkoxycarbonyl group, an aryloxycarbonyl group, an alkylthio group, an arylthio group, an alkylsulfonyl group, an arylsulfonyl group, an acyl group, a sulfonamide group, a carbamoyl group and a sulfamoyl group are cited. Specifically preferable substituents are an alkyl group, a hydroxy group, an alkoxy group and an acylamino group.

Hereinafter, practical examples of a yellow colored magenta coupler will be exhibited.

YCM-1

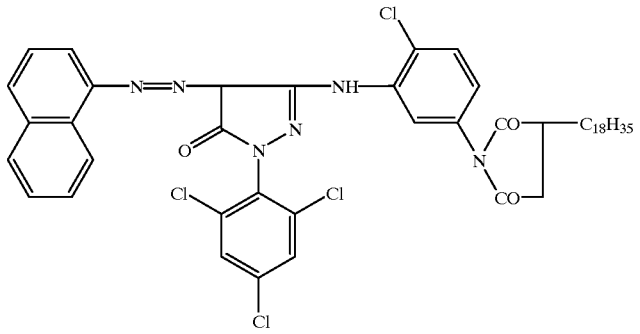

YCM-2

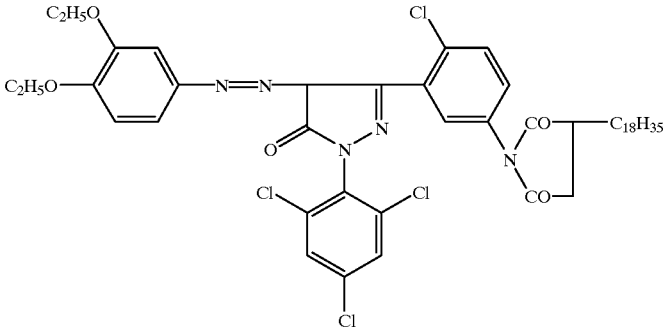

YCM-3

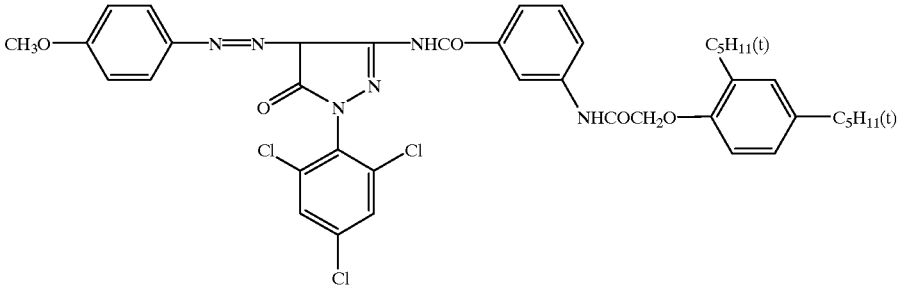

YCM-4

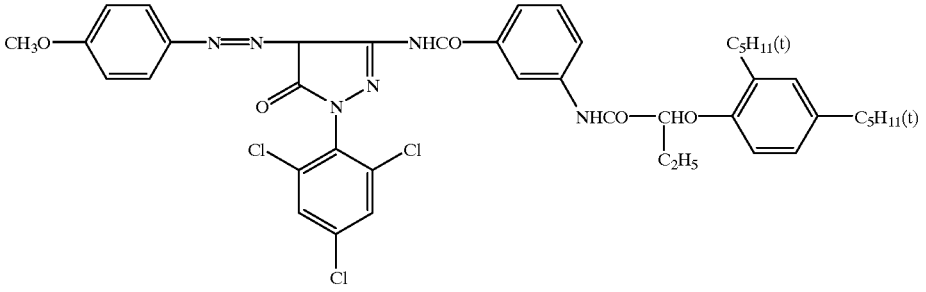

-continued
YCM-5
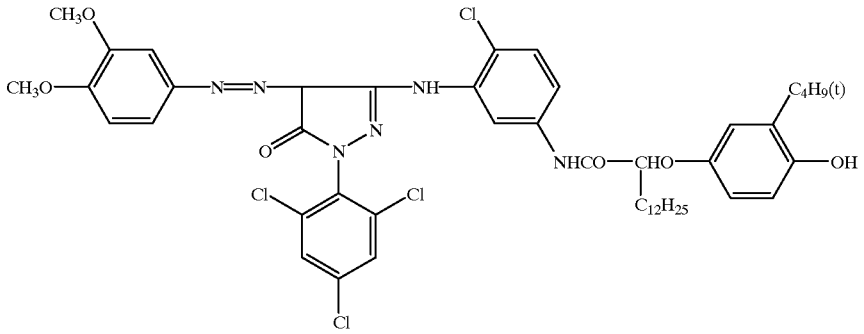
YCM-6
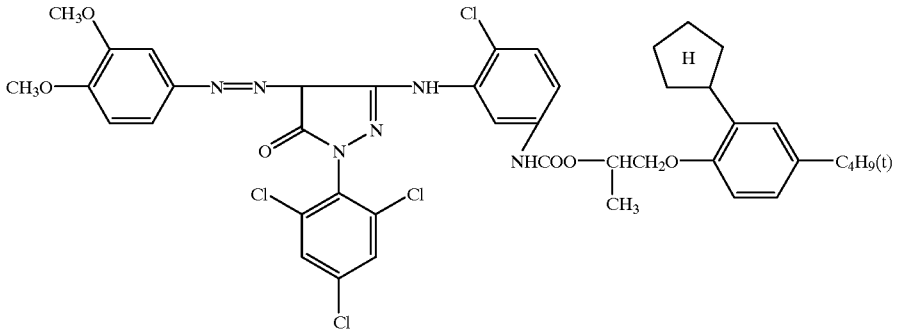
YCM-7
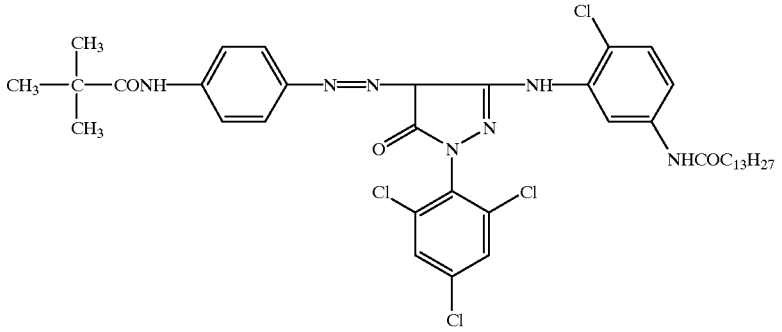
YCM-8
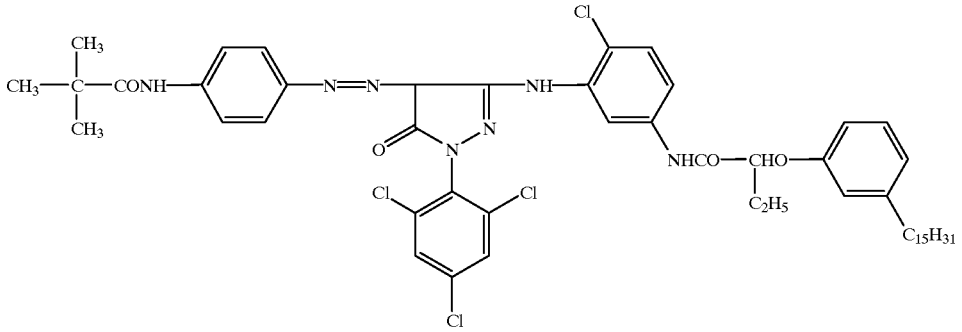

-continued
YCM-9
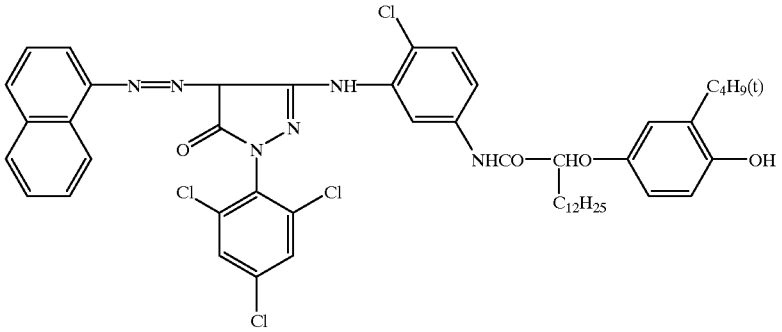
YCM-10
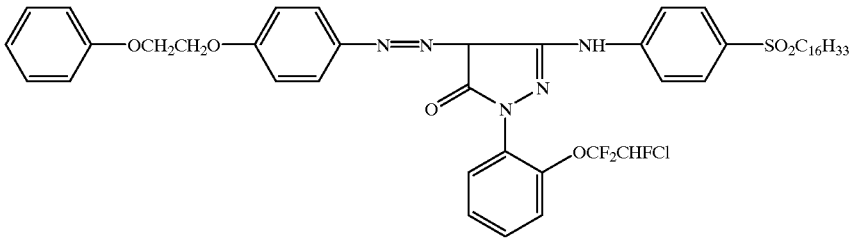
YCM-11
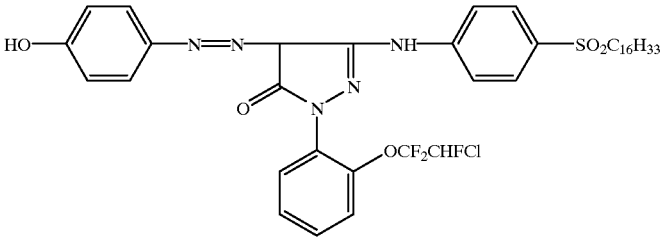
YCM-12
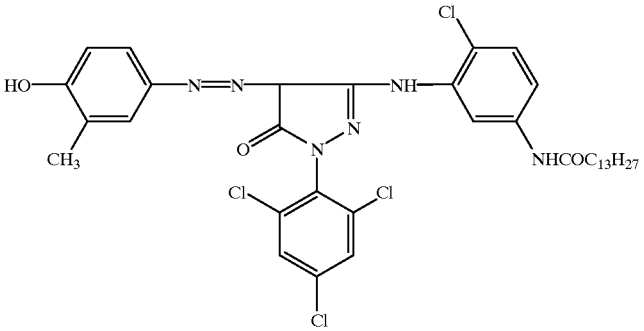
YCM-13
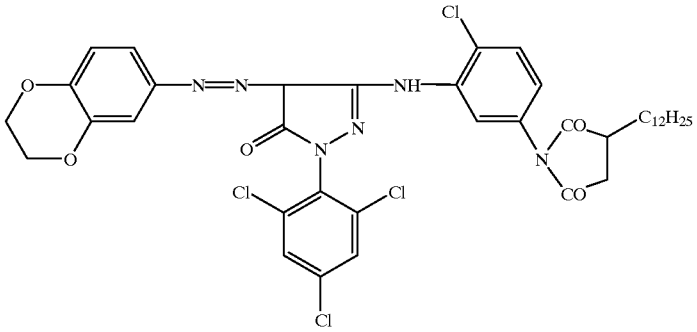

-continued
YCM-14
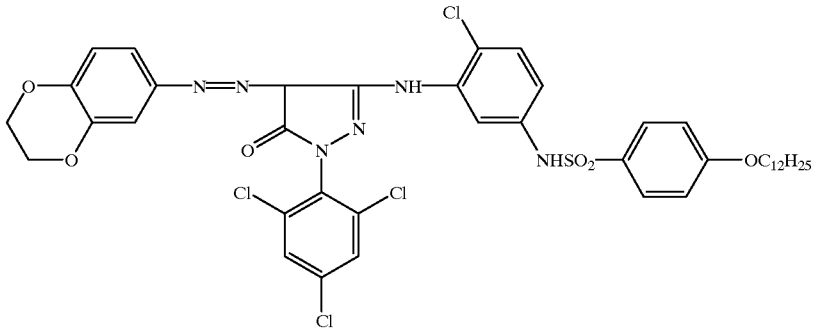
YCM-15
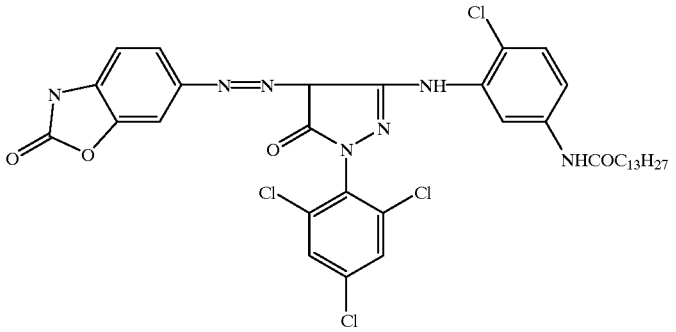
YCM-16
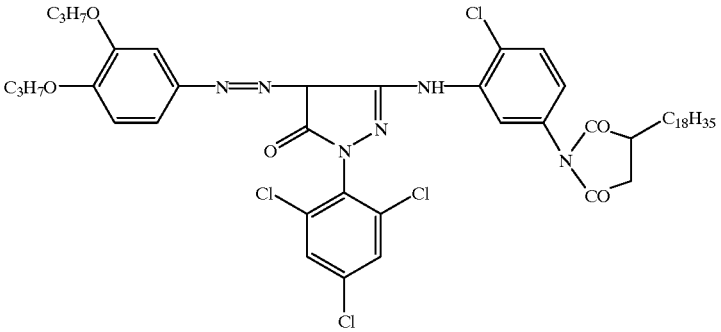
YCM-17
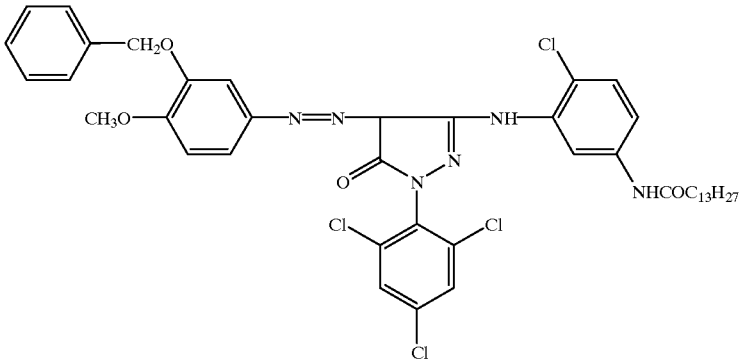

-continued

YCM-18

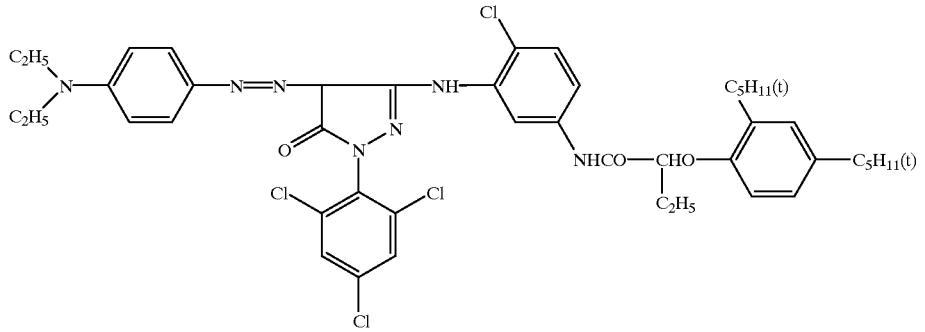

YCM-19

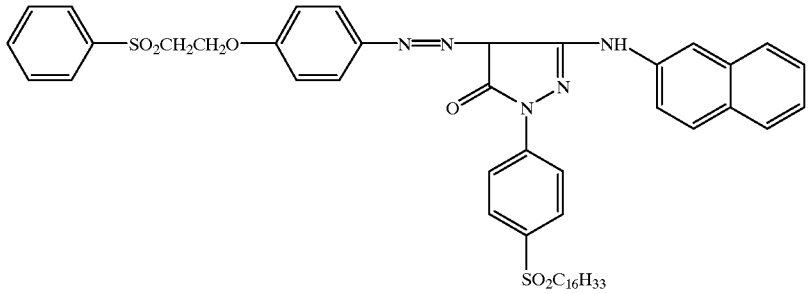

YCM-20

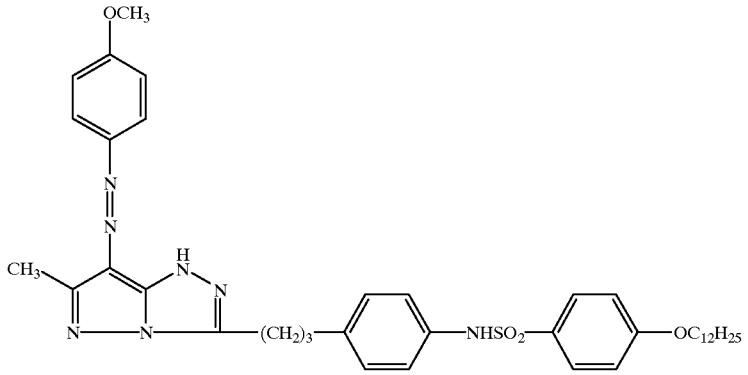

The above-mentioned yellow colored magenta coupler can be synthesized in reference to methods described in Japanese Patent O.P.I. Publication Nos. 123625/1974, 131448/1974, 42121/1977, 102723/1977, 52532/1979 and 172647/1983 and U.S. Pat. Nos. 2,763,552, 2,801,171 and 3,519,429.

A yellow colored magenta coupler of the present invention can be added to an arbitrary layer. It is preferable to be added to at least one of the light-sensitive silver halide emulsion layers. The added amount thereof is ordinarily 0.001 to 0.1 mol, preferably 0.005 to 0.05 and specifically preferably 0.01 to 0.03 per mol of silver halide in the added layer.

In the present invention, a magenta colored cyan coupler has an absorption maximum at visible absorption region of a coupler from 500–600 nm. Concurrently with this, it forms a cyan dye in which the absorption maximum in the visible absorption region is 630–750 nm due to coupling with an oxidized product of an amine color developing agent.

A magenta coupler of the present invention is preferably a compound represented by the following Formula (3).

Formula (3)

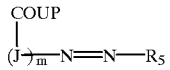

wherein COUP represents a cyan coupler residual group; J represents a divalent combination group; m represents 0 or 1; and $R_5$ represents an aryl group.

As a cyan coupler residual group represented by the COUP, a phenol type coupler residual group and a naphthol type coupler residual group are cited. Preferable is a naphthol type coupler residual group.

As a divalent combination group represented by J, those represented by the following Formula (4) are preferable.

Formula (4)

Formula (4)

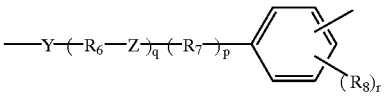

wherein Y represents

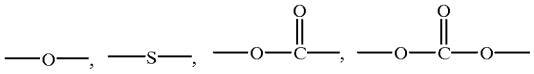

$R_6$ represents an alkylene group or an arylene group respectively having 1 to 4 carbon atoms; $R_7$ represents an alkylene group having 1 to 4 carbon atoms; an alkylene group represented by $R_6$ and $R_7$ may be substituted by an alkyl group, a carboxy group, a hydroxy group and a sulfo group.

A Z represents a —C($R_9$) ($R_{10}$)—, an —O—, an —S—, an —SO—, an —$SO_2$—, —$SO_2$NH—, a —CONH—, a —COO—, an —NHCO—, an NH$SO_2$—and an —OCO—; and $R_9$ and $R_{10}$ independently represents an alkyl group and an aryl group.

$R_8$ represents an alkyl group, an aryl group, a heterocycle, a hydroxy group, a cyano group, a nitro group, a sulfonyl group, an alkoxy group, and aryloxy group, a carboxy group, a sulfo group, a halogen atom, a carbonamide group, a sulfonamide group, a carbamoyl group, an alkoxycarbonyl group or a sulfamoyl group.

p represents 0 or a positive integer; q represents 0 or 1; r represents an integer from 1 to 4. When p represents 2 or more, $R_6$ and Z may be the same or different; when r is 2 or more, $R_8$ may be the same or different.

An aryl group represented by $R_5$ is preferably a phenyl group and a naphthyl group when m is 0. The above-mentioned phenyl group and naphthyl group may have a substituent. As aforesaid substituent, a halogen atom, an alkyl group, an alkoxy group, an aryloxy group, a hydroxy group, an acyloxy group, a carboxyl group, an alkoxycarbonyl group, an aryloxycarbonyl group, a mercapto group, an alkylthio group, an alkylsulfonyl group, an arylsulfonyl group, an acyl group, an acylamino group, a sulfonamide group, a carbamoyl group and a sulfamoyl group are cited.

When m is 1, an aryl group represented by $R_5$ represents preferably a naphthol group represented by the following Formula (5).

Formula (5)

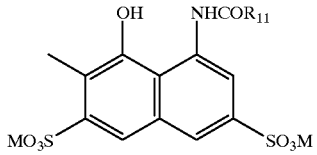

wherein $R_{11}$ represents a straight-chain or branched alkyl group (a methyl group, an ethyl group, a propyl group, an isopropyl group, a butyl group, an s-butyl group and a t-butyl group) respectively having 1–4 carbons; M represents a photographically inactive cation including a cation of a metallic alkali such as a hydrogen atom, a sodium atom and a potassium atom, ammonium, methyl ammonium, ethyl ammonium, diethyl ammonium, triethyl ammonium, ethanol ammonium, diethanol ammonium, pyridinium, piperidium, anilinium, toluidinium, p-nitroanilinium and aninedium.

Hereinafter, practical examples of a magenta colored cyan coupler represented by Formula (3) will be exhibited.

MCC-1

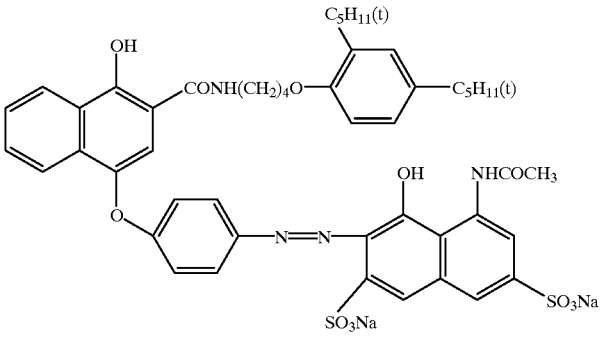

-continued
MCC-2
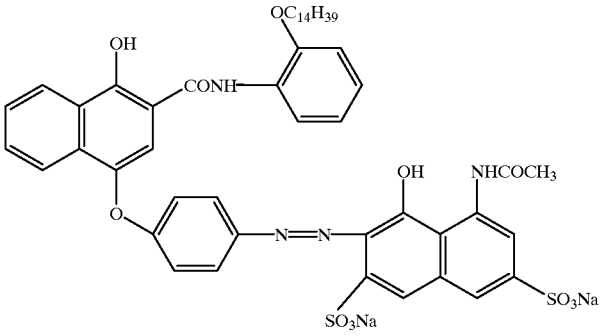
MCC-3
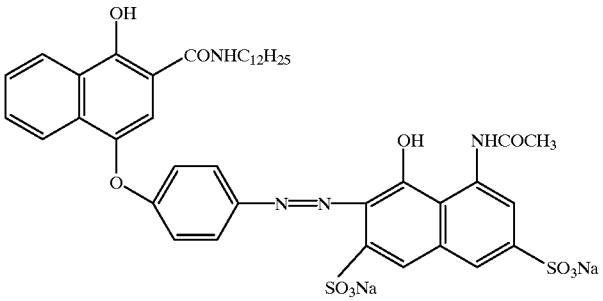
MCC-4
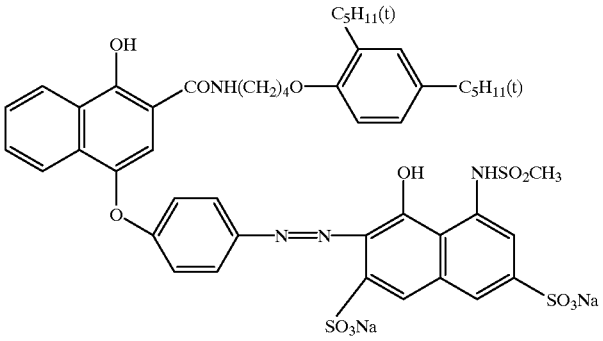
MCC-5
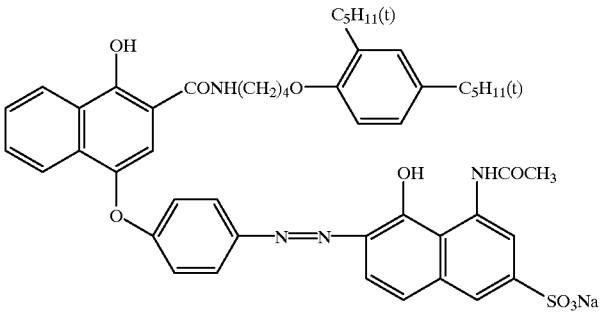

-continued
MCC-6
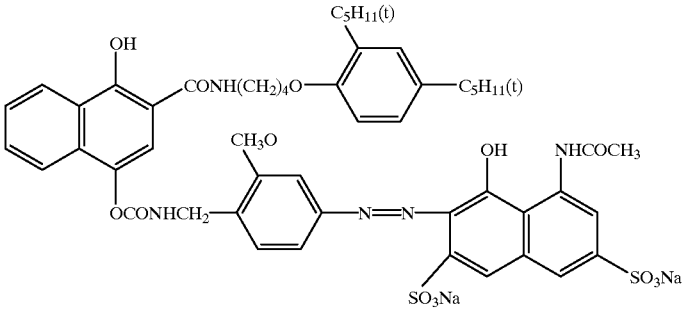
MCC-7
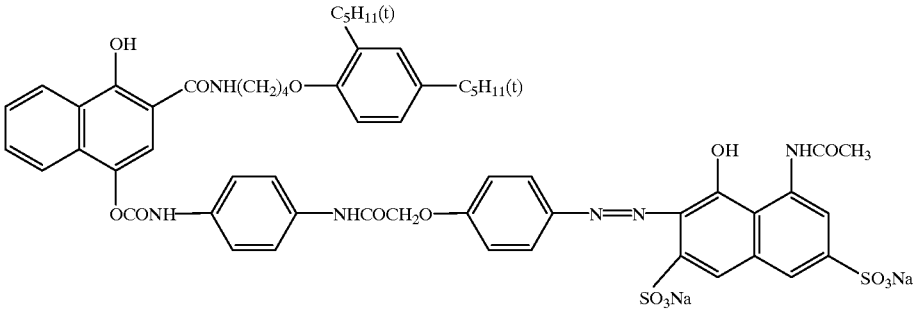
MCC-8
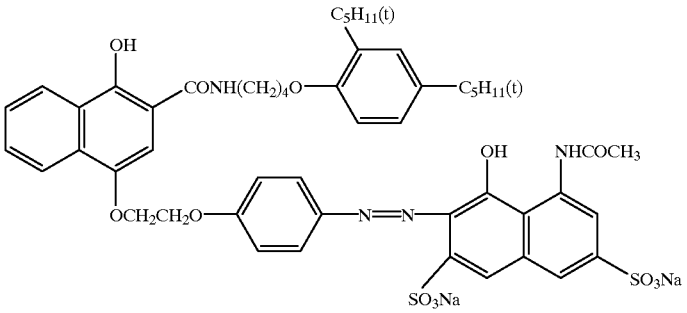
MCC-9
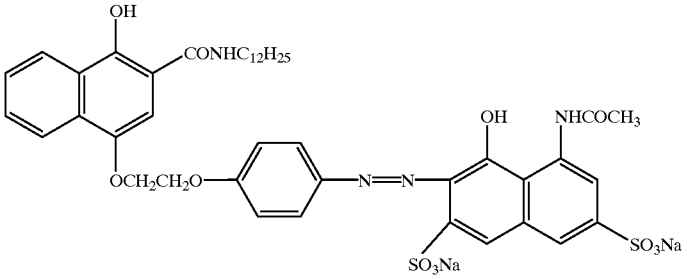
MCC-10
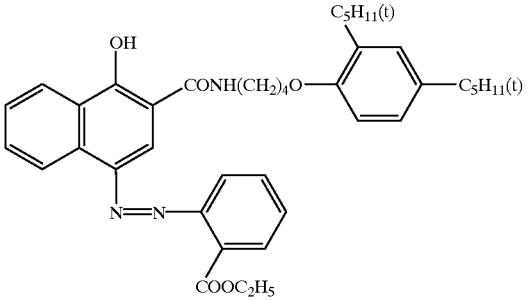

-continued

MCC-11

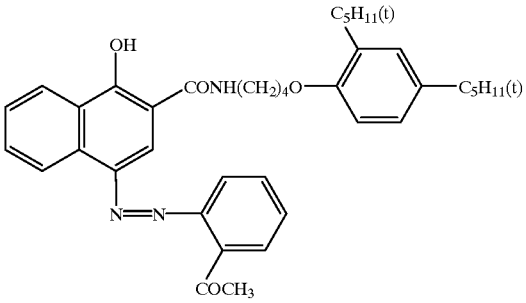

MCC-12

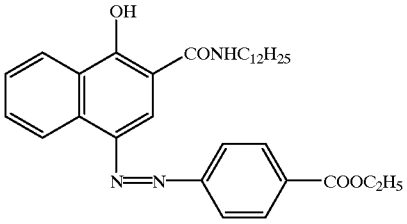

MCC-13

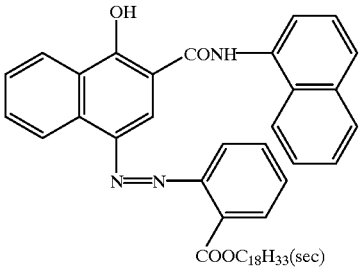

MCC-14

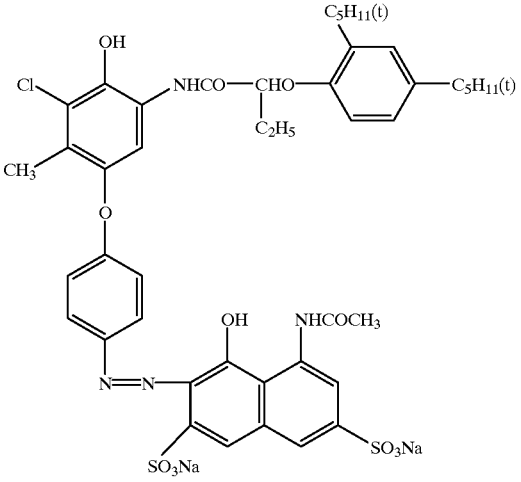

The above-mentioned compounds can be synthesized in reference to methods described in Japanese Patent O.P.I. Publication Nos. 123341/1975, 65957/1980 and 94347/1981 and Japanese Patent Publication Nos. 11304, 32461/1969, 17899/1973 and 34733/1978 and U.S. Pat. Nos. 3,034,892 and British Patent No. 1,084,480.

A magenta colored cyan coupler of the present invention can be added to any arbitrary layer. However, it is preferable to be added to at least one of the light-sensitive silver halide emulsion layers. The added amount thereof is ordinarily 0.001 to 0.1 mol, preferably 0.002 to 0.05 and specifically preferably 0.005 to 0.03 per mol of silver halide in the added layer.

In the present invention, a yellow colored cyan coupler has absorption maximum in the visible absorption region of a coupler from 400–500 nm. Concurrently with this, it forms a cyan dye in which the absorption maximum in the visible absorption region is 630–750 nm due to coupling with an oxidized product of an amine color developing agent. For example, see the description of couplers in Japanese Patent O.P.I. Publication No. 444/1992, pp. 8–26.

As a yellow colored cyan coupler of the present invention, those represented by the following Formulas (6) through (8) which can release a compound residual group containing a water-soluble 6-hydroxy-2-pyridine-5-ilazo group, a water-soluble pyrazolidone-4-ilazo group, a water-soluble 2-acylaminophenylazo group or a water-soluble 2-sulfonamidephenylazo group due to coupling reaction with an oxidized product of an aromatic primary amine developing agent.

Formula (6)

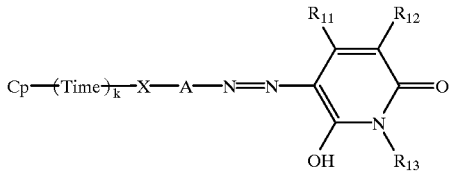

Formula (7)

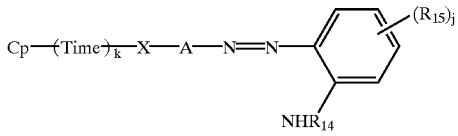

Formula (8)

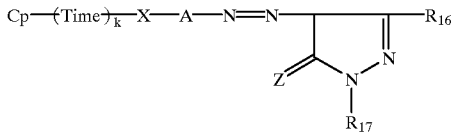

In Formulas (6) through (8), Cp represents a cyan coupler residual group (in which "Time" binds at its coupling position); Time represents a timing group; k represents an integer of 0 or 1; X includes N, O or S, and binds with $(Time)_k$ by means of N, O or S, and binds A with $(Time)_k$; and A represents an arylene group or a divalent heterocycle.

In Formula (6), $R_{11}$ and $R_{12}$ independently represent a hydrogen atom, a carboxyl group, a sulfo group, a cyano group, an alkyl group, a cycloalkyl group, an aryl group, a heterocycle, a carbamoyl group, a sulfamoyl group, a carbonamide group, a sulfonamide group or an alkylsulfonyl group. $R_{13}$ represents a hydrogen atom, an alkyl group, a cycloalkyl group, an aryl group or a heterocycle, provided that at least one of Time, X, A, $R_{11}$, $R_{12}$ or $R_{13}$ includes a water-soluble group (for example, a hydroxyl group, a carboxyl group, a sulfo group, an ammoniumyl group, a phosphono group, a phosphino group and a hydroxysulfonyloxy group).

In Formula (7), $R_{14}$ represents an acyl group or a sulfonyl group; $R_{15}$ represents a group capable of being substituted. i represents an integer of 0 through 4; when j is an integer of 2 or more, $R_{15}$ may be the same or different, provided that at least one of Time, X, A, $R_{11}$, $R_{14}$ or $R_{15}$ includes a water-soluble group (for example, a hydroxyl group, a carboxyl group, a sulfo group, a phosphono group, a phosphino group, a hydroxysulfonyloxy group, an amino group or an ammoniumyl group).

In Formula (8), $R_{16}$ independently represent a hydrogen atom, a carboxyl group, a sulfo group, a cyano group, an alkyl group, a cycloalkyl group, an aryl group, an alkoxy group, a cycloalkyloxy group, an aryloxy group, a heterocycle, a carbamoyl group, a sulfamoyl group, a carbonamide group, a sulfonamide group or an alkylsulfonyl group. $R_{17}$ represents a hydrogen atom, an alkyl group, a cycloalkyl group, an aryl group or a heterocycle, provided that at least one of Time, X, A, $R_{16}$ includes a water-soluble group (for example, a hydroxyl group, a carbamoyl group, a sulfo group, a phosphono group, a phosphino group, a hydroxysulfonyloxy group, an amino group and an ammoniumyl group,). Z represents O or NH.

Next, practical examples of yellow colored cyan couplers will be exhibited.

YCC-1

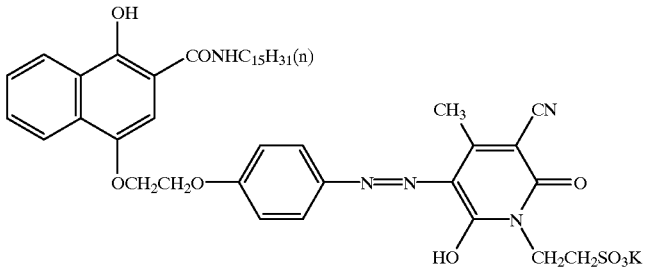

YCC-2

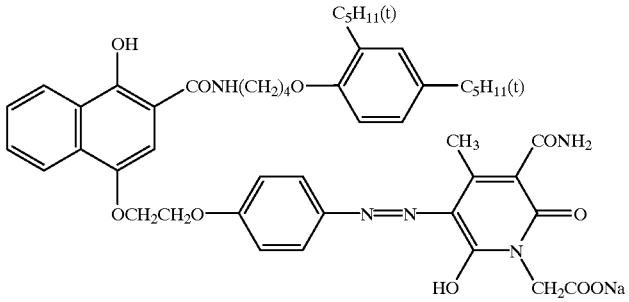

-continued
YCC-3
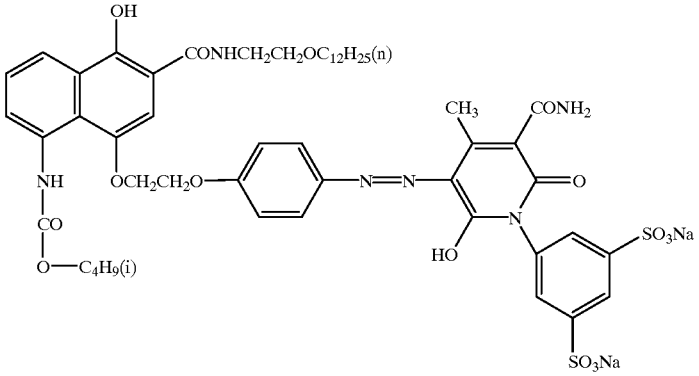
YCC-4
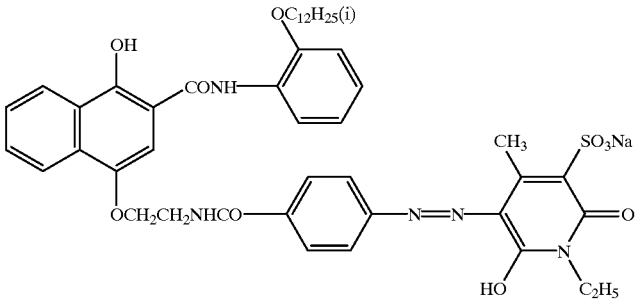
YCC-5
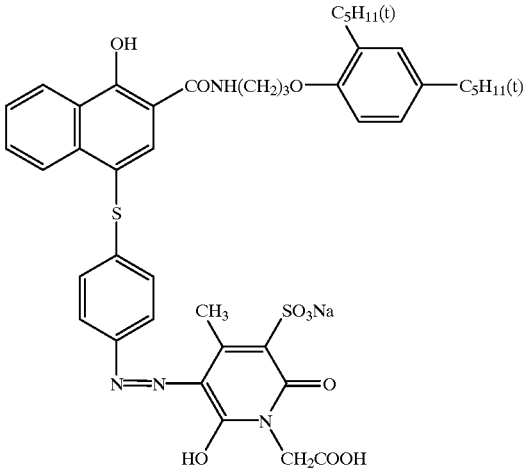
YCC-6
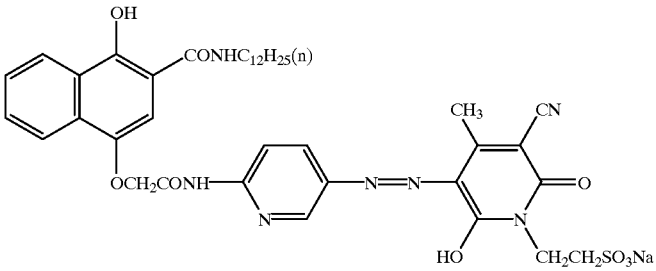

-continued
YCC-7
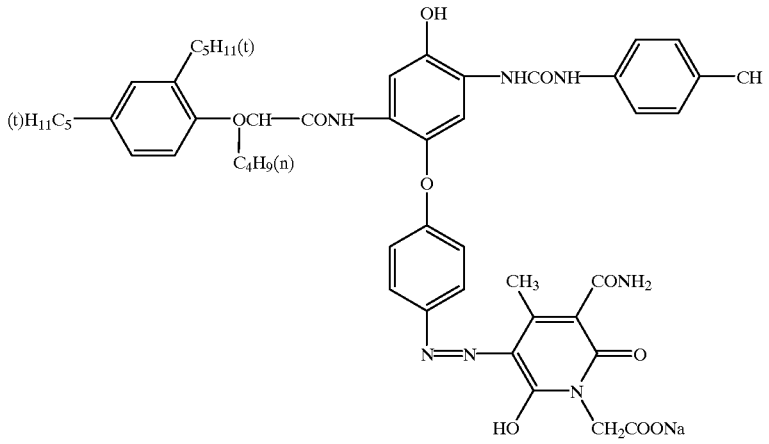
YCC-8
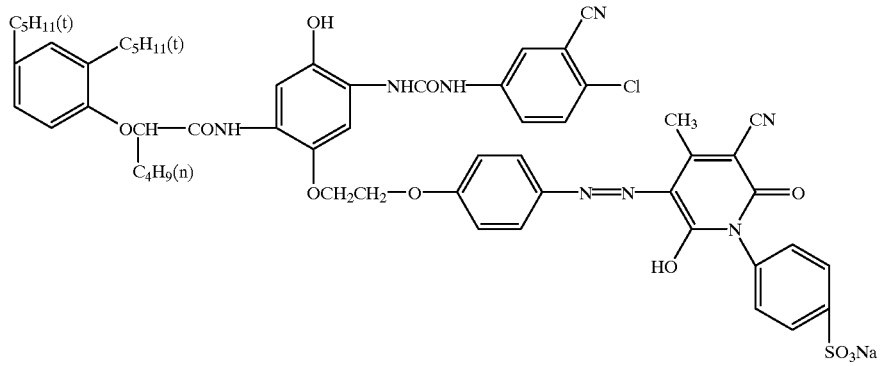
YCC-9
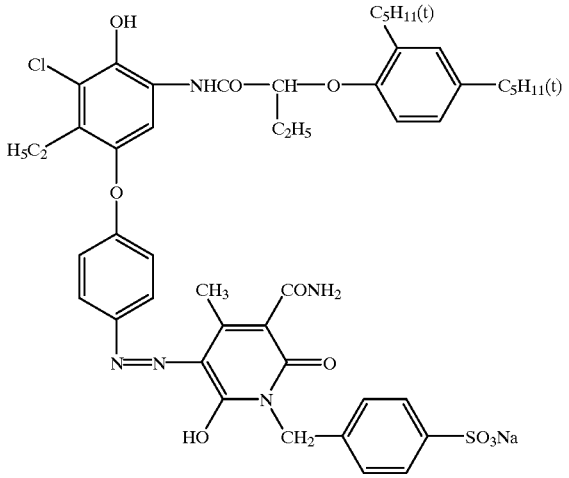

-continued
YCC-10
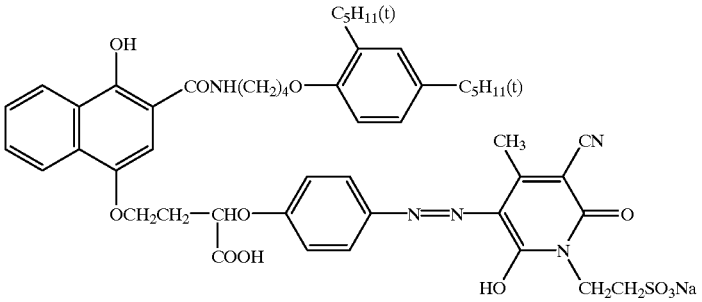
YCC-11
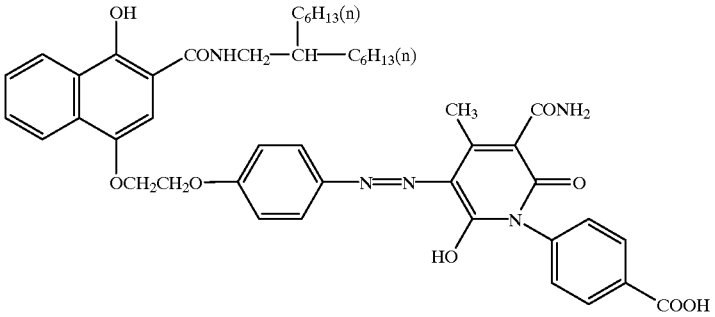
YCC-12
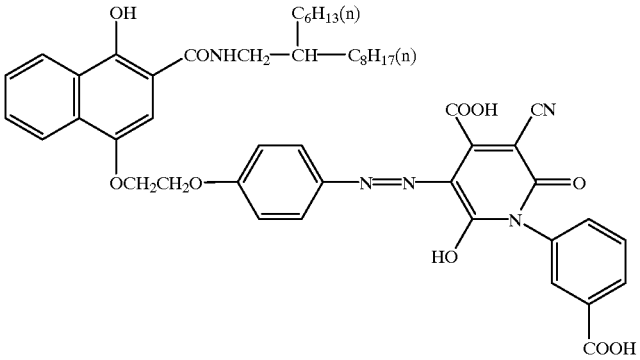
YCC-13
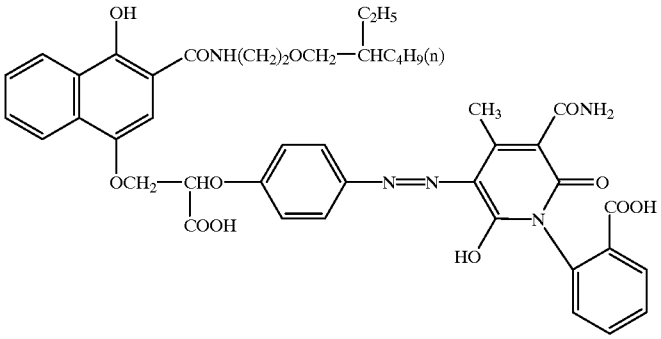

-continued
YCC-14
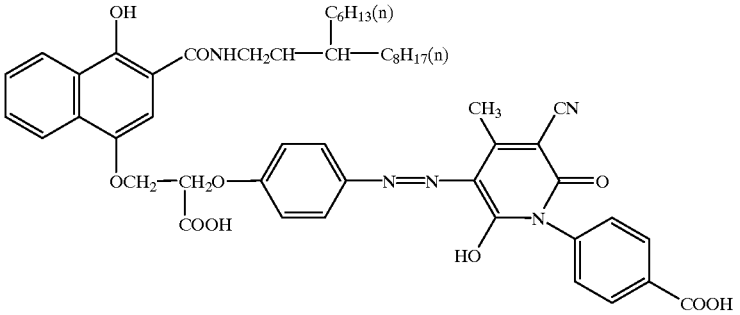
YCC-15
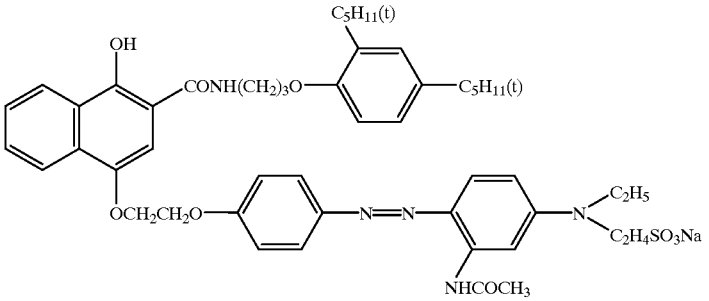
YCC-16
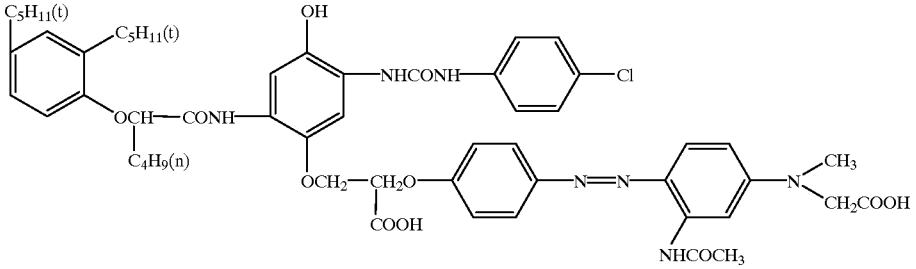
YCC-17
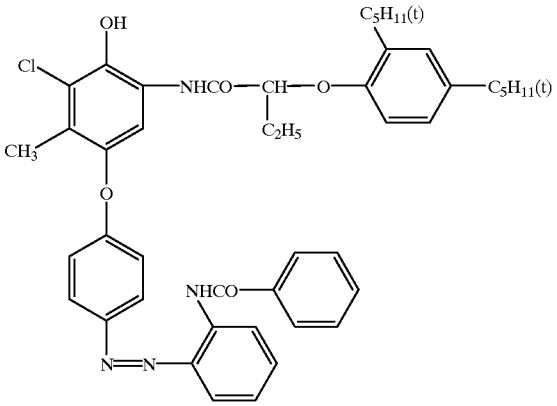

-continued
YCC-18
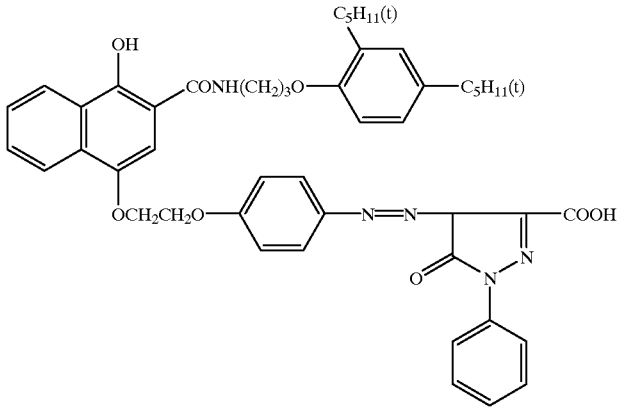
YCC-19
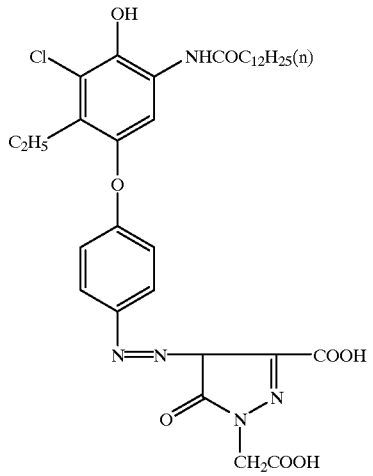
YCC-20
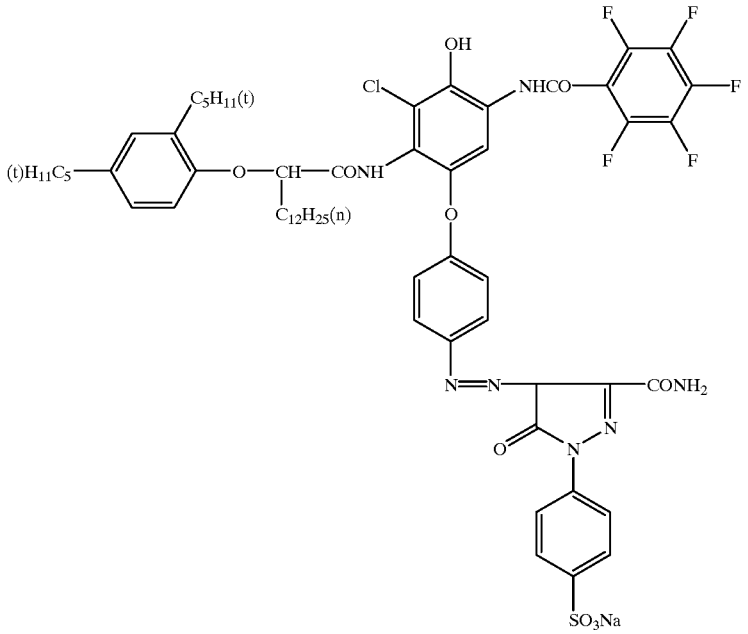
The above-mentioned yellow colored cyan couplers can be synthesized in reference to methods described in Japanese Patent Publication No. 52827/1986, U.S. Pat. Nos. 3,763,170 and 4,004,929 and Japanese Patent O.P.I. Publication Nos. 72244/1986, 273543/1986, 444/1992 and 151655/1992.

A yellow colored cyan coupler of the present invention can be added to an arbitrary layer. It is preferable to be added to at least one of the light-sensitive silver halide emulsion layers. The added amount thereof is ordinarily 0.001 to 0.1 mol, preferably 0.002 to 0.05 and specifically preferably 0.005 to 0.03 per mol of silver halide in the added layer.

The transmitting density of the orange coloration of the present invention after photographic processing on an unexposed portion under the status M condition is 0.37 or more and 0.75 or less for the blue light measurement density, 0.32 or more and 0.55 or less for the green light measurement density and 0.05 or more and 0.30 or less for the red light measurement density. If the density range is smaller than the aforesaid range, it becomes difficult to obtain the effects of the present invention. If the density range is larger than aforesaid density range, it requires too much time for printing time so as to be insufficient, and it becomes difficult to be suitable for printing conditions of a color photographic system.

In the present invention, there are two types in a monochrome image forming silver halide light-sensitive material for photography containing a colored coupler.

One of the methods is to contain a colored coupler, and to form a silver image by means of a black and white development. With this method, it is not necessary to incorporate a colorless coupler which forms a dye image by means of color developing, in which at least a colored coupler is added to a conventional black-and-white silver halide light-sensitive material. With this type, an image can be printed on color photographic paper by means of an automatic color printer while mixing with a black-and-white color negative film after black-and-white photographic processing (a black-and-white developing→stop→fixing→washing) from which an acceptable print can easily be obtained after exposure.

Another method is to contain a colored coupler, and to form a black-and-white dye image by means of color developing. In order to form a black-and-white dye image, a black-and-white dye image is formed by means of a coupler having a spectral absorption region visible to the human eye. A so-called black coupler which forms a black dye by means of a coupling reaction with an oxidized product of a color developing agent is used. In a silver halide multilayered color light-sensitive material having ordinary yellow, magenta and cyan couplers, it can be so arranged that the spectral sensitivity distribution of silver halide in the identical layer can cover all of the visible regions for couplers in all layers. In addition, yellow, magenta and cyan couplers are mixed so that a spectral sensitivity distribution of silver halide can cover all the visible region. As a result, a black-and-white dye image can be formed with a simple layer structure.

In the present invention, a colorless coupler is defined to be in contradiction to the above-mentioned colored coupler. Those which do not react have substantially no color hue. By means of color developing, a yellow coupler, a magenta coupler, a cyan coupler and a black coupler which respectively form a dye image such as yellow, magenta, cyan and black are contained. The following couplers described in Research Disclosures (RD) are cited.

| | RD308119 | RD17643 & RD18716 |
|---|---|---|
| Yellow coupler | 1001 VII-D | VIIC-G |
| Magenta coupler | - ditto - | - ditto - |

-continued

| | RD308119 | RD17643 & RD18716 |
|---|---|---|
| Cyan coupler | - ditto - | - ditto - |
| DIR coupler | 1001 VII-F | VII F |
| BAR coupler | 1002 VII-F | |

In the present invention, a hexa-equivalent coupler comprises three kinds of two-equivalent couplers having different coloring tones from each other. Simultaneously, it is preferable that the three kinds of aforesaid couplers exist in identical oil particles.

"The coloring tone difference" is defined to be that the spectral maximum absorption wavelength (λmax) of coloring dyes formed due to a coupling reaction with the oxidized product of a color developing dye being different from each other by 50 nm or more and preferably 70 nm or more. Specifically preferably is the hexa-equivalent coupler, in the same manner as in an ordinary color photography, which comprises three kinds of, i.e., a yellow color tone, a magenta color tone and a cyan color tone, and contains each of aforesaid two-equivalent couplers in identical oil particles.

The above-mentioned two-equivalent couplers preferably used in the present invention are represented by the following Formula I.

Formula I:

Formula I

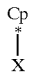

wherein $C_p$ represents a coupler residual group; * represents the coupling position of the coupler; X represents an atom or a group being split off when the oxidized product of an aromatic primary amine color developing agent is coupled to form a dye.

In a coupler residual group represented by $C_p$, typical yellow coupler residual groups are described in U.S. Pat. Nos. 2,298,443, 2,407,210, 2,875,057, 3,048,194, 3,265,506 and 3,447,928 and Farbkupplereine Literaturubersiecht Agfa Mitteilung (B and II), pp. 112 through 126 (1961). Of these, acylacetanilides, for example, benzoylacetanilides and pyvaloylacetanilides are preferable.

Typical magenta couplers are described in U.S. Pat. Nos. 2,369,489, 2,343,703, 2,311,082, 2,600,788, 2,908,573, 3,062,653, 3,152,896,3,519,429, 3,725,067 and 4,540,654, Japanese Patent O.P.I. Publication Nos. 162548/1984 and the above-mentioned Agfa Mitteilung (B and II), pp. 126 through 156 (1961). Of these, pyrazolones or pyrazoloazoles (for example, pyrazoloimidazole and pyrazolotriazole) are preferable.

Typical cyan coupler residual groups are described in U.S. Pat. Nos. 2,367,531, 2,423,730, 2,474,293, 2,772,162, 2,895,826, 3,002,836, 3,034,892 and 3,041,236 and the above-mentioned Agfa Mitteilung (B and II), pp. 156 through 175. Of these, the preferable ones are phenols or naphthols.

As a split-off atom or group represented by X, are for example, a halogen atom, an alkoxy group, an aryloxy group, a heterocyclic oxy group, an acyloxy group, an alkylthio group, an arylthio group, a heterocyclic thio group,

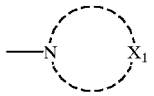

wherein $X_1$ represents atoms necessary to form a 5-membered or 6-membered ring together with at least one atom selected from a nitrogen atom, a carbon atom, an oxygen atom, a nitrogen atom and a sulfur atom in the Formula, a monovalent group such as an acylamino group and a sulfonamide group and a divalent group such as an alkylene group. In the case of a divalent group, X forms a dimmer with an X.

Hereinafter, practical examples will be cited.

A halogen atom: a chlorine atom, a bromine atom and a fluorine atom.

Alkoxy group:

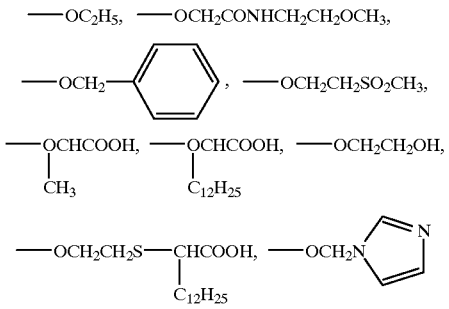

Aryloxy group:

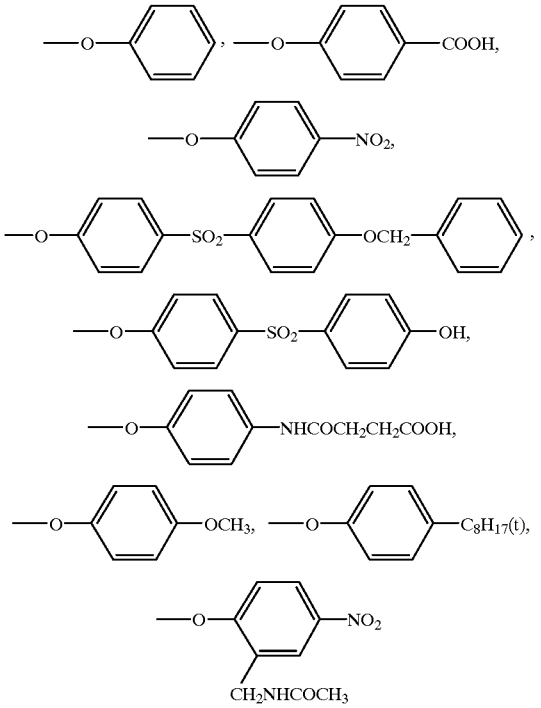

Heterocyclic oxy group:

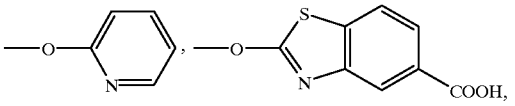

-continued

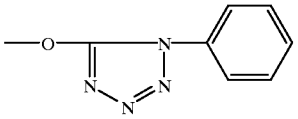

Acyloxy group

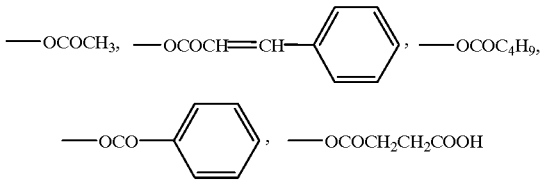

Alkythio group

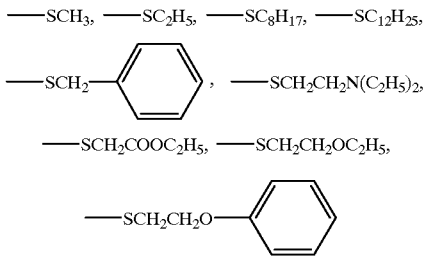

Arylthio group:

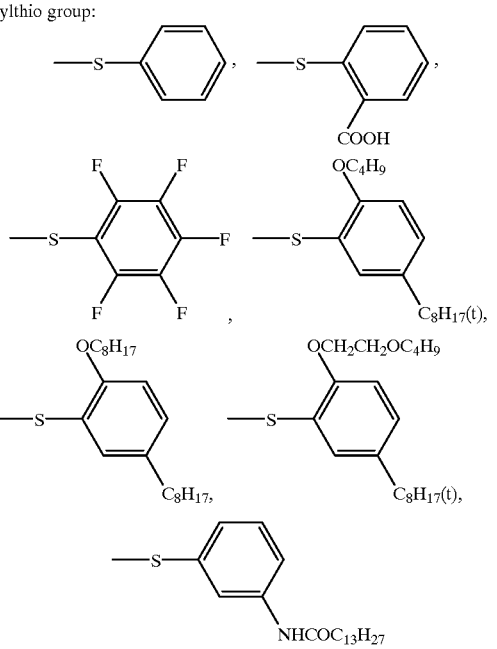

Heterocyclic thio group

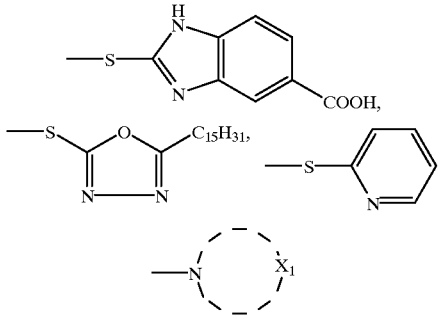

a pyrazolyl group, an imidazolyl group, a triazolyl group and a tetrazolyl group,

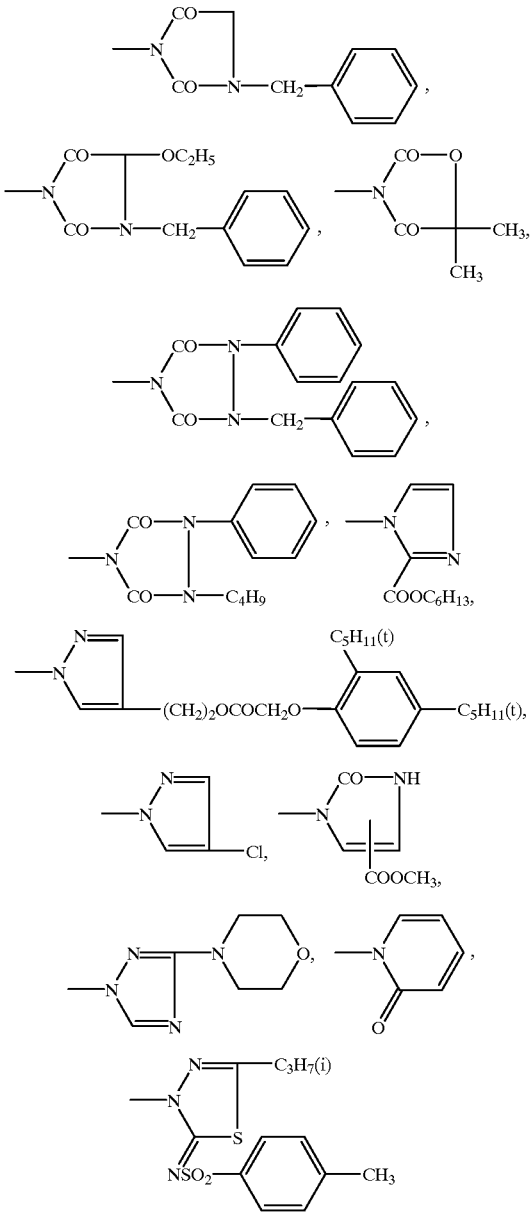

Acylamino group:

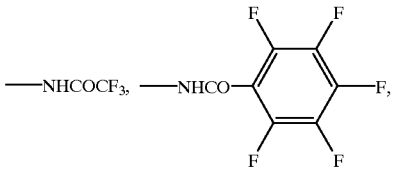

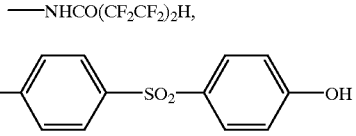

Sulfonamide group:

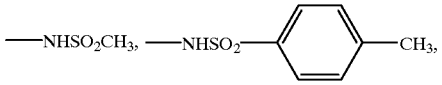

-continued

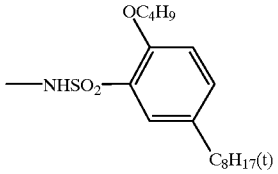

Alkylene group:

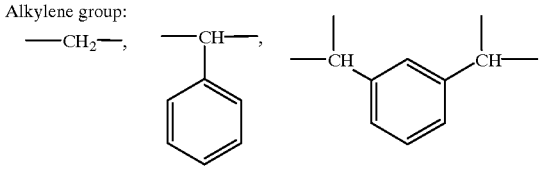

As a two-equivalent yellow coupler, those represented by the following Formulas II and III are preferable.

Formula II

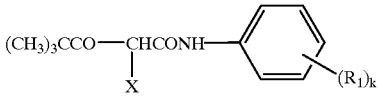

Formula III

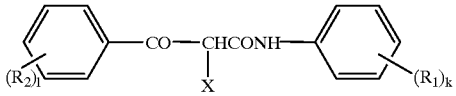

In Formulas II and III, $R_1$ and $R_3$ independently represent a hydrogen atom or a substituent. k and 1 independently represent an integer of 1 to 5. When both of k and 1 are 2 or more, $R_1$ and $R_2$ may be the same or different. X represents the same as that of Formula I.

As a substituting atom and a substituent represented by $R_1$ and $R_2$ for example, a halogen atom and an alkyl group, a cycloalkyl group, an aryl group and a heterocycle which directly combine or which combine through a divalent atom or a group are cited.

As the above-mentioned divalent atom or a group, for example, a halogen atom, a nitrogen atom, a sulfur atom, a carbonylamino group, an aminocarbonyl group, a sulfonylamino group, an aminosulfonyl group, an amino group, a carbonyl group, a carbonyloxy group, an oxycarbonyl group, a ureilene group, a thioureilene group, a thiocarbonylamino group, a sulfonyl group and a sulfonyloxy group are cited.

The above-mentioned alkyl group, cycloalkyl group, aryl group and heterocycle which are examples of a substituent represented by $R_1$ and $R_2$. Aforesaid substituents include a halogen atom, a nitro group, a cyano group, an alkyl group, an alkenyl group, a cycloalkyl group, an aryl group, an alkoxy group, an aryloxy group, an alkoxycarbonyl group, an aryloxycarbonyl group, a carboxy group, a sulfo group, a sulfamoyl group, a carbamoyl group, an acylamino group, an ureido group, an urethane group, a sulfonamide group, a heterocycle, an arylsulfonyl group, an alkylsulfonyl group, an arylthio group, an alkylthio group, an alkylamino group, an anilino group, a hydroxy group, an imide group and an acyl group.

In a two-equivalent yellow coupler, as an X, those illustrated in Formula I are cited. Specifically, an aryloxy group and

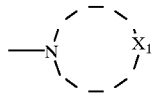

wherein $X_1$ represents the same as the above-mentioned $X_1$, are preferable.

In addition, Formula II includes a case when $R_1$ or X forms a dimmer or a higher polymer.

In addition, Formula III includes a case when $R_1$, $R_2$ or X forms a dimmer or a higher polymer.

As a two-equivalent magenta coupler, those represented by the following Formulas IV, V, VI and VII are cited.

Formula IV

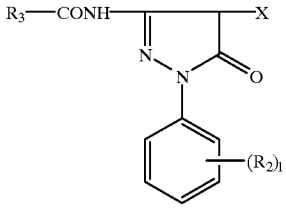

Formula V

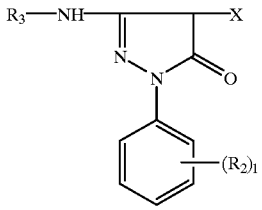

Formula VI

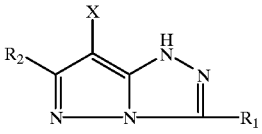

Formula VII

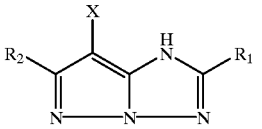

In the above-mentioned Formulas IV through VII, $R_3$ represents a substituent. $R_1$, $R_2$, X and 1 respectively represent the same as those in Formulas II and III. When 1 is 2 or more, each $R_2$ may be the same or different.

As examples of $R_1$ and $R_2$, those illustrated as $R_1$ and $R_2$ in Formula III are cited. As $R_3$, each of an alkyl group, a cycloalkyl group, an aryl group and a heterocycle are cited. These include those having a substituent. As examples of aforesaid substituents, those illustrated as substituents which each group cited as examples of $R_1$ and $R_2$ in Formula II are cited.

In a two-equivalent magenta coupler, as examples of an X, those illustrated in Formula I are cited, in which an alkylthio group, an arylthio group, an aryloxy group, an acyloxy group,

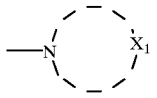

wherein $X_1$ represents the same as the above-mentioned $X_1$ and an alkylene group are specifically preferable.

In addition, Formulas IV and V include cases when a polymer including a dimmer or a higher polymer is included by means of $R_2$, $R_3$ and X. Formulas VI and VII include cases when a polymer including a dimmer or a higher polymer is included by means of $R_1$, $R_2$ and X.

As a two-equivalent cyan coupler, those represented by the following Formulas VIII, IX and X are preferable.

Formula VIII

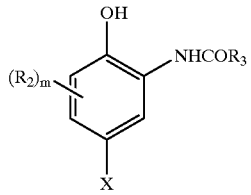

Formula IX

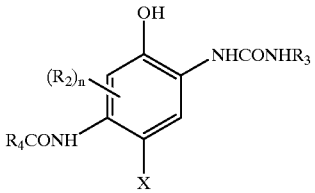

Formula X

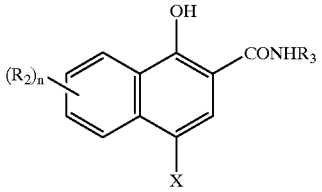

In Formulas VIII, IX and X, $R_2$ and $R_3$ represent the same as $R_2$ and $R_3$ in Formula IV. $R_4$ represents a substituent. m represents 1 through 3. n represents 1 or 2. p represents 1 through 5. When all of m, n and p are 2 or more, each of $R_2$ may be the same or different.

As $R_2$ and $R_3$, those illustrated in Formula IV are cited. As $R_4$, those illustrated as $R_3$ in Formula IV are cited. In a two-equivalent cyan coupler, as an example of X, those illustrated by Formula I are cited. A halogen atom, an alkoxy group, an aryloxy group and a sulfonamide group are specifically preferable.

In addition, Formulas VIII and X include cases when a dimmer or a higher polymer is formed with $R_2$, $R_3$ or X. Formula IX include cases when a dimmer or a higher polymer is formed with $R_2$, $R_3$, $R_4$ or X.

Practical examples of a two-equivalent coupler preferably used in the present invention will be cited as below.

Y-1
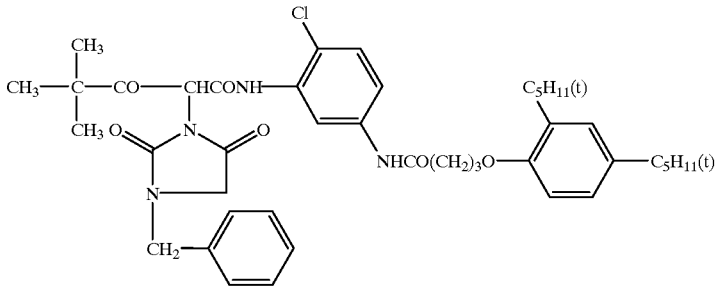
Y-2
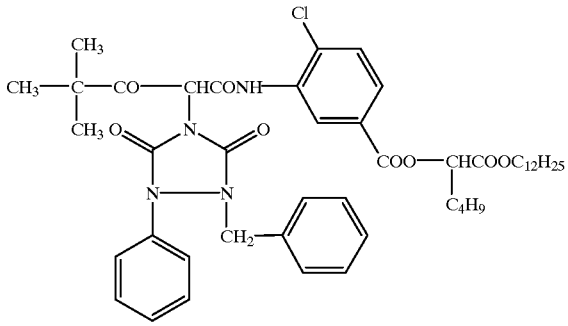
Y-3
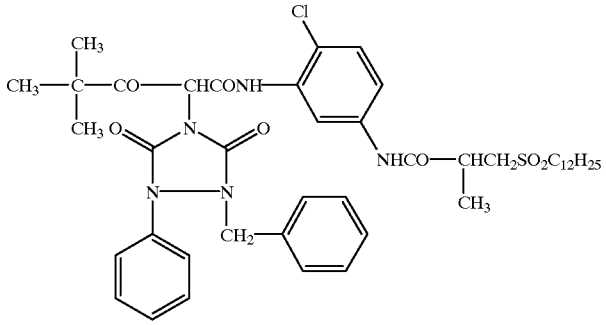
Y-4
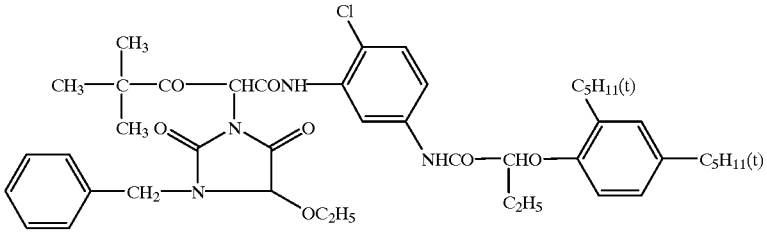
Y-5
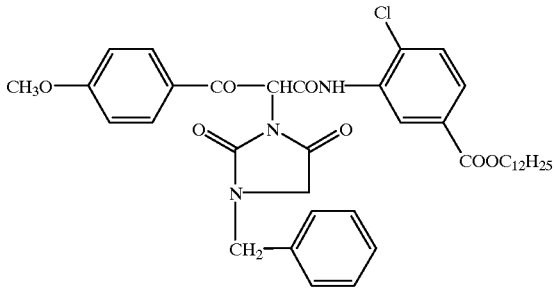

-continued
Y-6
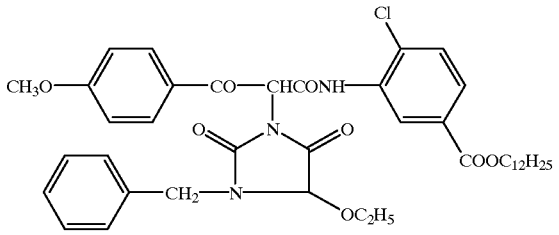
Y-7
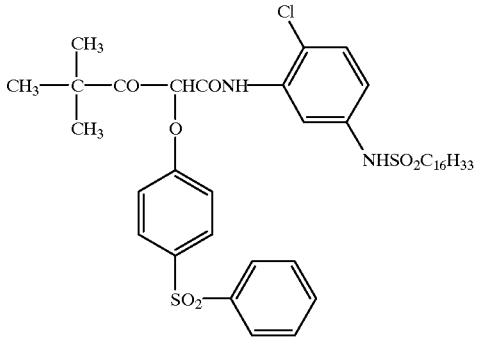
Y-8
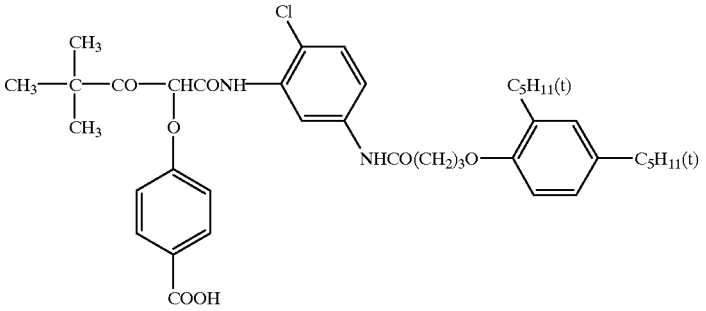
Y-9
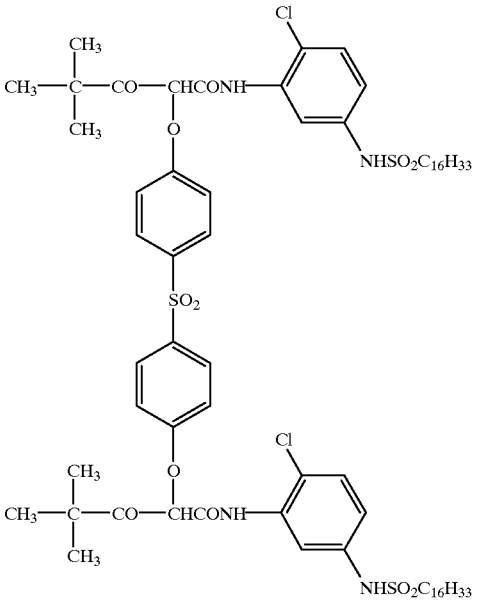

-continued
Y-10
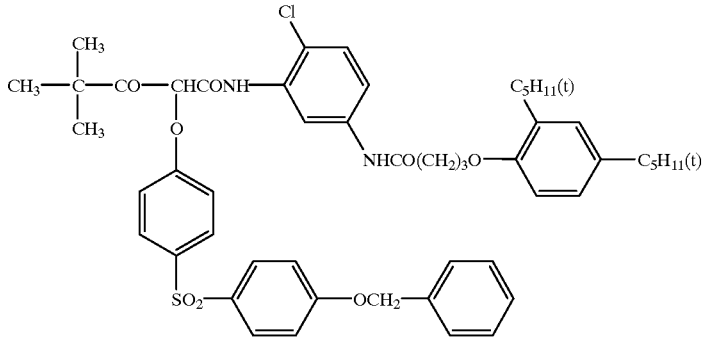
Y-11
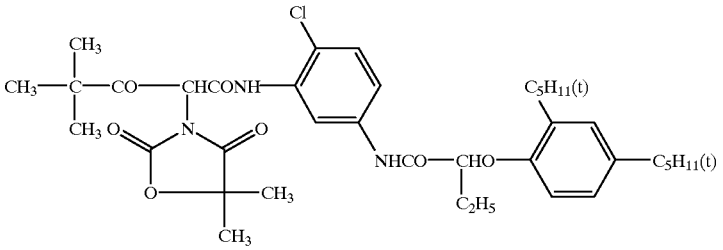
Y-12
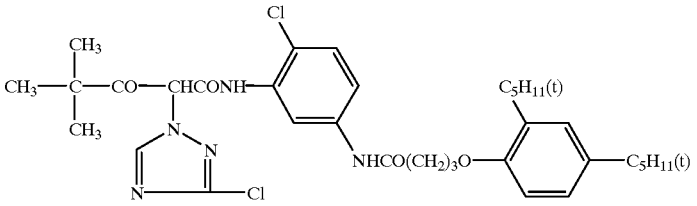
Y-13
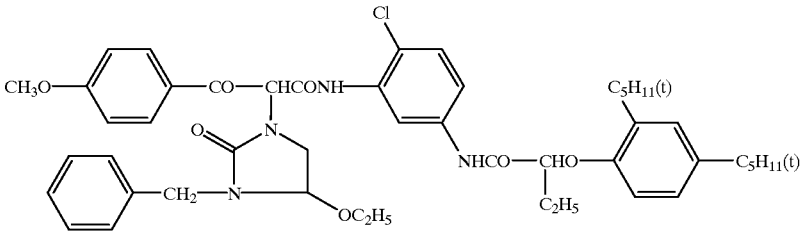
Y-14
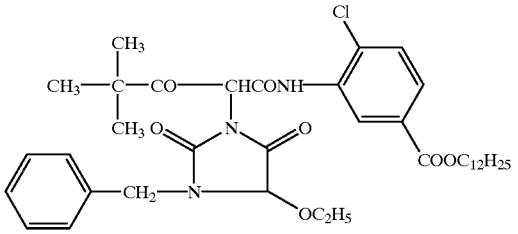

-continued
Y-15
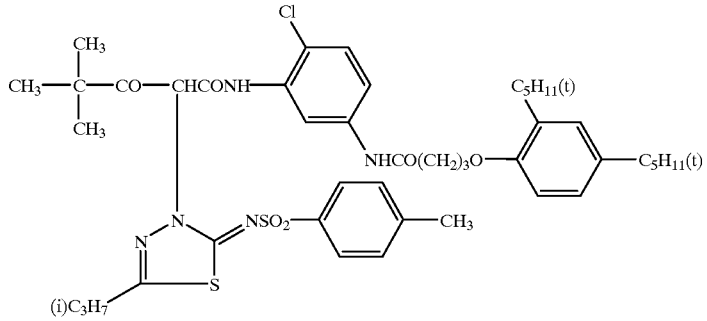
Y-16
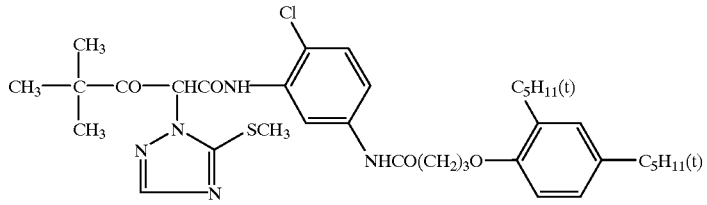
Y-17
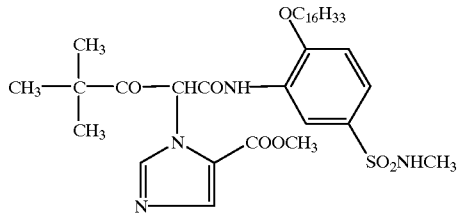
Y-18
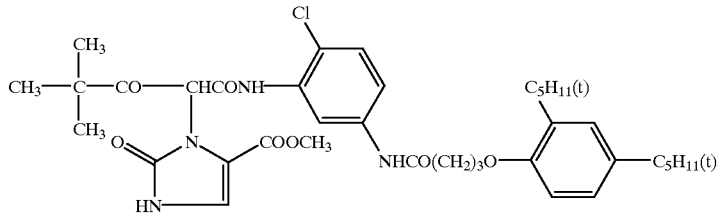
Y-19
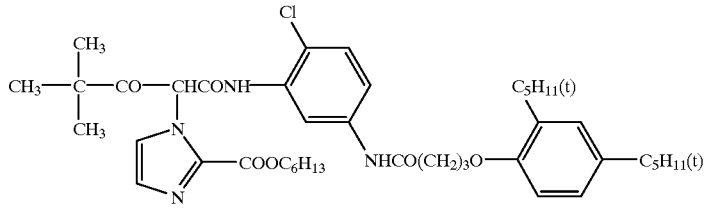
Y-20
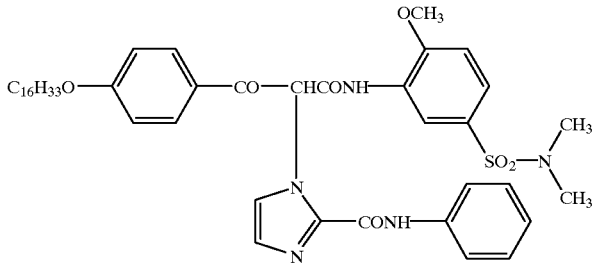

-continued
Y-21
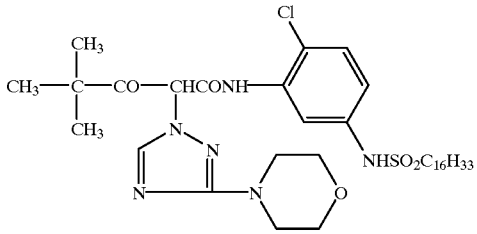
Y-22
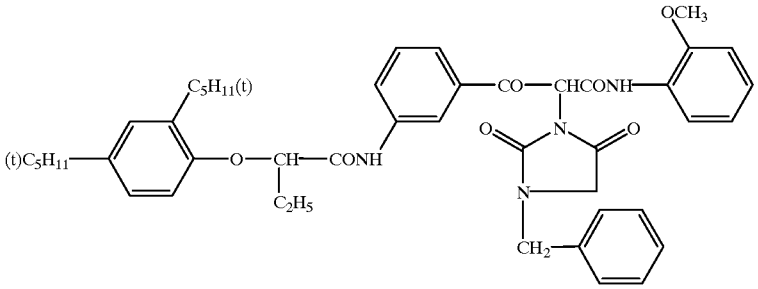
Y-23
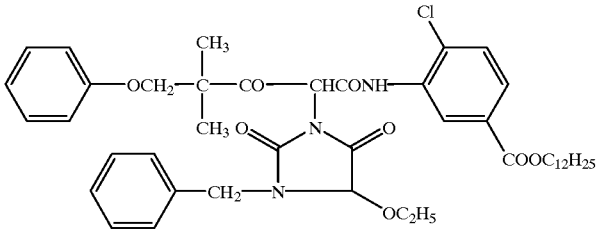
Y-24
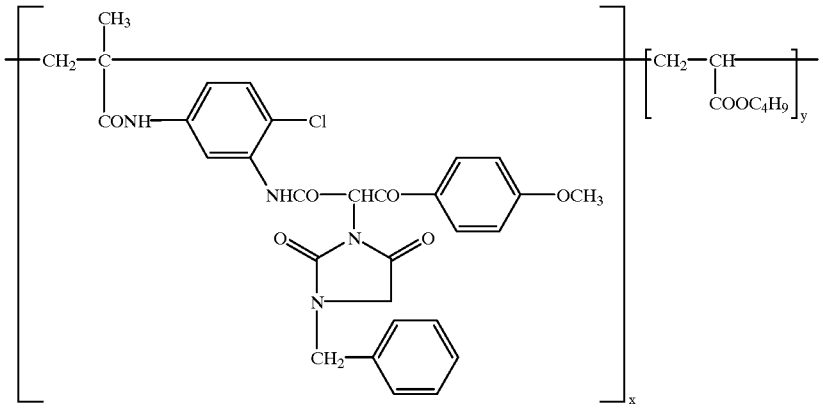
x : y = 50 : 50
(weight ratio)
Y-25
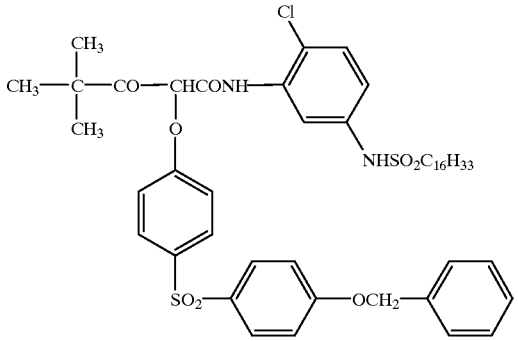

-continued
Y-26
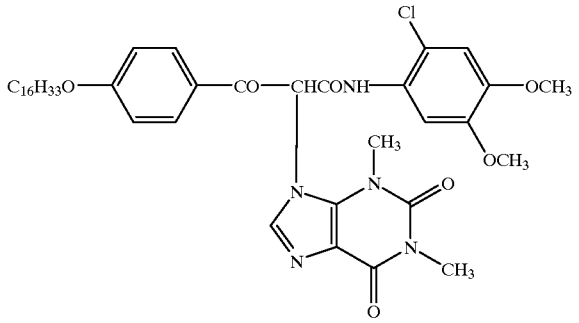
Y-27
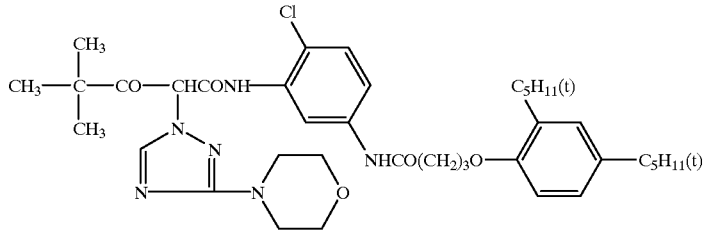
Y-28
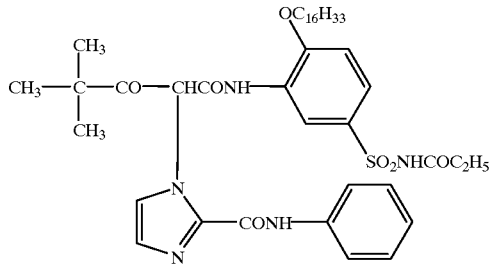
Y-29
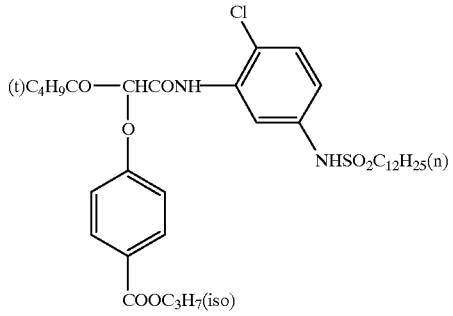
Y-30
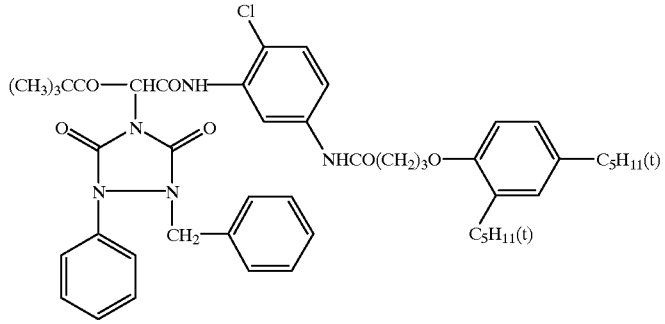

-continued
Y-31
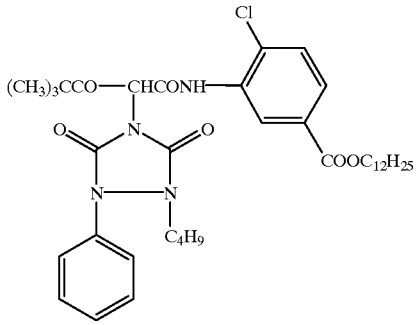
Y-32
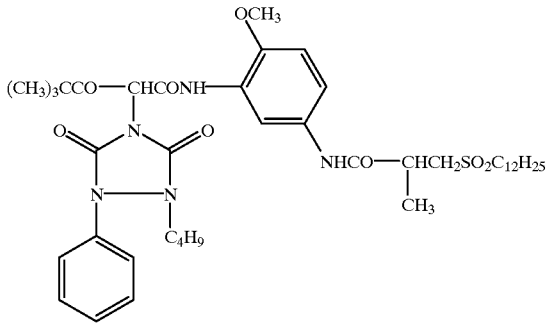
Y-33
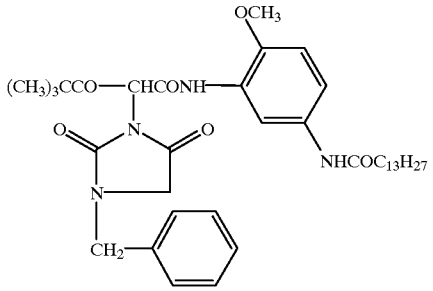
Y-34
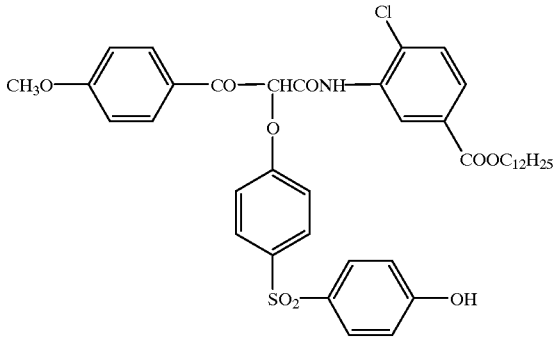

-continued
Y-35
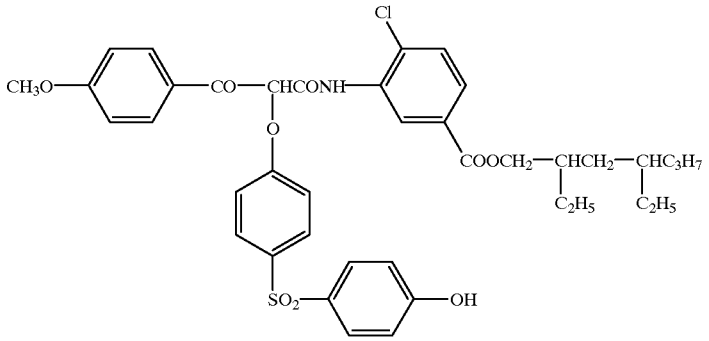
Y-36
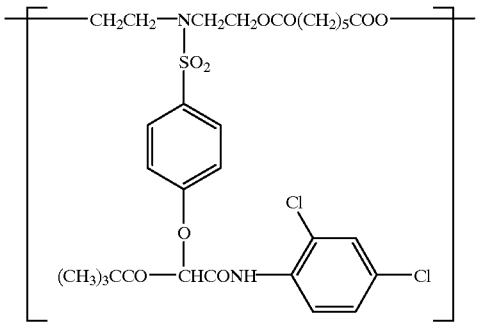
Y-37
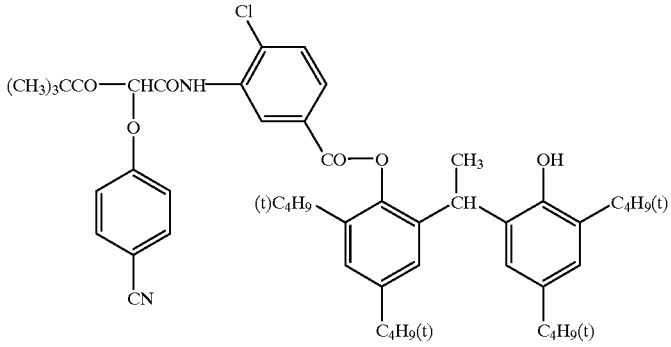
Y-38
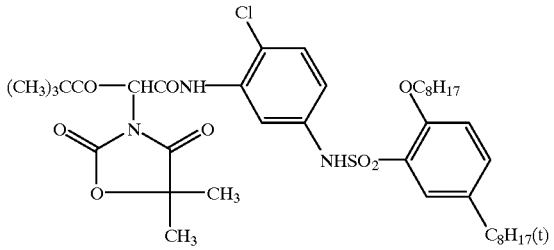
Y-39
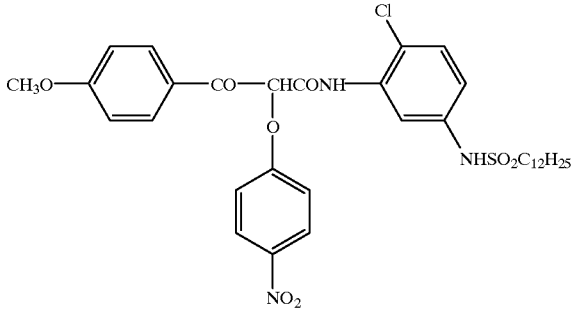

-continued
M-1
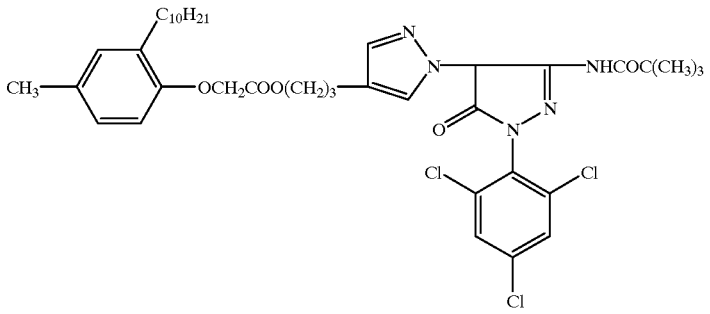
M-2
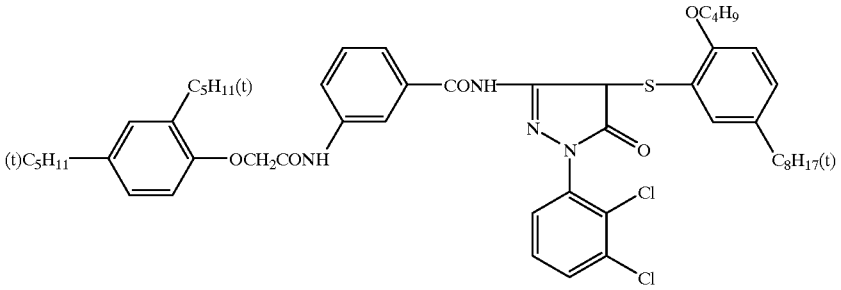
M-3
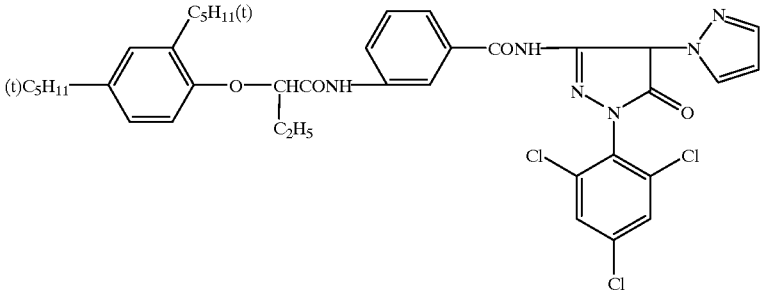
M-4
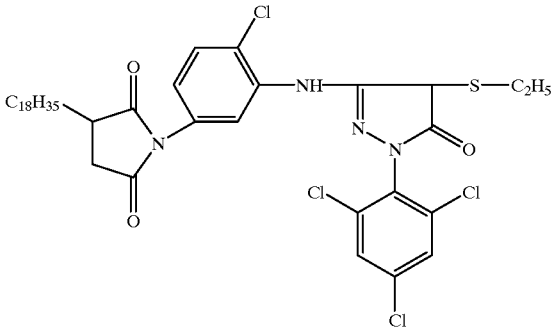
M-5
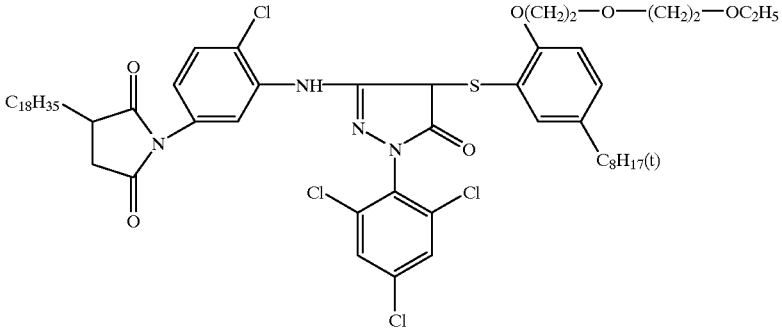

-continued
M-6
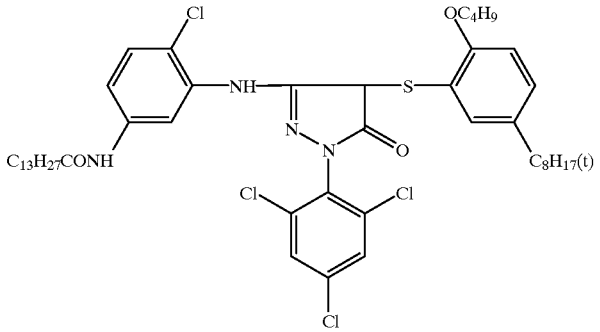
M-7
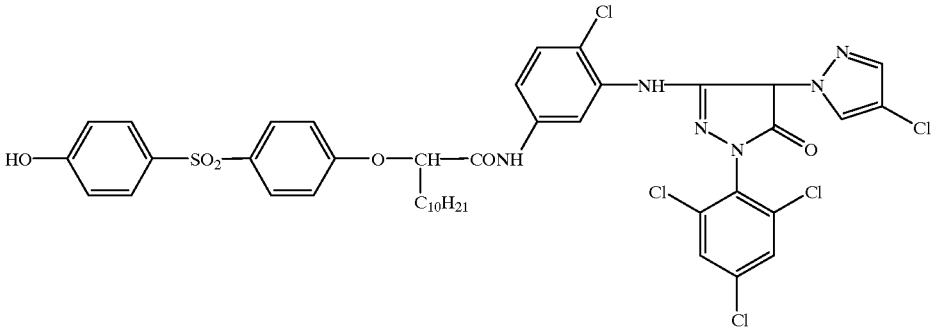
M-8
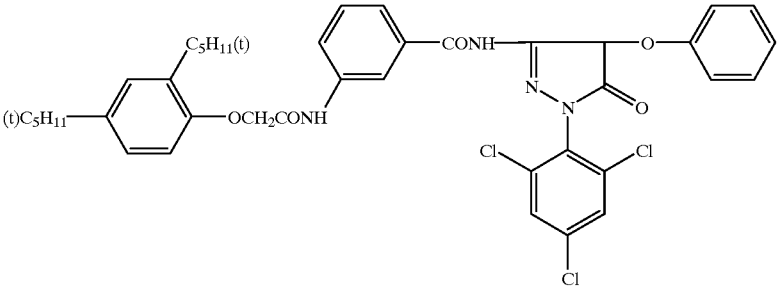
M-9
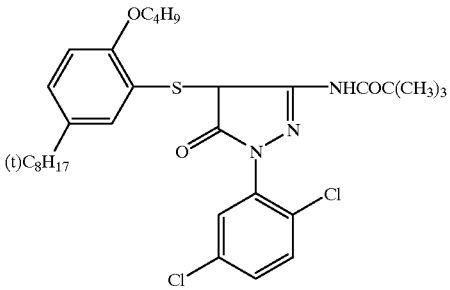
M-10
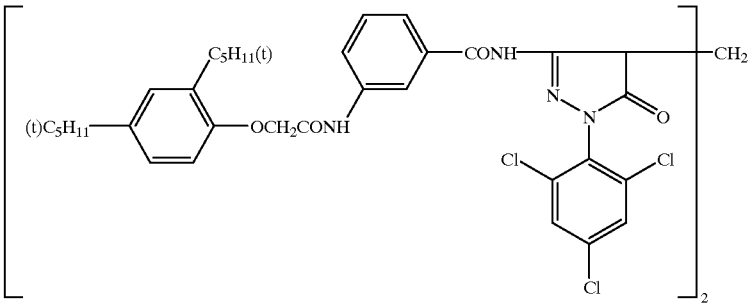

-continued
M-11
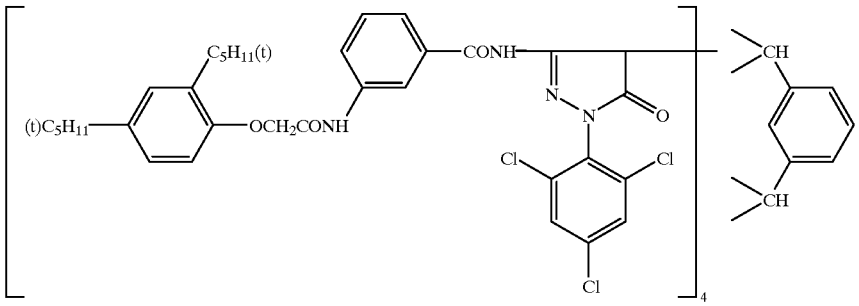
M-12
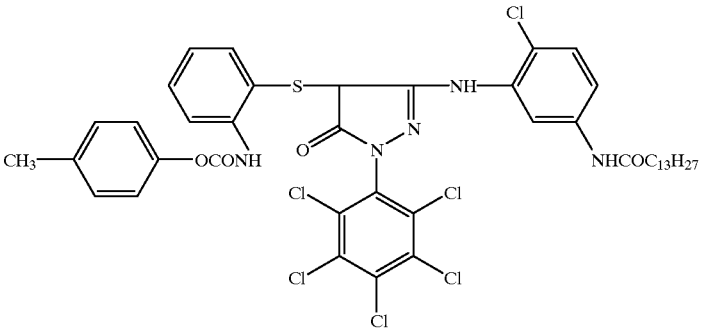
M-13
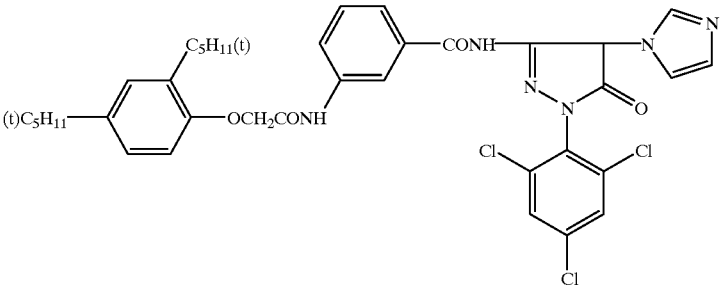
M-14
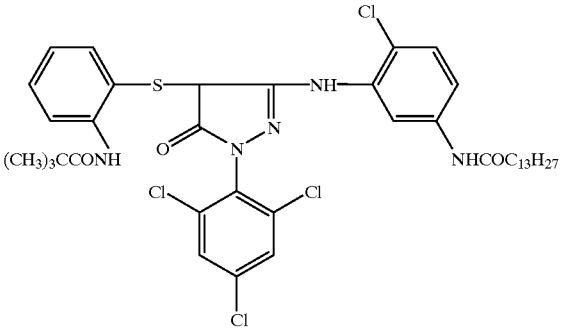
M-15
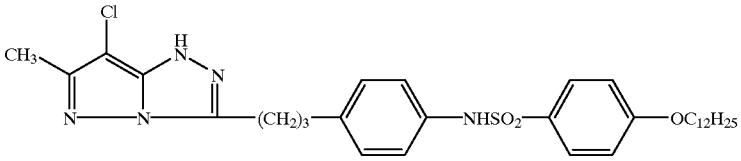

-continued
M-16
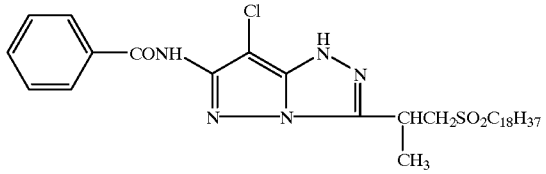
M-17
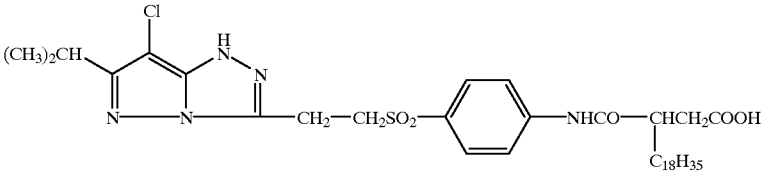
M-18
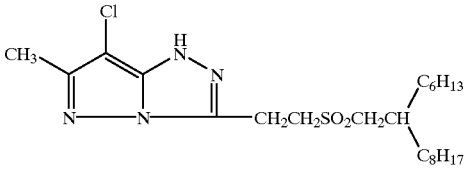
M-19
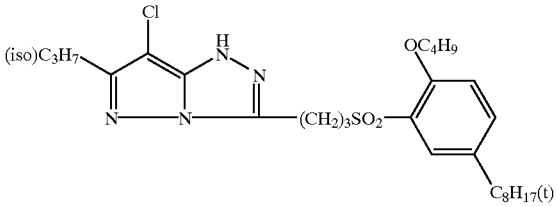
M-20
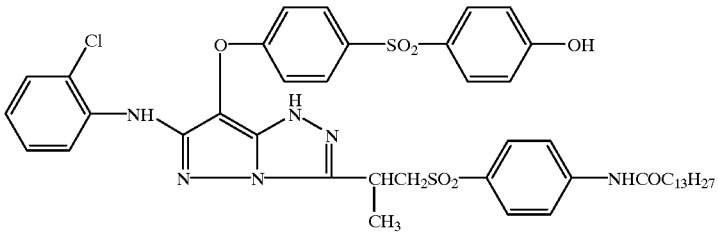
M-21
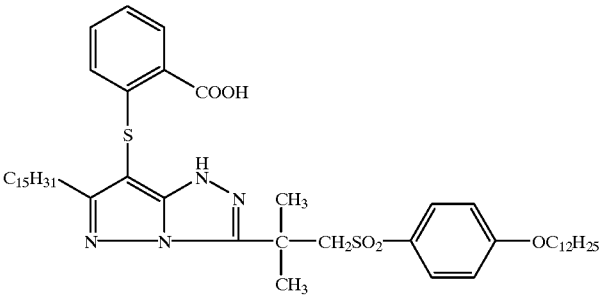
M-22
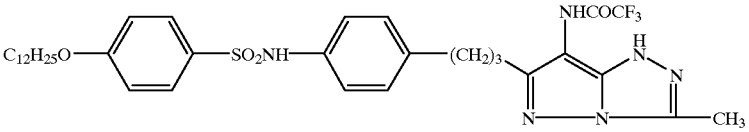

-continued
M-23
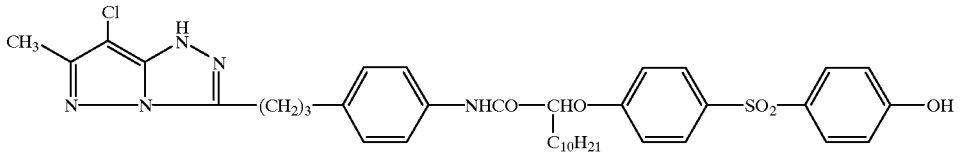
M-24
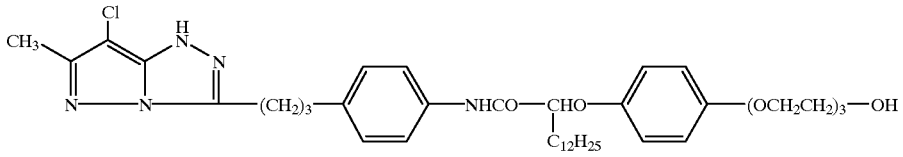
M-25
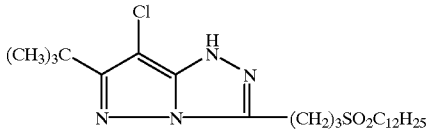
M-26
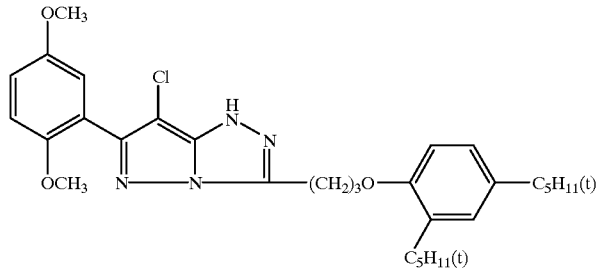
M-27
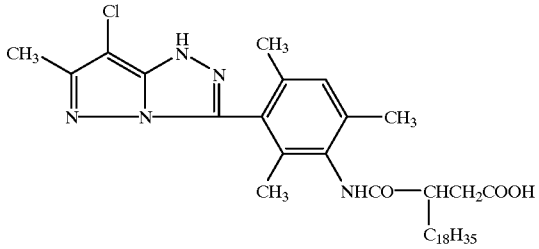
M-28
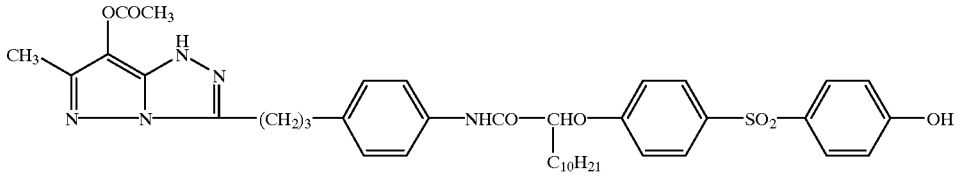
M-29
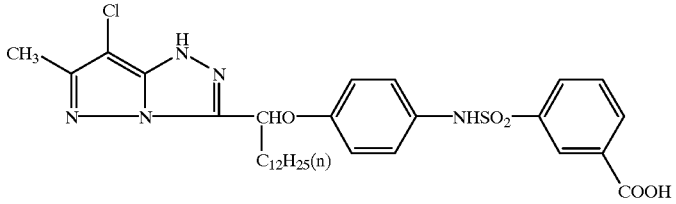

-continued
M-30
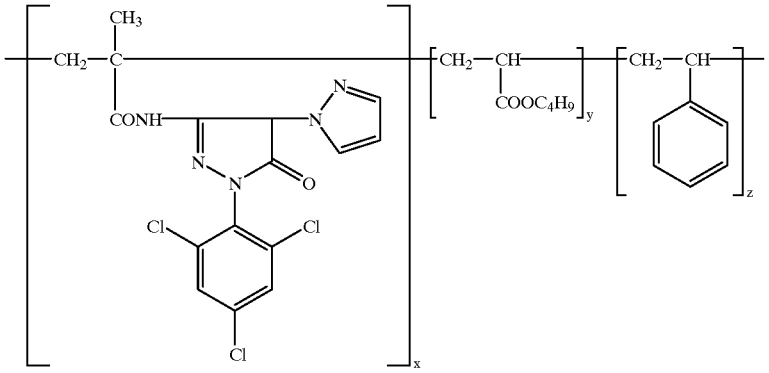
x : y : z = 50 : 25 : 25
(by weight ratio)
M-31
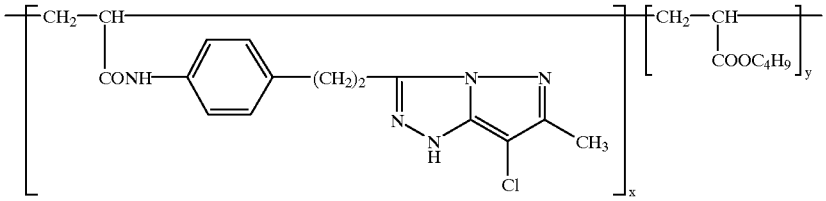
x : y = 50 : 50
(by weight ratio)
M-32
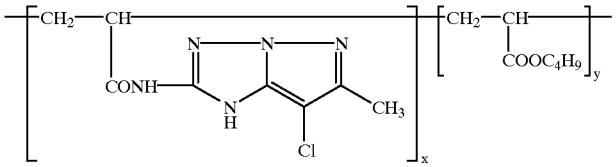
x : y = 50 : 50
(by weight ratio)
M-33
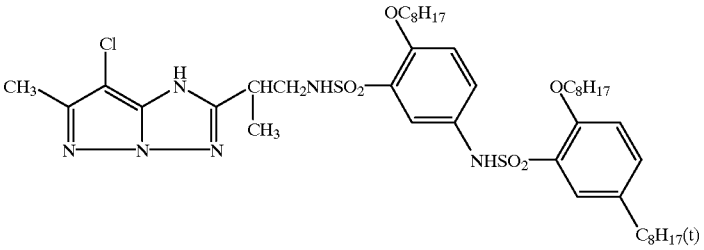
M-34
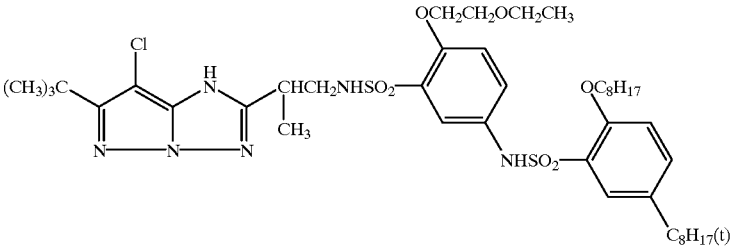
M-35
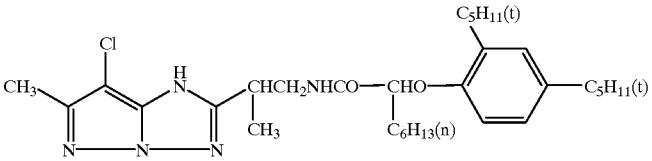

-continued
M-36
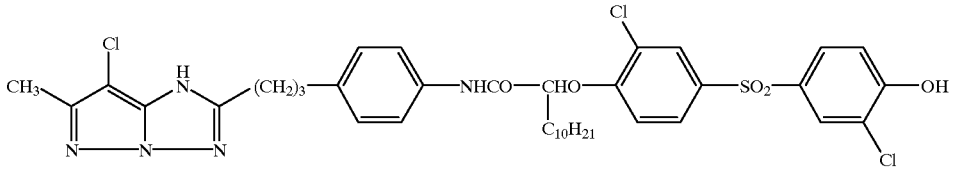
M-37
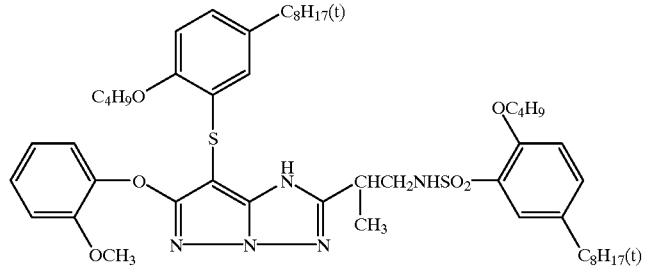
M-38
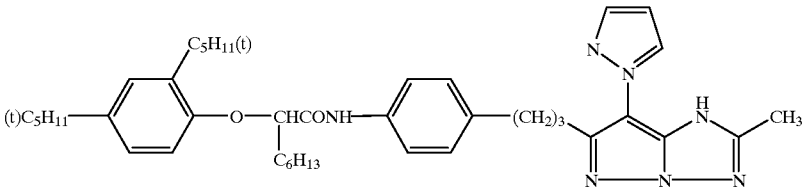
M-39
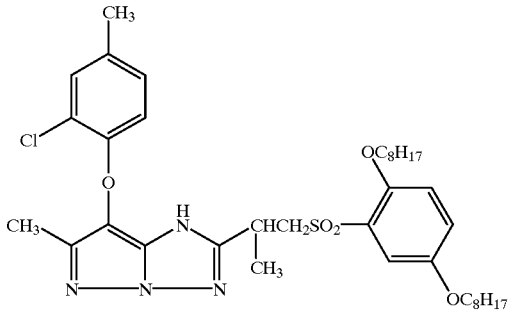
C-1
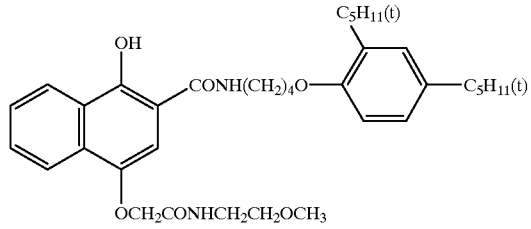
C-2
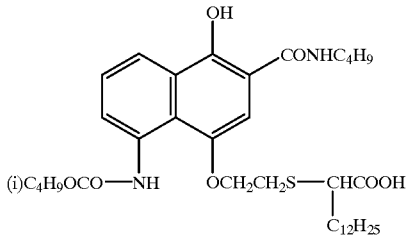

-continued
C-3
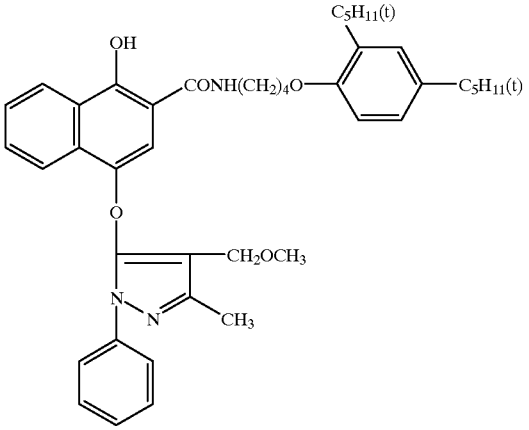
C-4
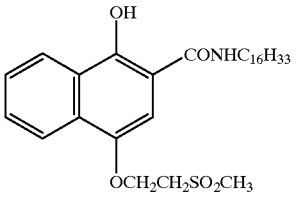
C-5
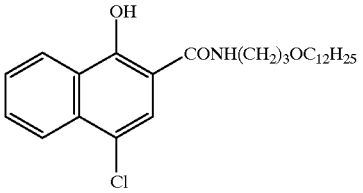
C-6
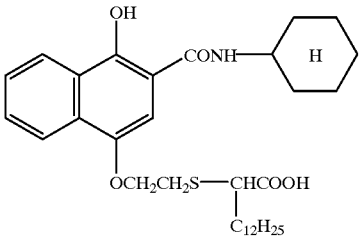
C-7
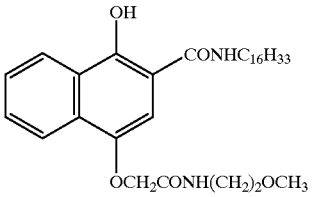

-continued
C-8
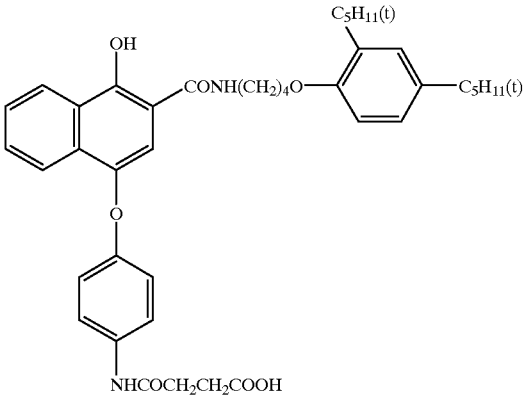
C-9
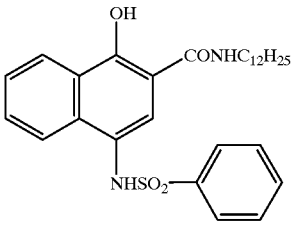
C-10
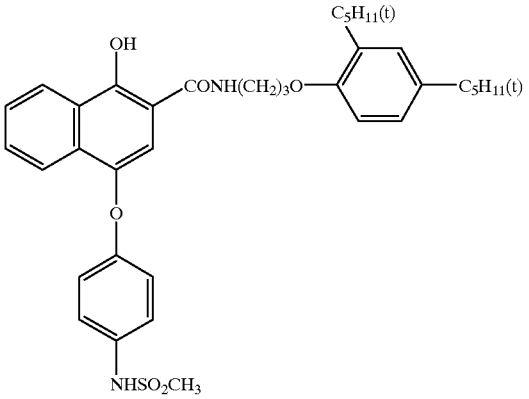
C-11
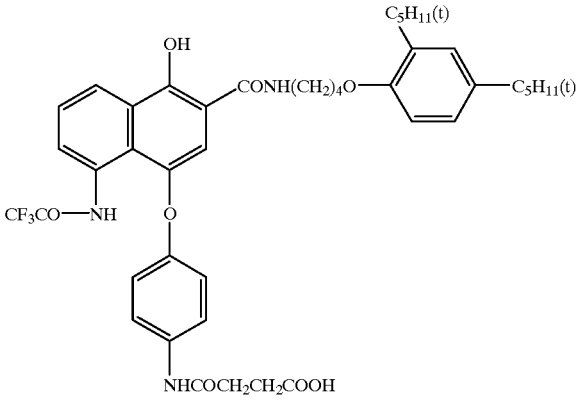

-continued
C-12
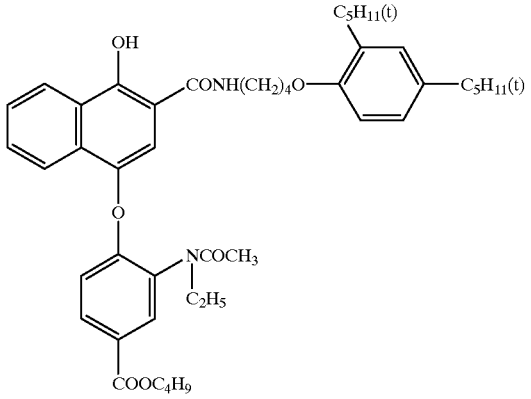
C-13
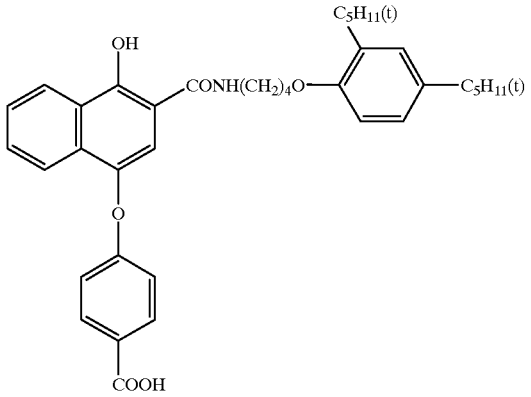
C-14
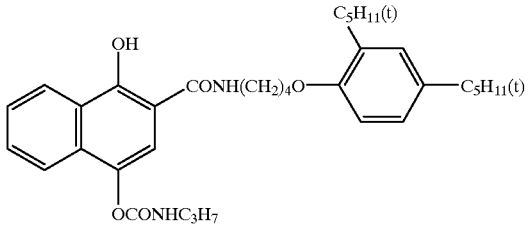
C-15
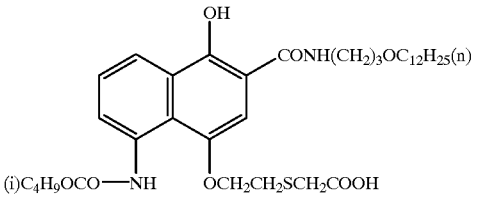
C-16
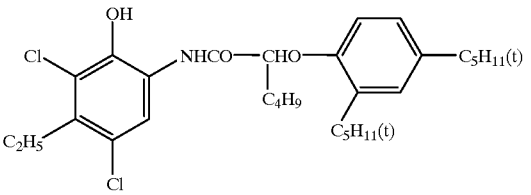

-continued
C-17
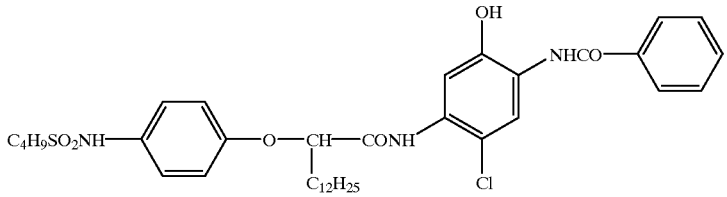
C-18
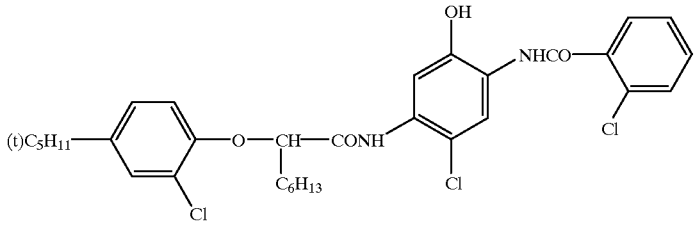
C-19
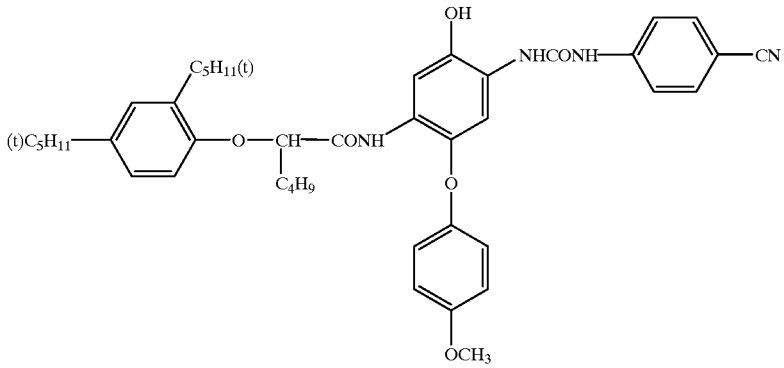
C-20
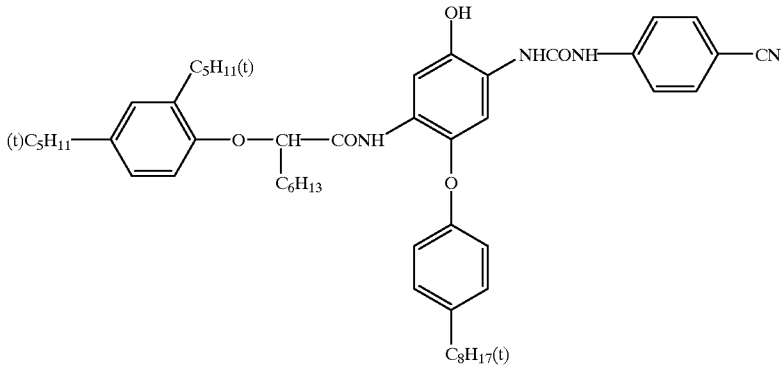
C-21
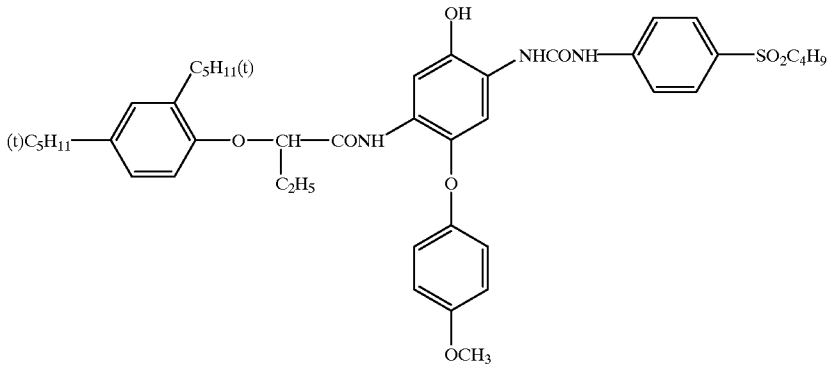

-continued
C-22
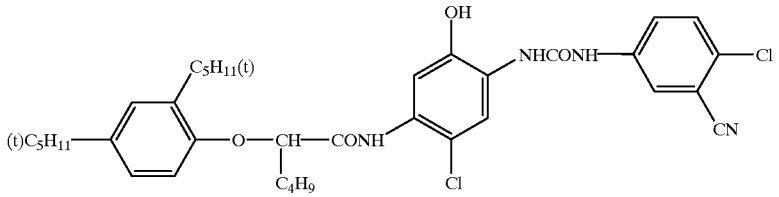
C-23
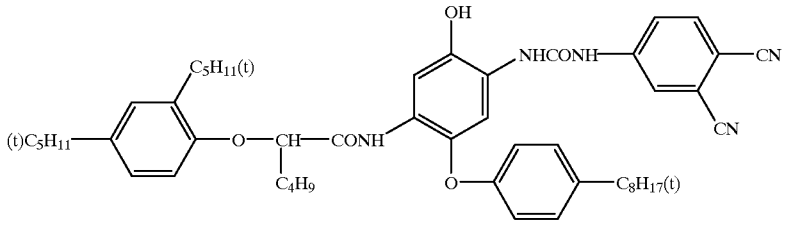
C-24
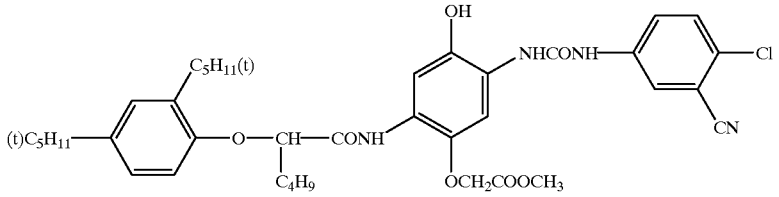
C-25
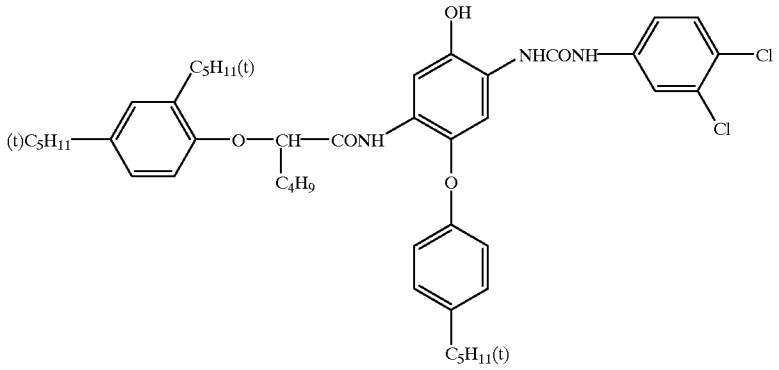
C-26
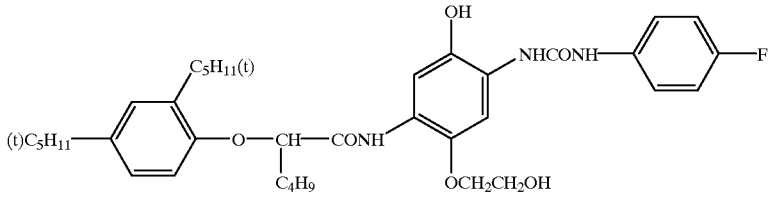
C-27
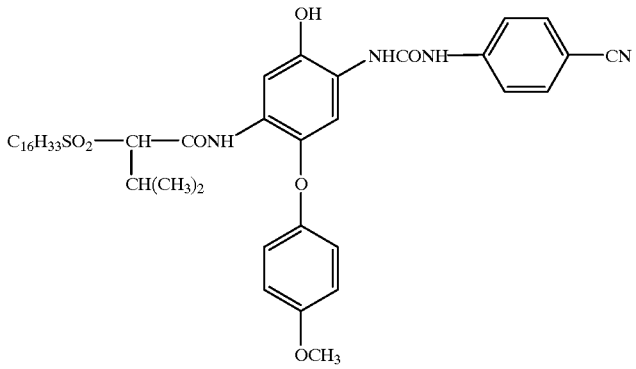

-continued
C-28
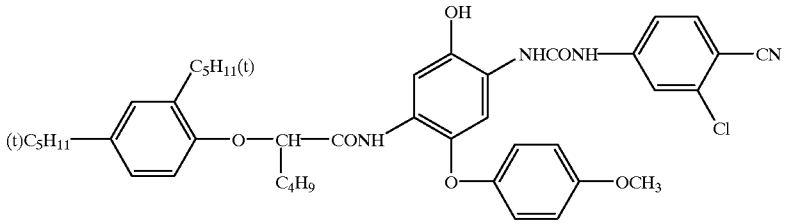
C-29
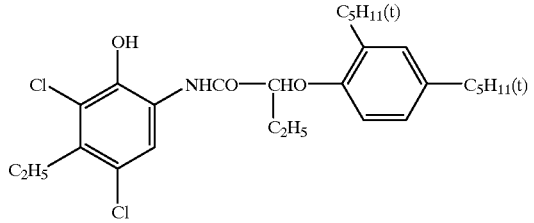
C-30
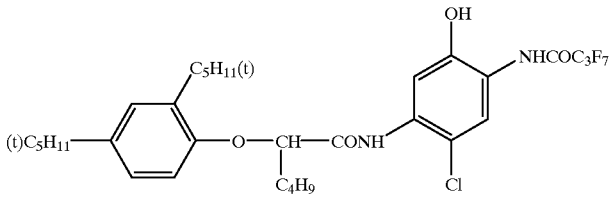
C-31
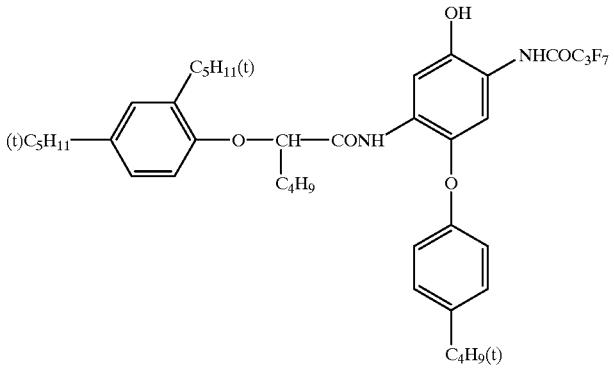
C-32
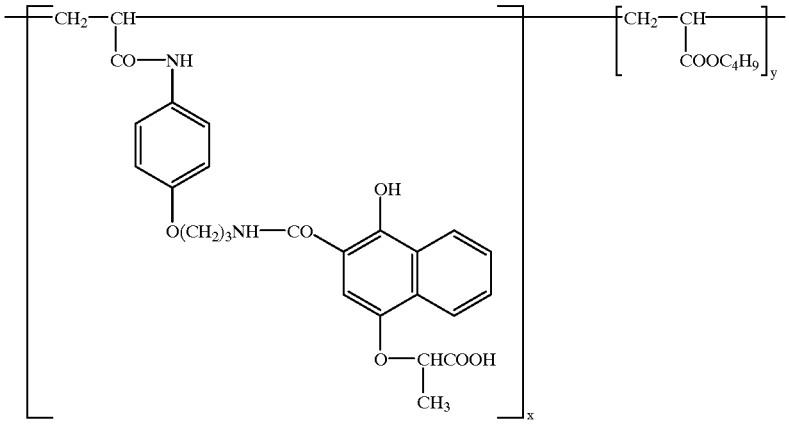
x : y = 40 : 60
(by weight ratio)

-continued
C-33
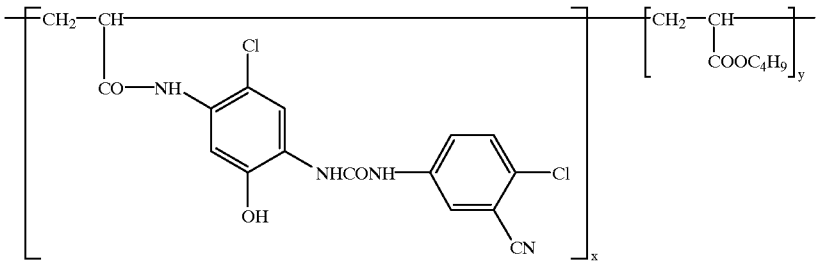
x : y = 50 : 50
(by weight ratio)
C-34
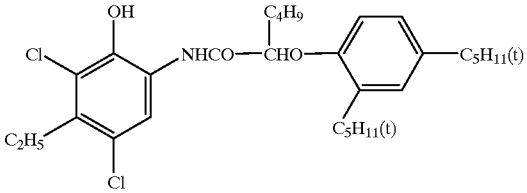
C-35
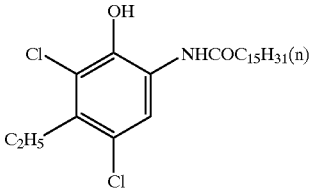
C-36
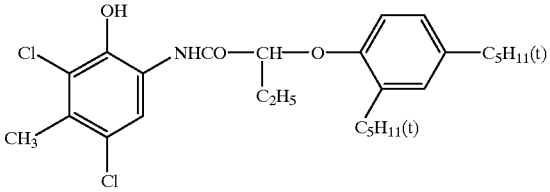
C-37
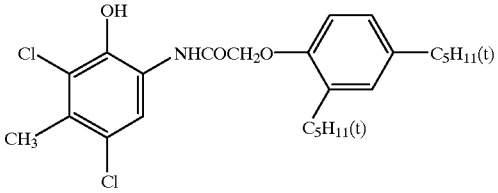
C-38
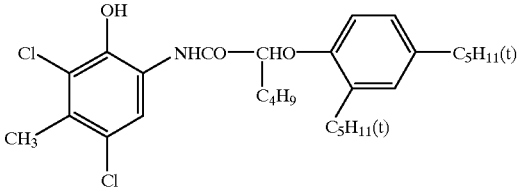
C-39
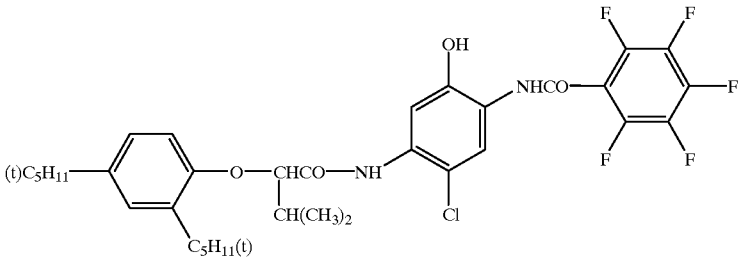

-continued

C-40

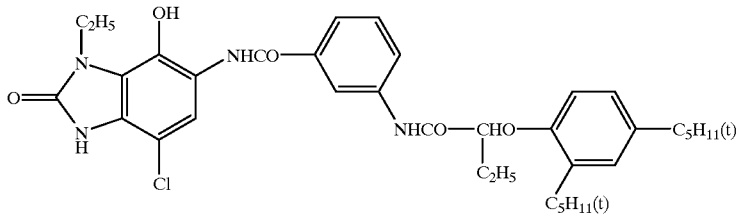

In the present invention, the added amount of a two-equivalent yellow coupler is preferably $5\times10^{-5}$ to $2\times10^{-3}$ mol/m$^2$, more preferably $1\times10^{-4}$ to $2\times10^{-3}$ mol/m$^2$ and most preferably $2\times10^{-4}$ to $2\times10^{-3}$ mol/m$^2$. The added amount of a two-equivalent magenta coupler is preferably $2\times10^{-5}$ to $1\times10^{-3}$ mol/m$^2$, most $2\times10^{-5}$ to $1\times10^{-3}$ mol/m$^2$ and specifically more preferably $1\times10^{-4}$ to $1\times10^{-3}$ mol/m$^2$. The added amount of a two-equivalent yellow coupler is preferably $5\times10^{-5}$ to $2\times10^{-3}$ mol/m$^2$, more preferably $1\times10^{-4}$ to $2\times10^{-3}$ mol/m$^2$ and most preferably $2\times10^{-4}$ to $2\times10^{-3}$ mol/m$^2$.

In order to add a coupler of the present invention to the silver halide emulsion, a coupler is dissolved in a high boiling solvent, together with a low boiling solvent as necessary. The resulting mixture is mixed with an aqueous gelatin solution containing a surfactant. The resulting solution is emulsified to be dissolved by means of a high speed rotation mixer, a colloid mill, a ultrasonic dispersant and a capillary type emulsifying device. The above-mentioned high boiling solvents include carboxylic acid esters, phosphoric acid esters, carboxylic acid amides, ethers and substituted hydro-carbons. Practically, di-n-butylphthanol acid ester, diisooctylphthanolic ester, dimethoxyethylphthanol acid ester, di-n-butyladipinic acid ester, diisooctyladipinic acid ester, tri-n-butylcitric acid ester, butyl lauric acid ester, di-n-sebacic acid ester, tricrezylphosphoric acid ester, tri-n-butylphosphoric acid ester, triisooctyl phosphoric acid ester, N, N-diethyl caprylic acid amide, N, N-dimethyl palmitinic acid amide, n-butylpentadecylphenylether, ethyl-2,4-di-tert-butylphenylether, succinic acid dioctylester and maleic acid dioctylester are cited. As a low boiling solvent, ethyl acetate, butyl acetate, cyclohexane and butylpropionate are cited.

In the present invention, a silver halide emulsion having a photographic structural layer comprising at least a light-sensitive layer and a non-sensitive layer on one side of a transparent support and which is panchromatically sensitized is defined to be a silver halide emulsion having sensitivity in the visual region, i.e., all of blue light, green light and red light. In aforesaid silver halide emulsion, a blue sensitive silver halide emulsion, a green sensitive silver halide emulsion and a red sensitive silver halide emulsion may be mixed in a certain mixing ratios. Otherwise, a silver halide emulsion in which a blue sensitive sensitizing dye, a green sensitive sensitizing dye and a red sensitive sensitizing dye are added so that it is sensitive to all of blue light, green light and red light may also be employed. Concurrently, the above-mentioned light-sensitive layer contains the dispersed product of the above-mentioned hexa—equivalent coupler.

There is no limit to the silver halide composition inside silver halide grains containing in the silver halide light-sensitive material of the present invention. However, in the case of a silver bromoiodide grain, it is preferable for it to have a core/shell structure. The silver iodide content in the core phase is preferably 10 mol % or more, and specifically preferably 20 mol % or more. The silver iodide content in the outermost shell layer is preferably 10 mol % or less, and specifically preferably 5 mol % or less. As a method for analyzing the composition of the above-mentioned silver halide grain, a method described in Japanese Patent O.P.I. Publication No. 142531/1992 can be referred to.

In the silver halide emulsion of the present invention, it is preferable that the silver iodide content between each grain is uniform.

When the average silver iodide content is measured by means of an XMA method which is commonly used in the photographic industry, the relative standard deviation of the measurement value is preferably 20% or less, more preferably 15% or less and specifically more preferably 5% or more and 12% or less.

Here, a relative standard deviation is defined to be {(the standard deviation of the silver iodide content when the silver iodide content ratio of at least 100 silver halide emulsion grains divided by the average silver iodide content ratio)×100}.

It is preferable that the silver halide emulsion used in the present invention is a mono-dispersed silver halide emulsion.

In the present invention, aforesaid a mono-dispersed silver halide emulsion is defined to be that the weight of silver halide included in the grain size distribution of ±20% with the average grain size d as the center is 70% or more, more preferably 80% or more and specifically more preferably 90% or more and 100% or less in total silver halide weight.

Here, the average grain size d is defined to be grain size (di) when the product of frequency ni of a grain having grain size (di) and $(di)^3$, i.e, ni x $(di)^3$ becomes maximum (the effective numeral is 3 digits and the minimum digit is rounded off).

Here, grain size is defined to be the diameter when the projecting the image of a grain is converted to a circular image having the same area. The grain size can be obtained by magnifying the above-mentioned grains to 10,000 through 50,000 times to be projected and by measuring the diameter of the grain or an area when projected (it is pre-determined that the number of measured grain size is randomly chosen 100 pcs or more).

The width of the distribution of a specifically preferable high-level mono-dispersed emulsion of the present invention defined by (Standard deviation of the grain size/Average grain size)

×100=the width of distribution.

is preferably 20% or less and specifically preferably 5% or more and 15% or less.

Here, the grain size measurement method is in accordance with the above-mentioned measurement method, and the average grain size is an arithmetic average.

Average grain size=Σdini/Σni

The average grain size of the silver halide emulsion of the present invention is preferably 0.1–10.0 μm, more preferably 0.2–5.0 μm and specifically preferably 0.3–3.0 μm.

In the present invention, it is preferable that the silver halide preferably used contains tabular silver halide grains whose average aspect ratio is 3 or more and preferably 4 or more and 20 or less.

The average aspect ratio referred to in the present invention is calculated as a ratio between the average diameter and the average thickness of the emulsion grains. Its specific definition and measurement method are the same as those disclosed in Japanese Patent O.P.I. Publication No. 10674/1985, 316847/1985 and 193138/1990.

In addition, the above-mentioned silver halide is preferably AgBrI.

The silver halide emulsion of the present invention is manufactured by an emulsion manufacturing apparatus using a double jet method in which pAg, pH, temperature and stirring in a liquid phase during growth are controlled to a prescribed pattern and addition of halogenated substances such as potassium bromide and potassium iodide and silver nitrate are controlled. In addition, to use substantially non-light-sensitive silver halide grains (preferably, at an average grain size of 0.01–0.2 μm) in a protective layer or an intermediate layer provides the desired effects. Specifically, it is preferable that the proportion of non-light-sensitive silver halide on the total silver amount coated in a light-sensitive material is 9% or more and 15% or less.

"Substantially non-light-sensitive" is defined to be 1/50 sensitivity of grains having the minimum sensitivity which exists in a light-sensitive emulsion layer.

In the present invention, silver halide emulsions having different grain size or different halide composition each other in the identical structural layer are mixed at an arbitrary ratio to be used in order to obtain a wide exposure latitude.

As silver halide grains, having different grain size each other, which are mixed to be used, a combinations from of silver halide grains having the maximum average grain size of 0.2–2.0 and silver halide grains having the minimum average grain size of 0.05–1.0 is preferable. In addition, one or more kinds of silver halide grains having an intermediate average grain size may be combined thereto. In addition, the average grain size of the silver halide grain having the maximum average grain size is preferably 1.5–40 times of the average grain size of the silver halide grains having the minimum average grain size.

In the present invention, a black dye image forming type coupler is referred to as a black coupler, in which a black dye image is formed due to coupling with an oxidized product of a color developing agent. The black dye image forming type coupler includes m-aminophenol compounds disclosed in Japanese Patent O.P.I. Publication No. 42725/1977, Japanese Patent Publication Nos. 49891/1982, 9938/1983 and 10737/1983, pyrazolone compounds disclosed in Japanese Patent Publication Nos. 49892/1982 and 46378/1984, resorcin compounds disclosed in 59126/1988, resorcinol compounds disclosed in Japanese Patent Publication No. 369/1991 and hydroxynaphthalene compounds disclosed in Japanese Patent O.P.I. Publication No. 149943/1980. All of these can be utilized.

Specifically preferable black dye image forming type couplers are m-aminophenol compounds. Illustrated compounds (1) through (82) in Japanese Patent Publication No. 49891/1982 are useful.

In the present invention, by means of a black coupler, or mixing of a yellow coupler, a magenta coupler, and a cyan coupler, a monochrome image can be obtained. In addition, due to mixing of a red coupler and a blue coupler, a monochrome coupler can be obtained. As practical examples of a red coupler, ketomethine type couplers in which a cyano group combines on an active methylene group are cited.

In the present invention, a silver halide light-sensitive material containing a hexa-equivalent coupler can form a monochrome image by means of an ordinary color photographic processing having a step in which a light-sensitive material is processed with a color developing solution after exposure.

With regard to color photographic processing, C-41 processing by Eastman Kodak, CNK-4 processing by Konica and CN-16 processing by Fuji Photo Film Industry Co., Ltd. which are common in the market are preferable.

In the present invention, from a monochrome image negative film of the present invention which has already been subjected to color photographic processing, printing is made on a black-and-white photographic paper or a color photographic paper for obtaining a monochrome image. Specifically, it is preferable to obtain a sepia tone monochrome image printing by printing on a color photographic paper.

"Sepia color" is generally referred to as an extremely dark yellow. In JIS Z 8721 (by means of a color display method using a tri-attribute), it is described as 10YR 2.5/2. In addition, in accordance with JIS Z 8701 (a color display method by means of an XYZ display system and X10Y10Z10 display system), the sepia belongs to yellow to yellowish red. The above-mentioned issues are described in "Color Science Lexicon" (Japan Color Hue Academy). In addition, in "Color Name Picture Book", (Written by Kunio Fukuda and published by Shufunotomo-sha), it is represented as dot density of C60, M74, Y85 and B57 in terms of an offset printing. Its typical color is illustrated.

In the present invention, in an L*a*b* coordinate system, an area which satisfies the following unequations is defined to be a sepia tone. $b^* \leqq a^*$ and $b \geqq 3.5a^*$ and $60 \geqq L^* \geqq 90$ and $5 \geqq c^*$.

In the present invention, a photo-taking unit packages an unexposed silver halide light-sensitive material and a monochrome image forming silver halide light-sensitive material while being capable of photographing. Aforesaid photo-taking unit i s not necessary to modify from a photo-taking unit for color film, in which conventional technologies can be applied. FIG. 1 is a photo-taking unit showing an example of the present invention.

Owing to the light-sensitive material of the present invention, so-called black-and-white photography employing an ordinary negative-positive type color photography system without burdening to a lab. Therefore, supplying of a photo-taking unit (see FIG. 1) such as "Film in Mini black-and-white" in which there is no worry about erroneous loading and anybody can easily enjoy photographing can be facilitated, noticeably contributing for prevailing of a black-and-white photography. Specifically, due to coloring to orange in such a manner that printing level can be set identical to Konica LV series (LV100, LV200 and LV400) which is a silver halide color light-sensitive material produced by Konica, the silver halide light-sensitive material of the present invention has merits not only to be suitable for color photographic processing but also to be able to be subjected to printing processing, in a printing process, without distincting with an ordinary color negative film.

In addition, the light-sensitive material of the present invention is excellent in terms of image graininess and photographic processing stability and is easy in terms of printing on a photographic paper and has a merit to be able to easily prepare monochrome printing in a sepia tone.

The silver halide emulsion capable of being used for the light-sensitive material of the present invention, As a silver halide emulsion used for the light-sensitive material of the present invention, one which is described in RD308119 can be cited. Hereinafter, described points will be exhibited.

| Issue | Page in RD308119 |
|---|---|
| Iodide structure | 993I-A |
| Production method | 993I-A and 994 E |
| Crystal habit: | |
| Normal | - ditto - |
| Twinned | - ditto - |
| Epitaxial | - ditto - |
| Halogen composition: | |
| Uniform | 993I-B |
| Ununiform | - ditto - |
| Halogen conversion | 994I-C |
| Halogen substituted | - ditto - |
| Metal content | 995I-D |
| Mono-dispersion | 995I-F |
| Solvent addition | - ditto - |
| Latent image formation position: | |
| Surface | 995I-G |
| Inner area | - ditto - |
| Light-sensitive material applied | |
| Negative | 995I-H |
| Emulsion is mixed to be used | 995I-J |
| Desalting | 995II-A |

In the present invention, the silver halide emulsion is subjected to physical ripening, chemical ripening and spectral sensitization. Additives used in the above-mentioned processes are described in RD17643, 18716 and 308119. Hereinafter, described points will be exhibited.

| [Issue] | [RD308119] | [RD17643] | [RD18716] |
|---|---|---|---|
| Chemical sensitizer | 996III-A | 23 | 648 |
| Spectral sensitizer | 996IV-A-A, B C, D, H, I & J | 23–24 | 648–9 |
| Super sensitizer | 996 IV-A-E & J | 23–24 | 648–9 |
| Anti-foggant | 998 VI | 24–25 | 649 |
| Stabilizer | 998 VI | 24–25 | 649 |

Conventional photographic additives usable for the present invention are also described in the above-mentioned RDs. Hereinafter, relevant described points will be exhibited.

| [Issue] | [RD308119] | [RD17643] | [RD18716] |
|---|---|---|---|
| Anti-stain agent | 1002VII-I | 25 | 650 |
| Dye image stabilizer | 1001VII-J | 25 | |
| Brightening agent | 998V | 24 | |
| UV absorber | 1003VIII-C XIIIC | 25–26 | |
| Light-absorption agent | 1003VIII | 25–26 | |
| Light scattering agent | 1003VIII | | |
| Filter dye | 1003VIII | 25–26 | |
| Binder | 1003IX | 26 | 651 |
| Anti-static agent | 1006XIII | 27 | 650 |
| Hardener | 1004X | 26 | 651 |
| Plasticizer | 1006XII | 27 | 650 |
| Lubricant | 1006XII | 27 | 650 |
| Matting agent | 1007XVI | | |
| Developing agent (contained in a light-sensitive material) | 1011XXB | | |

The above-mentioned additives may be added by means of a dispersion method described in RD308119XIV. In addition, the light-sensitive material of the present invention is provided with an auxiliary layer such as a filter layer and an intermediate layer as described in RD308119VII-K. It may take various layer structure such as an ordinary layer structure, a reverse layer structure and a unit structure.

The light-sensitive material of the present invention may be subjected to photographic processing by means of an ordinary method described in RD17643, pp. 28–29 and RD18716 page 647 and RD308119, XIX.

EXAMPLE

Hereinafter, the present invention will be detailed referring to examples. Unless otherwise described specifically, coated amount is represented by g/m$^2$, silver halide is represented in conversion to metallic silver, and sensitizing dye is represented by mol number per mol of silver halide.

Example 1

On a 122 $\mu$m thickness transparent triacetylcellulose support having a subbing layer, the following photographic structural layers were provided to prepare silver halide light-sensitive material 101.

<Light-Sensitive Layer>

| | |
|---|---|
| Silver bromoiodide emulsion A (average grain size was 1.2 $\mu$m, AgI was 8 mol %) | 2.2 |
| Silver bromoiodide emulsion B (average grain size was 0.45 $\mu$m, AgI was 4 mol %) | 3.8 |
| Sensitizing dye (SD-1) | $1.3 \times 10^{-4}$ |
| Sensitizing dye (SD-2) | $9.2 \times 10^{-5}$ |
| Stabilizer (ST-1) | 0.0004 |
| Anti-foggant (AF-1) | 0.0013 |
| Gelatin | 6.0 |
| Dye (AIM-1) | 0.003 |
| Dye (AIC-1) | 0.002 |
| Surfactant (Su-1) | 0.001 |
| Thickening agent agent | 0.008 |

<Protective layer>

| | |
|---|---|
| Matting agent (MAT-1) | 0.04 |
| Lubricant (WAX-1) | 0.04 |
| Anti-mildew agent (DI-1) | 0.001 |
| Gelatin | 0.6 |
| Surfactant (Su-2) | 0.002 |
| Hardener (H-1) | 0.02 |

Next, Sample 102 was prepared in the same manner as in Sample 101 except the following dyes were added as an oil-in-water particle type dispersing solution in the light-sensitive material.

| | |
|---|---|
| Dye A | 1.6 |
| Dye B | 0.96 |

SD-1
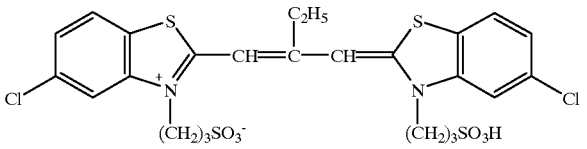
SD-2
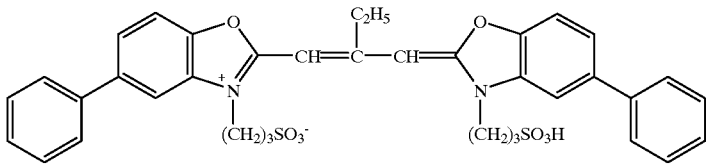
ST-1
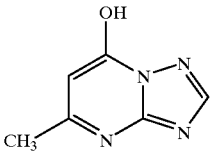
AF-1
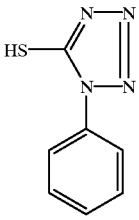
AIM-1
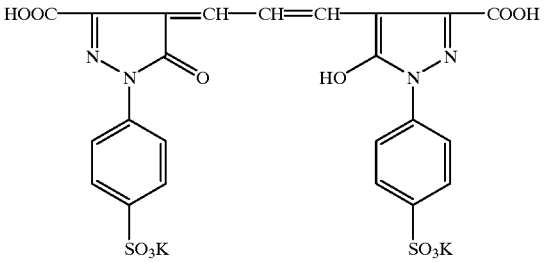
AIC-1
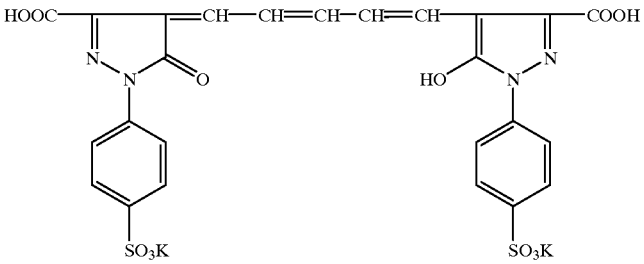
Su-1
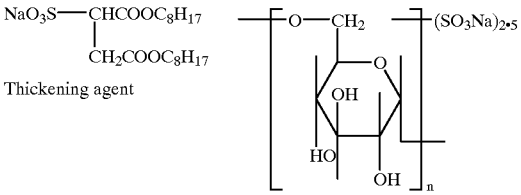
Thickening agent
Average molecular weight by weight: 20,000

-continued

MAT-1

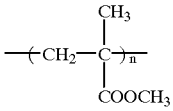

Average molecular weight by weight: 50,000

WAX-1

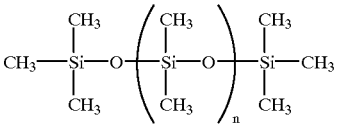

Average molecular weight by weight: 3,000

Dl-1

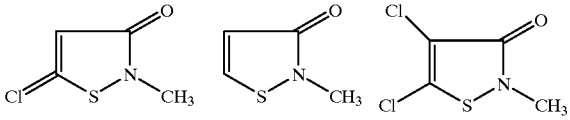

(Component A) (Component B) (Component C)

Component A: Component B: Component C = 50:46:4 (mol ratio)

Su-2

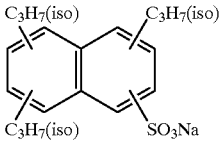

H-1

$(CH_2{=}CHSO_2CH_2)_2O$

Dye A

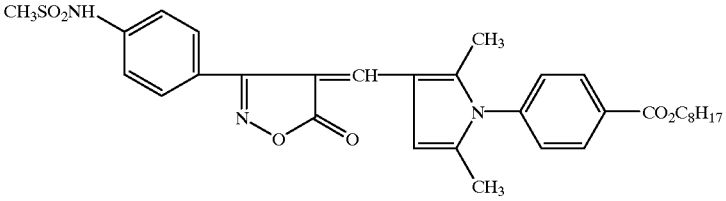

Dye B

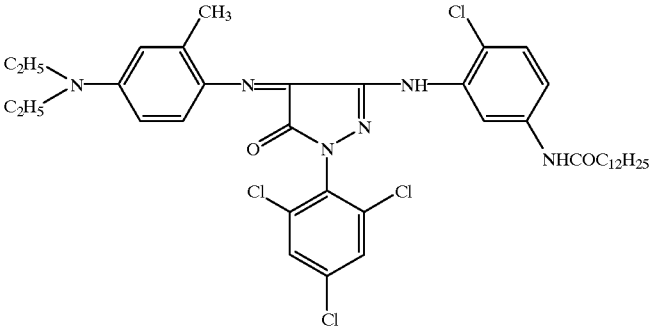

Samples 101 and 102 were respectively cut to a 135 standard size which is an ordinary photographic format and perforated. The films were housed in a cartridge, and portrait photography was conducted outdoors using a Big Mini (a camera produced by Konica Corporation).

The above-mentioned photographed samples were subjected to photographic processing using the following steps, and dried so that film samples 101 and 102 having a black-and-white negative image were obtained.

| | | |
|---|---|---|
| Konica Dol DP (produced by Konica) | 26° C. | 3.5 min. |
| Stop (1.5% an aqueous acetic acid solution) | 26° C. | 30 sec. |

-continued

| | | |
|---|---|---|
| Konica Fix Rapid (produced by Konica) | 26° C. | 3 min. |
| Washing | 15° C. | 20 min. |

In a commercial lab, in an ordinary negative-positive type color photographic process, film samples 101 and 102 were printed on a color photographic paper QA paper type A6 produced by Konica using a color printer KCP-5N3II produced by Konica in which printing level was set up for color negative films of each company. Since Sample 102 had almost the same printing level as a color negative film LV series, a satisfiable black-and-white print could be obtained with once operation. With regard to Sample 101, after trial and error on printing conditions, finally a black-and-white print was obtained. Thus, it can be found that the present invention is effective.

Example 2

On a 122 μm thickness transparent triacetylcellulose support having a subbing layer, the following photographic structural layers were provided to prepare silver halide light-sensitive material 201.

<Light-Sensitive Layer>

| | |
|---|---|
| Silver bromoiodide emulsion A (average grain size was 1.2 μm, AgI was 8 mol %) | 2.2 |
| Silver bromoiodide emulsion B (average grain size was 0.45 μm, AgI was 4 mol %) | 3.8 |
| Sensitizing dye (SD-1) | $1.3 \times 10^{-4}$ |
| Sensitizing dye (SD-2) | $9.2 \times 10^{-5}$ |
| Stabilizer (ST-1) | 0.0004 |
| Anti-foggant (AF-1) | 0.0013 |
| Gelatin | 6.0 |
| Dye (AIM-1) | 0.003 |
| Dye (AIC-1) | 0.002 |
| Surfactant (Su-1) | 0.001 |
| Thickening agent agent | 0.008 |
| <Protective layer> | |
| Matting agent (MAT-1) | 0.04 |
| Lubricant (WAX-1) | 0.04 |
| Anti-mildew agent (DI-1) | 0.001 |
| Gelatin | 0.6 |
| Surfactant (Su-2) | 0.002 |
| Hardener (H-1) | 0.02 |

Next, Sample 202 was prepared in the same manner as in Sample 201 except the following colored coupler dispersed solution was added in a light-sensitive layer.

<Colored Coupler Dispersed Solution>

| | |
|---|---|
| Colored coupler (YCM-2) | 2.4 |
| Colored coupler (MCC-2) | 1.1 |
| High boiling organic solvent (HBS-1) | 1.0 |

HBS-1

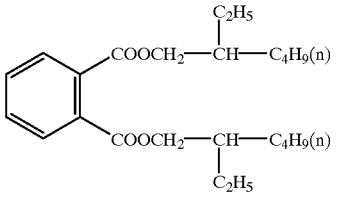

-continued

| | |
|---|---|
| Surfactant (Su-1) | 0.002 |
| Gelatin | 0.6 |

Samples 201 and 202 were respectively cut to a 135 standard size which is an ordinary photographic format and perforated. The films were housed in a cartridge, and portrait photography was conducted outdoor.

The above-mentioned photographed samples were subjected to photographic processing, and dried so that film samples 201 and 202 having a black-and-white negative image were obtained.

In a commercial lab, in an ordinary negative-positive type color photographic process, film samples 201 and 202 were printed on a color photographic paper QA paper type A6 produced by Konica using a color printer KCP-5N3II produced by Konica in which printing level was set up for color negative films of each company. Since Sample 202 had almost the same printing level as a color negative film LV series, a satisfactory black-and-white print was obtained with once operation. With regard to Sample 101, after trial and error on printing conditions, finally a black-and-white print was obtained. Thus, it can be found that the present invention is effective.

Example 3

Silver halide light-sensitive material sample 301 was prepared in the same manner as in Example 2.

<Light-sensitive layer>

| | |
|---|---|
| Silver bromoiodide emulsion A (average grain size was 1.2 μm, AgI was 8 mol %) | 2.2 |
| Silver bromoiodide emulsion B (average grain size was 0.45 μm, AgI was 4 mol %) | 3.8 |
| Sensitizing dye (SD-1) | $1.3 \times 10^{-4}$ |
| Sensitizing dye (SD-2) | $9.2 \times 10^{-5}$ |
| Stabilizer (ST-1) | 0.0004 |
| Anti-foggant (AF-1) | 0.0013 |
| Biack coupler (B-1) | 2.1 |
| High boiling solvent (HBS-2) | 1.2 |
| Gelatin | 6.0 |
| Dye (AIM-1) | 0.003 |
| Dye (AIC-1) | 0.002 |
| Surfactant (Su-1) | 0.001 |
| Thickening agent agent | 0.008 |

B-1

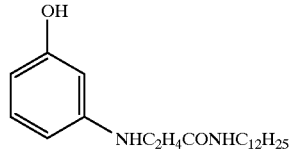

HBS-2

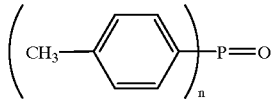

<Protective layer>

| | |
|---|---|
| Matting agent (MAT-1) | 0.04 |
| Lubricant (WAX-1) | 0.04 |
| Anti-mildew agent (DI-1) | 0.001 |
| Gelatin | 6.6 |

-continued

| | |
|---|---|
| Surfactant (Su-2) | 0.002 |
| Hardener (H-1) | 0.02 |

Next, Sample 302 was prepared in the same manner as in Sample 301 except thar the following colored coupler dispersed solution was added in a light-sensitive layer.

<Colored Coupler Dispersed Solution>

| | |
|---|---|
| Colored coupler (YCM-2) | 2.4 |
| Colored coupler (MCC-2) | 1.1 |
| High boiling organic solvent (HBS-1) | 1.0 |
| Surfactant (Su-1) | 0.002 |
| Gelatin | 0.6 |

Samples 301 and 302 were respectively used for portrait photography outdoor.

The above-mentioned photographed samples were subjected to photographic processing using CNK-4-J1 for color negative film produced by Konica Corporation, and dried so that film samples 301 and 302 having a black-and-white negative image were obtained.

In the same manner as in Example 1, processes for preparing a black-and-white printing was investigated. As a result, it was found that Sample 302 of the present invention is suitable for an ordinary negative-positive type color photographic processes in an ordinary commercial lab and that a black-and-white printing could be obtained without burdening no load on an operation process in a lab.

Example 4

Silver halide light-sensitive material sample 401 was prepared in the same manner as in Example 3.

<Light-Sensitive Layer>

| | |
|---|---|
| Silver bromoiodide emulsion A (average grain size was 1.2 μm, AgI was 8 mol %) | 2.2 |
| Silver bromoiodide emulsion B (average grain size was 0.45 μm, AgI was 4 mol %) | 3.8 |
| Sensitizing dye (SD-1) | $1.3 \times 10^{-4}$ |
| Sensitizing dye (SD-2) | $9.2 \times 10^{-5}$ |
| Stabilizer (ST-1) | 0.0004 |
| Anti-foggant (AF-1) | 0.0013 |
| Yellow coupler (Y-1) | 1.41 |
| Magenta coupler (M-1) | 0.72 |
| Cyan coupler (C-1) | 1.11 |
| High boiling solvent (HBS-2) | 0.76 |
| High boiling solvent (HBS-3) | 0.84 |
| Gelatin | 7.8 |
| Dye (AIM-1) | 0.003 |
| Dye (AIC-1) | 0.002 |
| Surfactant (Su-1) | 0.001 |
| Thickening agent agent | 0.008 |

-continued

Y-1

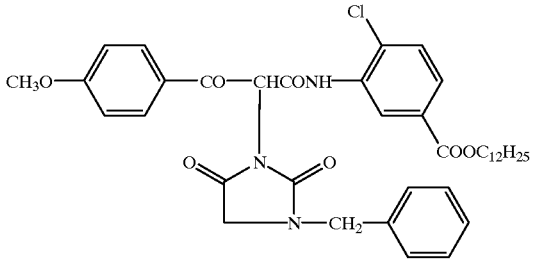

M-1

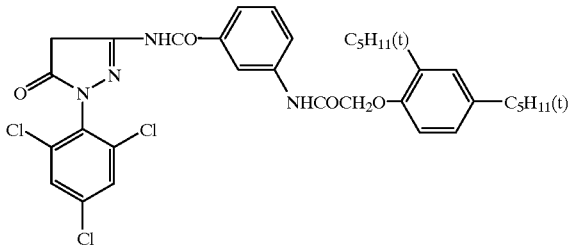

C-1

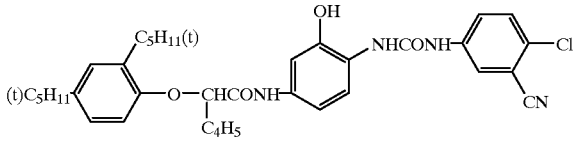

HBS-3

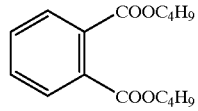

| | |
|---|---|
| Matting agent (MAT-1) | 0.04 |
| Lubricant (WAX-1) | 0.04 |
| Anti-mildew agent (DI-1) | 0.001 |
| Gelatin | 6.6 |
| Surfactant (Su-2) | 0.002 |
| Hardener (H-1) | 0.02 |

Next, Sample 402 was prepared in the same manner as in Sample 401 except that 0.20 g/m$^2$ of colored coupler YCM-2, 0.11 g/m$^2$ of MCC-2 and 0.04 g/m$^2$ of YCC were incorporated in a light-sensitive layer.

In the same manner as in Example 1, Samples 401 and 402 were used in outdoor portrait photographing, and subjected to color photographic processing and black-and-white printing using a color printer. As a result, it was found that Sample 402 of the present invention is suitable for an ordinary negative-positive type color photographic processes in an ordinary commercial lab and that a black-and-white printing could be obtained without burdening no load on an operation process in a lab.

Example 5

In the same manner as in Example 402 in Example 4 except that the following red coloring coupler of 1.85 g/m$^2$ and blue coloring coupler of 1.68 g/m$^2$ in place of a yellow, magenta and cyan couplers in Example 402, Sample 502 was prepared. Sample 502 was subjected to the identical evaluation as Sample 402.

As a result, a black-and-white print suitable for a negative-positive type color photographic process can be obtained.

Red coloring coupler

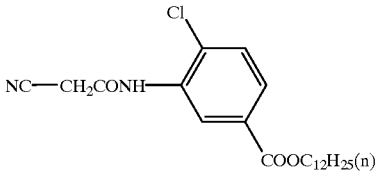

Blue coloring coupler

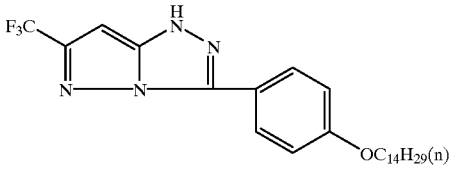

The present invention can provide a monochrome image forming silver halide light-sensitive material which is suitable for a negative-positive type color photographic system and which is easy in printing on a photographic paper.

Example 6

On a 122 μm thickness transparent triacetylcellulose support having a subbing layer, the following photographic structural layers were provided successively from a support side to prepare multilayered silver halide light-sensitive material 601.

| | |
|---|---|
| 1st layer: Anti-halation layer | |
| Black colloidal silver | 0.16 |
| UV absorber (UV-1) | 0.21 |
| High boiling organic solvent (Oil-1) | 0.12 |
| Colored coupler (CM-1) | 0.20 |
| Colored coupler (CC-1) | 0.04 |
| Gelatin | 1.53 |
| 2nd layer: Intermediate layer | |
| Gelatin | 0.80 |
| 3rd layer: Low sensitivity emulsion layer | |
| Silver bromoiodide emulsion A | 0.98 |
| (0.40 μ, AgI 4 mol %) | |
| Sensitizing dye (SD-1) | $2.4 \times 10^{-4}$ |
| Sensitizing dye (SD-2) | $2.1 \times 10^{-4}$ |
| Sensitizing dye (SD-3) | $1.9 \times 10^{-4}$ |
| Sensitizing dye (SD-4) | $1.7 \times 10^{-4}$ |
| Yellow coupler (Y-1) | 0.26 |
| Magenta coupler (M-1) | 0.21 |
| Cyan coupler (C-1) | 0.32 |
| High boiling organic solvent (Oil-2) | 0.72 |
| Gelatin | 2.10 |
| 4th layer: Medium sensitivity emulsion layer | |
| Silver bromoiodide emulsion B | 1.50 |
| (0.60 μ, AgI 7 mol %) | |
| Sensitizing dye (SD-1) | $2.3 \times 10^{-4}$ |
| Sensitizing dye (SD-2) | $1.3 \times 10^{-4}$ |
| Sensitizing dye (SD-3) | $1.6 \times 10^{-4}$ |

-continued

| | |
|---|---|
| Sensitizing dye (SD-4) | $1.3 \times 10^{-4}$ |
| Yellow coupler (Y-1) | 0.20 |
| Magenta coupler (M-1) | 0.16 |
| Cyan coupler (C-1) | 0.24 |
| High boiling organic solvent (Oil-2) | 0.55 |
| Gelatin | 2.20 |
| 5th layer: High sensitivity emulsion layer | |
| Silver bromoiodide emulsion C | 1.55 |
| (0.75 μ, AgI 8 mol %) | |
| Sensitizing dye (SD-1) | $1.8 \times 10^{-4}$ |
| Sensitizing dye (SD-2) | $1.0 \times 10^{-4}$ |
| Sensitizing dye (SD-3) | $1.3 \times 10^{-4}$ |
| Sensitizing dye (SD-4) | $1.0 \times 10^{-4}$ |
| Yellow coupler (Y-1) | 0.12 |
| Magenta coupler (M-1) | 0.08 |
| Cyan coupler (C-1) | 0.16 |
| High boiling organic solvent (Oil-2) | 0.33 |
| Gelatin | 1.60 |
| 6th layer: 1st protective layer | |
| Silver bromoiodide emulsion | 0.30 |
| (average grain size was 0.05 μm, AgI was 3 mol %) | |
| UV absorber (UV-1) | 0.09 |
| UV absorber (UV-2) | 0.10 |
| High boiling organic solvent (Oil-1) | 0.10 |
| Gelatin | 1.44 |
| 7th layer: 2nd protective layer | |
| Alkaline-soluble matting agent PM-1 | 0.15 |
| (average grain size was 2 μm) | |
| Polymethylmethacrylate | 0.04 |
| (the average grain size was 3 μm) | |
| Lubricant (WAX-1) | 0.02 |
| Gelatin | 0.55 |

In addition to the above-mentioned components, coating aids SU-1, SU-2 and SU-3, dispersion aid SU-4, viscosity regulator V-1, stabilizer ST-1, dyes AI-1 and AI-2, antifoggant AF-1, 2 kinds of polyvinyl pyrrolidone (AF-2: whose average molecular weight by weight were respectively 10,000 and 100,000), hardeners H-1 and H-2 and anti-mildew agent DI-1 were added.

Incidentally, Oil-1 represents dioctylphthalate and Oil-2 represents dioctylphthalate.

(Y-1)
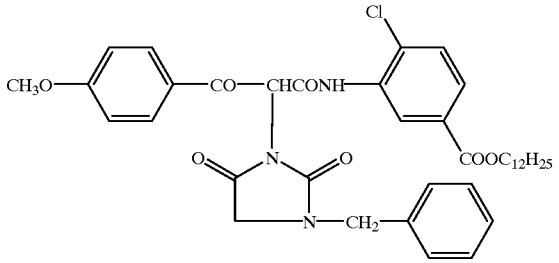
(M-1)
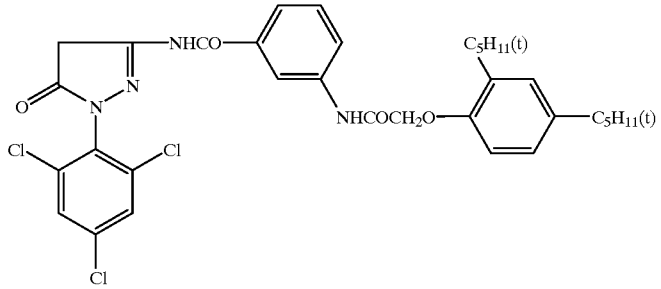
(C-1)
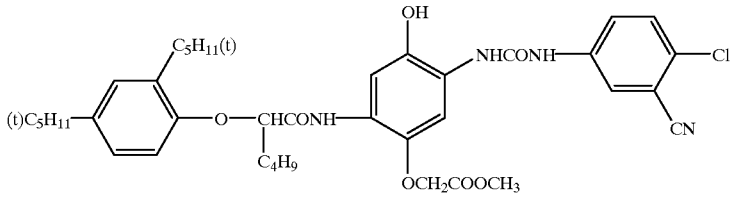
CM-1
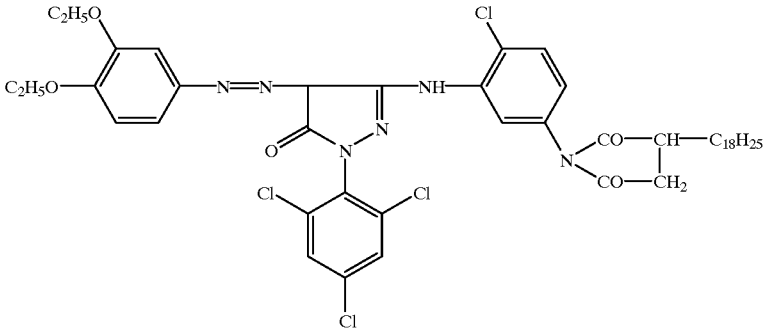
CC-1
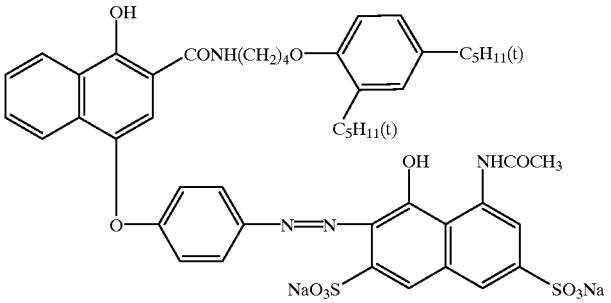
SD-1
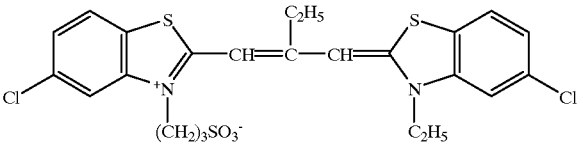

-continued
SD-2
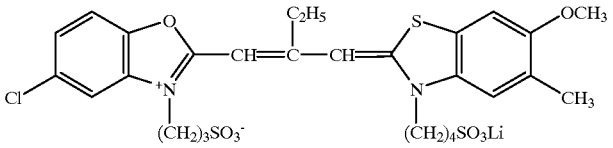
SD-3
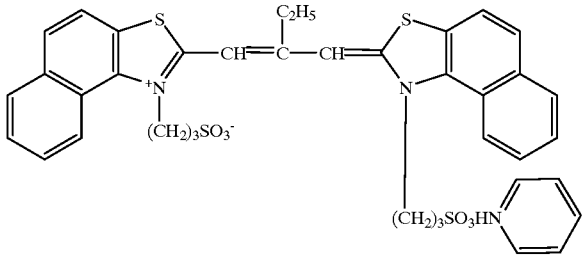
SD-4
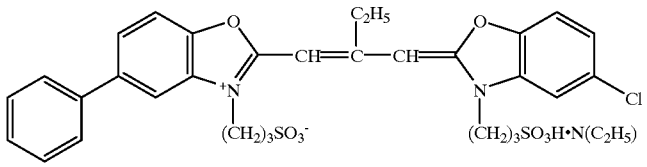
ST-1
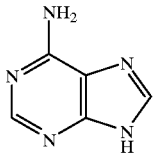
(M-2)
Comparative compound
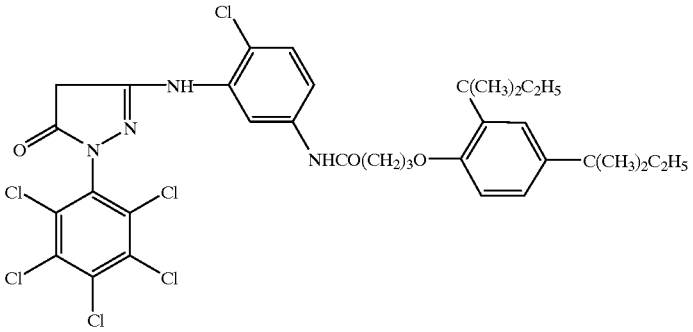
(M-3)
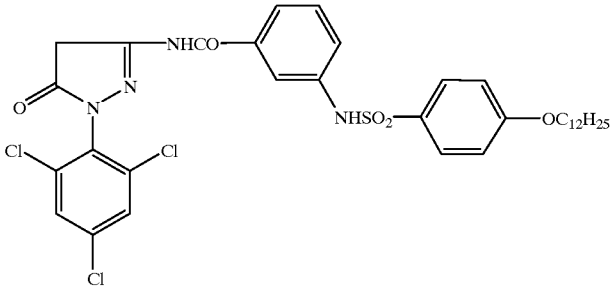

-continued
(M-4)
Compound of the invention
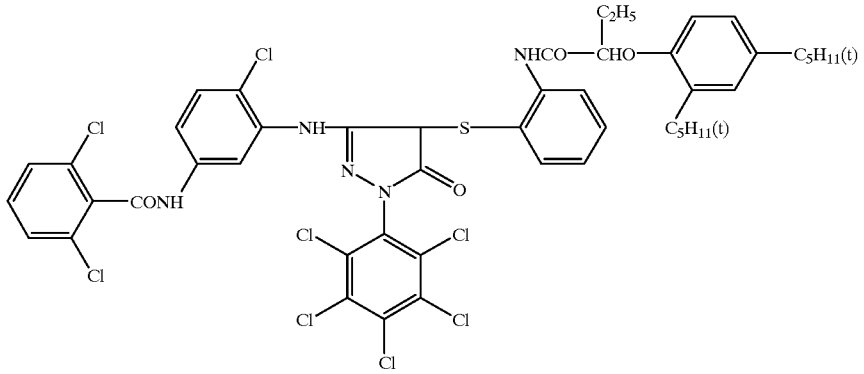
(M-5)
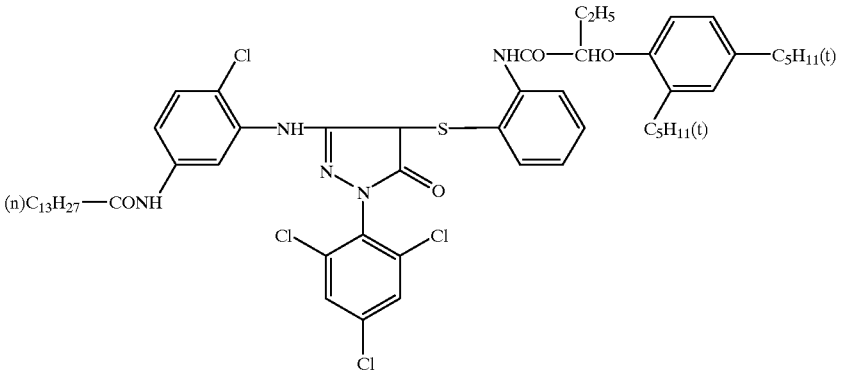
(M-6)
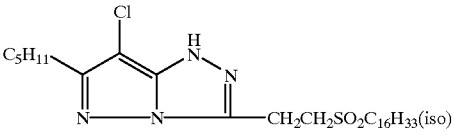
UV-1
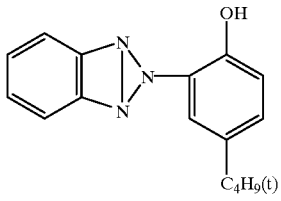
UV-2
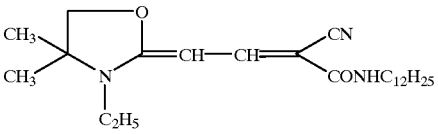
WAX-1
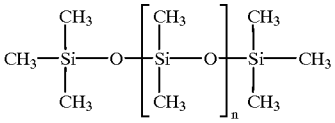
Average molecular weight by weight MW: 3,000

-continued
SU-1
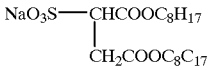
SU-3
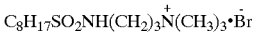
SU-2
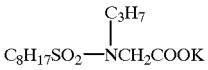
SU-4
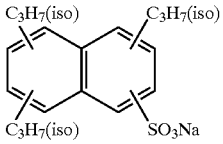
H-1
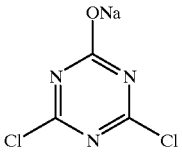
H-2
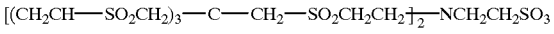
PM-1
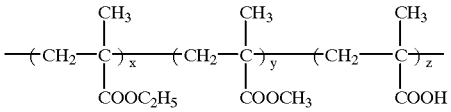
x: y: z = 3:3:4
V-1
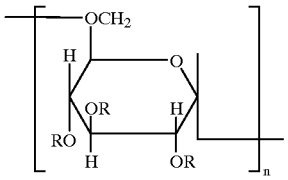
R: H, $SO_3H$
Average molecular weight MW: 120,000
AF-1
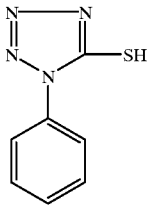
AF-2
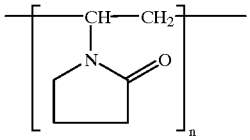
n: Polymerization degree
DI-1
(A mixture of the following three components)
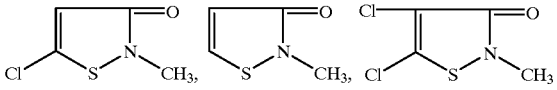
(Component A) (Component B) (Component C)
Component A: Component B: Component C = 50:46:4 (mol ratio)

-continued

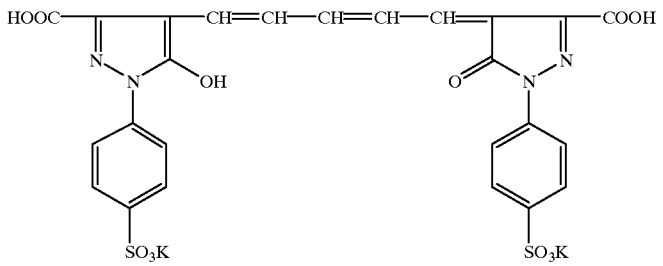

AI-1

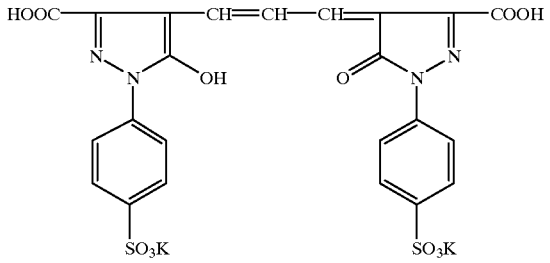

AI-2

Samples 602 through 606 were prepared in the same manner as in Sample No. 601 except that a magenta coupler in the third, fourth and fifth layers was replaced with magenta couplers M-2 through M-6.

Samples 601 through 606 prepared in the above-mentioned manner were subjected to wedge exposure to light using 5400 K light source, and then subjected to photographic processing in accordance with the following processing steps.

<Color Photographic Processing>

(Processing Steps)

| Step | Time | Processing Temperature | Amount of Replenishing* |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 60 sec. | 38 ± 5.0° C. | 830 ml |
| Drying | 60 sec. | 55 ± 5.0° C. | — |

*Amount of replenishing is a value per 1 $m^2$ of light-sensitive material.

<Preparation of a Processing Agent>

(Composition of a Color Developing Solution)

| | |
|---|---|
| Water | 800 ml |
| Potassium carbonate | 30 g |
| Sodium hydrocarbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-N-(β-hydroxyethyl) aniline sulfate | 4.5 g |
| Diethylenetetraamine pentaacetic acid | 3.0 g |
| Potassium hydroxide | 1.2 g |

Water was added to make 1.0 liter, and regulate pH to 10.06 using potassium hydroxide or 20% sulfuric acid.

(Composition of the Replenisher for the Color Developing Solution)

| | |
|---|---|
| Water | 800 ml |
| Potassium carbonate | 35 g |
| Sodium hydro-carbonate | 3.0 g |
| Potassium sulfite | 5.0 g |
| Sodium bromide | 0.4 g |
| Hydroxyamine sulfate | 3.1 g |
| 4-amino-3-methyl-N-ethyl-N-(β-hydroxyethyl) aniline sulfate | 6.3 g |
| Diethylenetetraamine pentaacetic acid | 3.0 g |
| Potassium hydroxide | 2.0 g |

Water was added to make 1.0 liter, and regulate pH to 10.18 using potassium hydroxide or 20% sulfuric acid.

(Composition of a Bleaching Solution)

| | |
|---|---|
| Water | 700 ml |
| Ferric (III) ammonium of 1,3-diaminopropane tetraacetic acid | 125 g |
| Ethylenediamine tetraacetic acid | 2 g |
| Sodium nitrate | 40 g |
| Ammonium bromide | 150 g |
| Glacial acetic acid | 40 g |

Water was added to make 1.0 liter, and regulate pH to 4.4 using aqueous ammonium or glacial acetic acid.

(Composition of a Replenisher for Bleaching Solution)

| | |
|---|---|
| Water | 700 ml |
| Ferric (III) ammonium of 1,3-diaminopropane tetraacetic acid | 175 g |
| Ethylenediamine tetraacetic acid | 2 g |
| Sodium nitrate | 50 g |
| Ammonium bromide | 200 g |
| Glacial acetic acid | 56 g |

Water was added to make 1.0 liter, and regulate pH to 4.4 using aqueous ammonium or glacial acetic acid.

(Formula of the Fixing Solution)

| | |
|---|---|
| Water | 800 ml |
| Ammonium thiocyanate | 120 g |
| Ammonium thiosulfate | 150 g |
| Sodium sulfite | 15 g |
| Ethylenediamine tetraacetic acid | 2 g |

Water was added to make 1.0 liter, and regulate pH to 6.2 using aqueous ammonium or glacial acetic acid.

(Formula of the Replenisher for the Fixing Solution)

| | |
|---|---|
| Water | 800 ml |
| Ammonium thiocyanate | 150 g |
| Ammonium thiosulfate | 180 g |
| Sodium sulfite | 20 g |
| Ethylenediamine tetraacetic acid | 2 g |

Water was added to make 1.0 liter, and regulate pH to 6.5 using aqueous ammonium or glacial acetic acid.

(Formulas for the Stabilizing Solution and the Replenisher for the Stabilizing Solution)

| | |
|---|---|
| Water | 900 ml |
| 10-mol addition product of p-octylphenol ethylene oxide | 2.0 g |
| Dimethylol urea | 0.5 g |
| Hexamethylenetetramine | 0.2 g |
| 1,2-benzoisothiazoline-3-on | 0.1 g |
| Siloxane (L-77 produced by UCC) | 0.1 g |
| Agueous ammonia | 0.5 ml |

Water was added to make 1.0 liter, and pH was regulated to 8.5 using aqueous ammonium or 50% sulfuric acid. The sensitivity of each sample was represented by the inverse of an exposure amount in which green density provided an optical fogging density ±0.15. Aforesaid sensitivity is shown in a table as a relative value where the value of the Sample was defined to be 100. In addition, the graininess of the magenta color images was evaluated in terms of RMS granuality. With regard to the RMS granuality, portions, where the green density fogging was ±0.3 and where the green density fogging ±0.1 were scanned with a microdensitometer having an aperture scanning area of 1800 $\mu m^2$ (a slit width was 10 $\mu$m and a slit length of 180 $\mu$m), and a 1000-magnified value of a standard deviation of fluctuation of the density value of the density measurement sampling number of 1000 or more was calculated, and such values are shown in the table by means of relative values when that of Sample 601 was defined as 100. It shows that the smaller the value, the more favorable the graininess is.

With regard to processing stability, in which the density fluctuation width, as to whether the density is active or inactive compared with the standard development was measured for B, G and R respectively. In Table 1, B/G and R/G are shown. Due to this, how "G" fluctuates against "B" and "R" are understood. The closer to 1.0, the fluctuation is B, G and R are close each other. Therefore, it can be said that they are stable against processing fluctuation. The model active and inactive color developing solutions were prepared in which the added amount of 4-amino-3-methyl-N-(β-hydroxyethyl)aniline sulfate was changed by ±20% compared with the standard Formula thereof. The above-mentioned level was formed using dispersion of a commercial lab as a model.

TABLE 1

| Sample No. | Magenta coupler in the 3, 4, 5 layer | Sensitivity | Graininess +0.3 | Graininess +1.0 | Processing Fluctuation B/G | Processing Fluctuation R/G |
|---|---|---|---|---|---|---|
| 601 | (M-1) | 100 | 100 | 100 | 1.20 | 1.25 |
| 602 | (M-2) | 103 | 105 | 110 | 1.10 | 1.15 |
| 603 | (M-3) | 105 | 100 | 118 | 1.24 | 1.28 |
| 604 | (M-4) | 115 | 95 | 72 | 1.00 | 0.98 |
| 605 | (M-5) | 112 | 97 | 75 | 1.02 | 0.98 |
| 606 | (M-6) | 105 | 98 | 80 | 1.05 | 1.03 |

It is apparent from the above-mentioned Table 1, it can be understood that, due to taking a coupler constitution of the present invention, the coupler is excellent in terms of graininess in the middle density region specifically and that balance of B, G and R against processing fluctuation is not damaged to be stable.

Next, by the use of Samples 601 and 604, outdoor portrait photographing was conducted. The photographed samples were subjected to photographic processing using photographic processing chemicals CNK-41-J1 in Konica's mini lab system NPS-858J Type II (the printer section was set at the print level channel of Konica LV series), and dried to obtain film samples 601 and 604 having a monochrome negative image. In addition, aforesaid films were printed on Konica color paper type QAA5 to obtain a monochrome print having a sepia tone.

In a series of development and printing operation processes, operation complexity and stability of printing finishing were investigated. As a result, in the case of Comparative Sample 601, it was necessary to conduct a trial printing twice for adjusting printing conditions for sepia tone balance. In addition, depending upon a scene, minute adjustment was necessary. To the contrary, Sample 604 of the present invention could be achieved printing under the same conditions as Konica color negative film LV series. Accordingly, it was found that the Sample 604 of the present invention is compatible with an ordinary negative-positive system color photographic processing in a commercial lab, and a sepia tone monochrome print could be obtained stably without burdening any load onto an operation in the lab.

Example 7

Sample No. 607 was prepared in the same manner as in Sample 604 in Example 6 except that the cyan coupler in the third, fourth and fifth layers were replaced with a Comparative compound (C-2), and Sample No. 608 was prepared in the same manner as in Sample 604 in Example 6 except that the yellow coupler in the third, fourth and fifth layers were replaced with a Comparative compound (Y-2).

TABLE 2

Comparative compound (C-2)

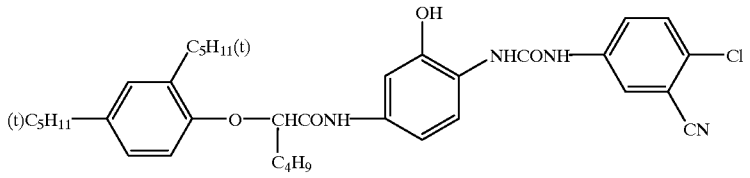

(Y-2)

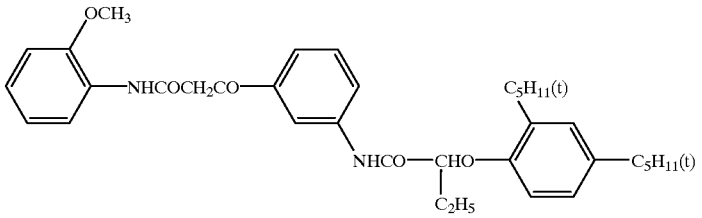

| Sample No. | Yellow coupler in the 3, 4, 5 layer | Magenta coupler in the 3, 4, 5 layer | Cyan coupler in the 3, 4, 5 layer | Processing Fluctuation B/G R/G |
|---|---|---|---|---|
| 604 | (Y-1) | (M-4) | (C-1) | 1.00<br>0.98 |
| 607 | (Y-1) | (M-4) | (C-2) | 1.08<br>0.85 |
| 608 | (Y-2) | (M-4) | (C-1) | 0.82<br>1.15 |

It is apparent from the above-mentioned Table 2, due to the coupler constitution of the present invention, balance of B, G and R fluctuations stable.

As being verified in the Examples, the silver halide light-sensitive material, the monochrome image forming silver halide light-sensitive material, the photo-taking unit and the monochrome image forming method of the present invention is compatible with an ordinary negative-positive system color photographic processing in a commercial lab, and a sepia tone monochrome print can be obtained stably without further burden operation in the lab.

We claim:

1. A monochrome-image forming silver halide light-sensitive material comprising a silver halide emulsion layer which is sensitive to all of blue light, green light, and red light, wherein the light-sensitive material is orange and comprises a non-eluting and non-decoloring dye or a non-eluting and non-decoloring pigment.

2. A silver halide light-sensitive material of claim 1 wherein the colored coupler is selected from a group consisting of yellow colored magenta coupler, a magenta colored cyan coupler and a yellow colored cyan coupler.

3. A silver halide light-sensitive material of claim 1, wherein the monochrome image is formed due to metallic silver formed by developing of silver halide.

4. A silver halide light-sensitive material of claim 1, wherein the monochrome image is formed due to a black dye image forming type coupler.

5. A silver halide light-sensitive material of claim 1, wherein the monochrome image is formed due to a mixture of a colorless coupler which forms a red image due to color developing and a colorless coupler which forms a blue image due to color developing.

6. A silver halide light-sensitive material of claim 1, wherein the monochrome image is formed due to a mixture of a colorless coupler which forms a yellow image, a colorless coupler which forms a magenta image and a colorless coupler which forms a cyan image due to color developing.

7. A silver halide light-sensitive material of claim 1 having photographic constituting layers composed of at least one light-sensitive layer and at least one non-light-sensitive layer on one side of a transparent support, wherein aforesaid light-sensitive layer contains a silver halide emulsion sensitized to panchromatic light and a dispersed product of a hexa-equivalent coupler.

8. A silver halide light-sensitive material of claim 6, wherein the silver halide is AgBrI.

9. A silver halide light-sensitive material of claim 6, wherein the silver halide contains tabular silver halide grains whose average aspect ratio is 3 or more.

10. The silver halide light-sensitive material of claim 1 wherein a silver halide emulsion in the silver halide emulsion layer is a mixture of a blue sensitive silver halide emulsion, a green sensitive silver halide emulsion and a red sensitive silver halide emulsion.

11. The silver halide light-sensitive material of claim 1 wherein a silver halide emulsion in the silver halide emulsion layer is panchromatically sensitized.

12. The silver halide light-sensitive material of claim 1 wherein yellow, magenta and cyan couplers are mixed in the silver halide emulsion layer.

13. The silver halide light-sensitive material of claim 1 wherein the light-sensitive material comprises yellow, magenta and cyan couplers, and spectral sensitivity distribution of silver halide covers all of the visible regions in all layers.

14. The silver halide light-sensitive material of claim 1 further having an identical printing level as at least one of the silver halide color light-sensitive materials provided for a negative-position type color photographic system.

15. The silver halide light-sensitive material of claim 1 wherein the silver halide emulsion layer further comprises a black dye image forming coupler.

16. The silver halide light-sensitive material of claim 1 wherein the silver halide emulsion layer further comprises a yellow-image forming colorless coupler, a magenta-image forming colorless coupler, and a cyan-image forming colorless coupler.

17. The silver halide light-sensitive material of claim 1 wherein the silver halide emulsion layer further comprises a two-equivalent yellow coupler, a two-equivalent magenta coupler, and a two-equivalent cyan coupler.

18. The silver halide light-sensitive material of claim 1 wherein the light-sensitive material comprises a colored coupler as the non-eluting and non-decoloring dye.

19. A monochrome-image forming silver halide light-sensitive material comprising a silver halide emulsion layer which is sensitive to all of blue light, green light, and red light, wherein the light-sensitive material is colored orange by a dye or pigment so that transmitting density of the orange coloration after photographic processing on an unexposed portion under the status M condition is from 0.37 to 0.75 for blue light measurement density, from 0.32 to 0.55 for green light measurement density, and from 0.05 to 0.30 for red light measurement density.

20. The silver halide light-sensitive material of claim 19 wherein the light-sensitive material comprises a colored coupler as the dye.

21. The silver halide light-sensitive material of claim 19 wherein the silver halide emulsion layer comprises a colored coupler selected from the group consisting of yellow colored magenta coupler, a magenta colored cyan coupler, and a yellow colored cyan coupler.

22. The silver halide light-sensitive material of claim 19 wherein a silver halide emulsion in the silver halide emulsion layer is a mixture of a blue sensitive silver halide emulsion, a green sensitive silver halide emulsion and a red sensitive silver halide emulsion.

23. A silver halide light-sensitive material of claim 19 wherein a silver halide emulsion in the silver halide emulsion layer is panchromatically sensitized.

24. A silver halide light-sensitive material of claim 19 wherein yellow, magenta, and cyan couplers are mixed in the silver halide emulsion layer.

25. A silver halide light-sensitive material of claim 19 wherein the light-sensitive material comprises yellow, magenta, and cyan couplers, and spectral sensitivity distribution of silver halide covers all of the visible regions in all layers.

26. The silver halide light-sensitive material of claim 19 further having an identical printing level to at least one of the silver halide color light-sensitive materials provided for a negative-positive type color photographic system.

27. The silver halide light-sensitive material of claim 19 wherein the silver halide emulsion layer further comprises a black dye image forming coupler.

28. The silver halide light-sensitive material of claim 19 wherein the silver halide emulsion layer further comprises a yellow-image forming colorless coupler, a magenta-image forming colorless coupler, and a cyan-image forming colorless coupler.

29. The silver halide light-sensitive material of claim 19 wherein the silver halide emulsion layer further comprises a two-equivalent yellow coupler, a two-equivalent magenta coupler and a two-equivalent cyan coupler.

* * * * *

UNITED STATES PATENT AND TRADEMARK OFFICE

CERTIFICATE OF CORRECTION

PATENT NO. : 6,027,868

DATED : February 22, 2000

INVENTOR(S) : M. IWAGAKI, et al

It is certified that error appears in the above-identified patent and that said Letters Patent is hereby corrected as shown below:

On the title page, Item [22], cancel "Mar. 25, 1997" insert -- Mar. 6, 1997--.

Signed and Sealed this

Twenty-seventh Day of February, 2001

Attest:

Nicholas P. Godici

NICHOLAS P. GODICI

Attesting Officer

Acting Director of the United States Patent and Trademark Office